US008340552B2

(12) United States Patent
Maehata et al.

(10) Patent No.: US 8,340,552 B2
(45) Date of Patent: Dec. 25, 2012

(54) IMAGE FORMING APPARATUS

(75) Inventors: Yasuhiro Maehata, Kanagawa (JP); Tetsuji Nishikawa, Tokyo (JP); Masahiro Ishida, Kanagawa (JP); Yasuhisa Ehara, Kanagawa (JP); Noriaki Funamoto, Tokyo (JP); Jun Yasuda, Chiba (JP)

(73) Assignee: Ricoh Company, Limited, Tokyo (JP)

( * ) Notice: Subject to any disclaimer, the term of this patent is extended or adjusted under 35 U.S.C. 154(b) by 457 days.

(21) Appl. No.: 12/659,647

(22) Filed: Mar. 16, 2010

(65) Prior Publication Data

US 2010/0239318 A1 Sep. 23, 2010

(30) Foreign Application Priority Data

Mar. 17, 2009 (JP) ..... 2009-064952
Mar. 17, 2009 (JP) ..... 2009-064979

(51) Int. Cl.
*G03G 15/01* (2006.01)
*G03G 15/00* (2006.01)
*G03G 15/16* (2006.01)

(52) U.S. Cl. ..... 399/167; 399/66; 399/159; 399/236; 399/309

(58) Field of Classification Search ..... 399/53, 399/66, 159, 165, 167, 236, 309; 347/19; 318/683
See application file for complete search history.

(56) References Cited

U.S. PATENT DOCUMENTS

2002/0051028 A1* 5/2002 Kobayashi et al. ..... 347/19
2006/0275056 A1* 12/2006 Matsuda et al. ..... 399/301
2008/0231223 A1* 9/2008 Imai et al. ..... 318/683

FOREIGN PATENT DOCUMENTS

JP 2002-182450 6/2002
JP 3455067 7/2003
JP 2003-329090 11/2003
JP 2004-117386 4/2004

OTHER PUBLICATIONS

Abstract of JP 11-024356, Published on Jan. 29, 1999.

* cited by examiner

*Primary Examiner* — Walter L Lindsay, Jr.
*Assistant Examiner* — Jessica L Eley
(74) *Attorney, Agent, or Firm* — Harness, Dickey & Pierce, P.L.C.

(57) ABSTRACT

A printer according to the present invention is a so-called tandem-type printer, and has a configuration that a motor gear is directly connected to an M-photoconductor driving gear and an idler gear is directly connected to a Y-photoconductor driving gear and the M-photoconductor driving gear. A diameter of the Y and M photoconductors driving gear, a distance between transfer sections of the Y and M photoconductors, a motor gear input angle, and an idler input angle are set so that an absolute value of a value obtained by subtracting 1 from an ideal amplitude ratio, which indicates a ratio of an ideal amplitude of an eccentric component of the Y-photoconductor driving gear to an actual amplitude of an eccentric component of the M-photoconductor driving gear, is equal to or less than a maximum allowable amplitude ratio.

14 Claims, 26 Drawing Sheets

IMAGE FORMING APPARATUS

CROSS-REFERENCE TO RELATED APPLICATIONS

The present application claims priority to and incorporates by reference the entire contents of Japanese Patent Application No. 2009-064952 filed in Japan on Mar. 17, 2009 and Japanese Patent Application No. 2009-064979 filed in Japan on Mar. 17, 2009.

BACKGROUND OF THE INVENTION

1. Field of the Invention

The present invention relates to an image forming apparatus, such as a copier, a printer, or a facsimile machine, that includes two or more latent-image carriers of which the surfaces go around the respective latent-image carriers, such as photoconductors, to be aligned in a surface moving direction of an object onto which an image is to be transferred, such as an intermediate transfer medium or a recording material, and obtains a final image by transferring visible images, which are obtained by developing respective latent images on the surfaces of the latent-image carriers, onto the object in a superimposed manner.

2. Description of the Related Art

As this type of image forming apparatus, for example, a tandem-type image forming apparatus including four photoconductors (latent-image carriers) for forming yellow, magenta, cyan, and black visible images, respectively, has been conventionally known. In the image forming apparatus that transfers respective visible images formed on the photoconductors onto an object in a superimposed manner, to reduce a degree of relative transfer misalignment among the visible images transferred onto the object (hereinafter, arbitrarily referred to as "color shift") is important in improving the image quality.

As causes of color shift, there is radial run-out of a photoconductor driving gear (a driven transmission rotating body), which is fixed to a rotating shaft of a photoconductor, due to eccentricity of the photoconductor driving gear. The color shift caused by the radial run-out is explained in detail below. The photoconductor driving gear has the radial run-out due to its own eccentricity, and rotates at the lowest angular velocity when a portion of which having the longest radius engages with a motor gear or an idler gear that transmits a rotational driving force to the photoconductor driving gear. Thus, if other fluctuation components that can fluctuate the linear velocity of the photoconductor are not taken into consideration, the photoconductor provided with the photoconductor driving gear has the lowest angular velocity at this time, and also has the lowest linear velocity at this time. Furthermore, from the same point of view, when a portion of the photoconductor driving gear having the shortest radius engages with the motor gear or the idler gear, the photoconductor driving gear rotates at the highest angular velocity, and the photoconductor provided with this photoconductor driving gear has the highest linear velocity. The former portion causing the photoconductor to have the lowest linear velocity and the latter portion causing the photoconductor to have the highest linear velocity are located at positions symmetrical with respect to a point of the rotation center of the photoconductor driving gear, i.e., at rotational positions different by 180°. Therefore, the angular velocity of the photoconductor driving gear has a sinusoidal fluctuation component with a period corresponding to one revolution of the photoconductor driving gear, and thus the sinusoidal fluctuation component with the period corresponding to one revolution of the photoconductor driving gear is seen in the linear velocity of the photoconductor. A toner image (a visible image) transferred onto the object from the photoconductor when the photoconductor rotates at the linear velocity of around the upper limit of the fluctuation component has a contracted shape that an original shape is contracted in a sub-scanning direction (the surface moving direction of the object). In contrast, a toner image transferred onto the object from the photoconductor when the photoconductor rotates at the linear velocity of around the lower limit of the fluctuation component has an elongated shape that an original shape is elongated in the sub-scanning direction. Accordingly, when a toner image on one of two photoconductors and a toner image on the other photoconductor are transferred onto the same point on the object, if one of the toner images has the most contracted shape and the other toner image has the most elongated shape, the maximum degree of color shift occurs.

Usually, the same gears are used as the photoconductor driving gears provided to the photoconductors, so it can be said that an amplitude value of radial run-out of each of the photoconductor driving gears due to its own eccentricity is the same. Therefore, an amplitude value of the fluctuation component seen in the linear velocity of the photoconductor due to the eccentricity is the same, and a maximum amount of elongation/contraction of a toner image transferred onto the object due to this is the same. Therefore, if relative rotational positions of the photoconductor driving gears are adjusted so that toner images having the most contracted shape or toner images having the most elongated shape are transferred onto the same point on the object, color shift due to the eccentricities of the photoconductor driving gears can be prevented in theory.

As a configuration for driving three or more photoconductors, there has been conventionally known a configuration that a motor gear (a drive transmission rotating body) connected to a drive source is directly connected to each two photoconductor driving gears of those provided to the photoconductors thereby driving two photoconductors provided with the two photoconductor driving gears. In this configuration, by adjusting a phase of eccentricity of the photoconductor driving gear provided to one of the two photoconductors at a point of time when a specific point on an object (an arbitrary point in the surface moving direction of the object) passes through a transfer section of the one photoconductor to coincide with a phase of eccentricity of the photoconductor driving gear provided to the other photoconductor at a point of time when the specific point passes through a transfer section of the other photoconductor, color shift due to the eccentricities of the photoconductor driving gears can be prevented in theory. However, in this configuration, at least two drive sources are necessary, and problems of rising cost and difficulty in downsizing of the apparatus occur.

On the other hand, as another configuration for driving three or more photoconductors, there has been also known a configuration that a motor gear connected to a drive source is directly connected to some of photoconductor driving gears and is connected to the rest of the photoconductor driving gears via another photoconductor driving gear and an idler gear (a driven rotating body) (see, for example, Japanese Patent Application Laid-open No. 2003-329090 and Japanese Patent Application Laid-open No. 2004-117386). In this configuration, all photoconductors can be driven by the single drive source, and thus it is possible to achieve cost reduction and downsizing of the apparatus as compared with the foregoing configuration that the motor gear is directly connected to the photoconductor driving gears without using an idler gear.

However, the conventional configuration using the idler gear has a problem that even if relative rotational positions of two photoconductor driving gears connected to each other via the idler gear are adjusted as described above, color shift due to the eccentricities of the photoconductor driving gears still occurs.

This problem is explained with an example where the two photoconductor driving gears connected to each other via the idler gear are composed of the photoconductor driving gear directly connected to the motor gear connected to the drive source (hereinafter, referred to as a "second photoconductor driving gear") and the photoconductor driving gear to which a rotational driving force is transmitted through the idler gear that rotates in accordance with rotation of the second photoconductor driving gear (hereinafter, referred to as a "first photoconductor driving gear"). In this example, eccentricity of the photoconductor driving gear that affects the fluctuation component of the linear velocity of the photoconductor provided to the second photoconductor driving gear (hereinafter, referred to as a "second photoconductor") is only eccentricity of the second photoconductor driving gear provided to the second photoconductor. On the other hand, eccentricity of the photoconductor driving gear that affects the fluctuation component of the linear velocity of the photoconductor provided to the first photoconductor driving gear (hereinafter, referred to as a "first photoconductor") includes not only eccentricity of the first photoconductor driving gear provided to the first photoconductor but also the eccentricity of the second photoconductor driving gear transmitted via the idler gear. In other words, the angular velocity of the first photoconductor driving gear includes composite wave of the fluctuation components due to the eccentricities of the both photoconductor driving gears (hereinafter, referred to as a "composite-wave fluctuation component"); as a result, this composite-wave fluctuation component is seen as a linear-velocity fluctuation component in the linear velocity of the first photoconductor.

In this configuration, when the adjustment described above is made, relative rotational positions of the first photoconductor driving gear and the second photoconductor driving gear are set so that a phase of the composite-wave fluctuation component of the angular velocity of the first photoconductor driving gear at a point of time when a specific point on the object passes through a transfer section of the first photoconductor coincides with a phase of the fluctuation component of the angular velocity of the second photoconductor driving gear due to the eccentricity of the second photoconductor driving gear at a point of time when the specific point passes through a transfer section of the second photoconductor. Consequently, toner images having the most contracted shape or toner images having the most elongated shape are transferred onto the same point on the object.

If a distance between the transfer sections of the first and second photoconductors is configured to be equal to an integral multiple of the circumferential length of these photoconductors, even when the same gears are used as the photoconductor driving gears, an amplitude value of the composite-wave fluctuation component of the angular velocity of the first photoconductor driving gear can coincide with an amplitude value of the fluctuation component of the angular velocity of the second photoconductor driving gear due to the eccentricity of the second photoconductor driving gear. Therefore, if this configuration is employed, color shift due to the eccentricities of the photoconductor driving gears can be prevented by the adjustment described above.

However, if this configuration is employed, the internal layout of the image forming apparatus is much limited, and it is not possible to meet demands, for example, a demand to downsize the apparatus as compact as possible by reducing the distance between the transfer sections to be smaller than the integral multiple of the circumferential length of the photoconductors as much as possible. Furthermore, this configuration may not be employed by other limitations. Therefore, in the conventional image forming apparatus, generally, the distance between the transfer sections of the first and second photoconductors is configured to deviate from a value of the integral multiple of the circumferential length of these photoconductors. In this case, an amplitude value of the composite-wave fluctuation component of the angular velocity of the first photoconductor driving gear does not coincide with an amplitude value of the fluctuation component of the angular velocity of the second photoconductor driving gear due to the eccentricity of the second photoconductor driving gear. As a result, an amplitude value of the linear-velocity fluctuation component of the first photoconductor does not coincide with an amplitude value of the linear-velocity fluctuation component of the second photoconductor, and thus an amount of contraction in the sub-scanning direction of a toner image having the most contracted shape on the object or an amount of elongation in the sub-scanning direction of a toner image having the most elongated shape on the object differs between the first photoconductor and the second photoconductor. Therefore, even if it is adjusted so that toner images having the most contracted shape or toner images having the most elongated shape are transferred onto the same point on the object, color shift corresponding to a difference in amount of contraction or elongation (hereinafter, referred to as "specific color shift") still occurs.

The specific color shift can be prevented from occurring by making the adjustment described above if separate rotating bodies having a different amount of eccentricity from each other are used as the first and second photoconductor driving gears and if an amount of eccentricity of the first photoconductor driving gear is set to an amount capable of eliminating the specific color shift. However, using gears having a different amount of eccentricity from each other as the first and second photoconductor driving gears becomes a factor causing the rising cost, and the difficulty of manufacturing the first photoconductor driving gear having an amount of eccentricity capable of eliminating the specific color shift is another factor causing the rising cost.

The present invention is made in view of the above problems, and an object of the present invention is to provide an image forming apparatus capable of reducing a degree of specific color shift that may occur between two driven transmission rotating bodies, such as photoconductor driving gears, connected to each other via a driven rotating body, such as an idler gear, even if the same rotating bodies are used as these driven transmission rotating bodies when a distance between transfer sections of first and second latent-image carriers is configured to deviate from a value of an integral multiple of the circumferential length of these latent-image carriers for downsizing of the apparatus or the like.

SUMMARY OF THE INVENTION

It is an object of the present invention to at least partially solve the problems in the conventional technology.

According to an aspect of the present invention, there is provided an image forming apparatus that includes two or more latent-image carriers of which the surfaces go around the respective latent-image carriers to be aligned in a surface moving direction of an object onto which visible images are to be transferred, and obtains a final image in such a manner that the image forming apparatus causes the surfaces of the latent-image carriers to go around the respective latent-image carriers by transmitting a rotational driving force from a drive source to respective driven transmission rotating bodies provided to the latent-image carriers, and transfers visible images, which are obtained by developing respective latent images on the surfaces of the latent-image carriers formed at predetermined latent-image forming points, onto the object in a superimposed manner, wherein a distance L between transfer sections of two latent-image carriers having the same diameter R is configured to deviate from a value of an integral multiple of a circumferential length πR of the two latent-image carriers, a first driven transmission rotating body provided to a first latent-image carrier, one located on the upstream side in the surface moving direction of the object out of the two latent-image carriers, and a second driven transmission rotating body provided to a second latent-image carrier, the other one located on the downstream side in the surface moving direction of the object out of the two latent-image carriers, are each made up of the same rotating body, relative rotational positions of the first driven transmission rotating body and the second driven transmission rotating body are set so that a phase of a fluctuation component of angular velocity of the first driven transmission rotating body due to eccentricity of the first driven transmission rotating body and eccentricity of the second driven transmission rotating body at a point of time when a specific point on the object passes through the transfer section of the first latent-image carrier coincides with a phase of a fluctuation component of angular velocity of the second driven transmission rotating body due to the eccentricity of the second driven transmission rotating body at a point of time when the specific point passes through the transfer section of the second latent-image carrier, a drive transmission rotating body connected to the side of the drive source is directly connected to the second driven transmission rotating body, and a driven rotating body, which rotates dependently, is directly connected to the first driven transmission rotating body and the second driven transmission rotating body, whereby both the first latent-image carrier and the second latent-image carrier are driven by the rotational driving force transmitted through the drive transmission rotating body, the driven rotating body is arranged so that the rotation center of the driven rotating body is located on the upstream side of a first virtual straight line connecting the rotation center of the first driven transmission rotating body and the rotation center of the second driven transmission rotating body in a rotating direction of the second driven transmission rotating body when viewed from a direction of a rotating shaft of the driven rotating body, and on the assumption that an angle between the first virtual straight line and a second virtual straight line connecting the rotation center of the second driven transmission rotating body and the rotation center of the drive transmission rotating body when viewed from the direction of the rotating shaft of the driven rotating body is defined as a with a direction opposite to the rotating direction of the second driven transmission rotating body as positive, and an angle between the first virtual straight line and a third virtual straight line connecting the rotation center of the first driven transmission rotating body and the rotation center of the driven rotating body when viewed from the direction of the rotating shaft of the driven rotating body is defined as β with a direction opposite to a rotating direction of the first driven transmission rotating body as positive, when an ideal amplitude ratio Y, which indicates a ratio of an ideal amplitude of radial run-out of the first driven transmission rotating body that can theoretically zero relative transfer misalignment which occurs between the first latent-image carrier and the second latent-image carrier due to the eccentricities of the first driven transmission rotating body and the second driven transmission rotating body to an actual amplitude of radial run-out of the second driven transmission rotating body due to the eccentricity that the second driven transmission rotating body has, is defined by the following Equation (1), the diameter R of the two latent-image carriers, the distance L between the transfer sections of the two latent-image carriers, the angle α, and the angle β are set so that an absolute value of a value obtained by subtracting 1 from the ideal amplitude ratio Y is equal to or smaller than a maximum allowable amplitude ratio indicating a ratio of 10 μm, a maximum allowable amount of the transfer misalignment, to the actual amplitude of the radial run-out of the second driven transmission rotating body:

$$Y=\sqrt{A^2+B^2}\cos(\omega t-C) \tag{1}$$

a period of Y being L/πR, and A, B, and C in the above Equation (1) being defined by the following Equations (2) to (4), respectively:

$$A=\cos(X+\alpha-\beta)-Z\times\cos(\theta-\beta) \tag{2}$$

$$B=\sin(X+\alpha-\beta)-Z\times\sin(\theta-\beta) \tag{3}$$

$$\cos C=\frac{A}{\sqrt{A^2+B^2}} \tag{4}$$

X and Z in the above Equations (2) and (3) being defined by the following Equations (5) and (6), respectively:

$$X[°]=\frac{L-\pi R}{\pi R}\times 360 \tag{5}$$

$$Z=\sqrt{\begin{array}{l}(|A_M|\cos\theta_M+|A_M|\cos(\theta_I+\pi))^2+\\(|A_M|\sin\theta_M+|A_M|\sin(\theta_I+\pi))^2\end{array}} \tag{6}$$

$A_M$ denoting an amplitude of the eccentricity of the second driven transmission rotating body, $\theta_M$ equaling α, and $\theta_I$ equaling (180−β).

According to another aspect of the present invention, there is provided an image forming apparatus that includes two or more latent-image carriers of which the surfaces go around the respective latent-image carriers to be aligned in a surface moving direction of an object onto which visible images are to be transferred, and obtains a final image in such a manner that the image forming apparatus causes the surfaces of the latent-image carriers to go around the respective latent-image carriers by transmitting a rotational driving force from a drive source to respective driven transmission rotating bodies provided to the latent-image carriers, and transfers visible images, which are obtained by developing respective latent images on the surfaces of the latent-image carriers formed at predetermined latent-image forming points, onto the object in a superimposed manner, wherein a distance L between transfer sections of two latent-image carriers having the same diameter R is configured to deviate from a value of an integral multiple of a circumferential length πR of the two latent-image carriers, a first driven transmission rotating body provided to a first latent-image carrier, one located on the downstream side in the surface moving direction of the object out of the two latent-image carriers, and a second driven transmission rotating body provided to a second latent-image carrier, the other one located on the upstream side in the surface moving direction of the object out of the two latent-image carriers, are each made up of the same rotating body, relative rotational positions of the first driven transmission rotating body and the second driven transmission rotating body are set so that a phase of a fluctuation component of angular velocity of the first driven transmission rotating body due to eccentricity of the first driven transmission rotating body and eccentricity of the second driven transmission rotating body at a point of time when a specific point on the object passes through the transfer section of the first latent-image carrier coincides with a phase of a fluctuation component of angular velocity of the second driven transmission rotating body due to the eccentricity of the second driven transmission rotating body at a point of time when the specific point passes through the transfer section of the second latent-image carrier, a drive transmission rotating body connected to the side of the drive source is directly connected to the second driven transmission rotating body, and a driven rotating body, which rotates dependently, is directly connected to the first driven transmission rotating body and the second driven transmission rotating body, whereby both the first latent-image carrier and the second latent-image carrier are driven by the rotational driving force transmitted through the drive transmission rotating body, the driven rotating body is arranged so that the rotation center of the driven rotating body is located on the upstream side of a first virtual straight line connecting the rotation center of the first driven transmission rotating body and the rotation center of the second driven transmission rotating body in a rotating direction of the second driven transmission rotating body when viewed from a direction of a rotating shaft of the driven rotating body, and on the assumption that an angle between the first virtual straight line and a second virtual straight line connecting the rotation center of the second driven transmission rotating body and the rotation center of the drive transmission rotating body when viewed from the direction of the rotating shaft of the driven rotating body is defined as a with the rotating direction of the second driven transmission rotating body as positive, and an angle between the first virtual straight line and a third virtual straight line connecting the rotation center of the first driven transmission rotating body and the rotation center of the driven rotating body when viewed from the direction of the rotating shaft of the driven rotating body is defined as β with a rotating direction of the first driven transmission rotating body as positive, when an ideal amplitude ratio Y, which indicates a ratio of an ideal amplitude of radial run-out of the first driven transmission rotating body that can theoretically zero relative transfer misalignment which occurs between the first latent-image carrier and the second latent-image carrier due to the eccentricities of the first driven transmission rotating body and the second driven transmission rotating body to an actual amplitude of radial run-out of the second driven transmission rotating body due to the eccentricity that the second driven transmission rotating body has, is defined by the following Equation (11), the diameter R of the two latent-image carriers, the distance L between the transfer sections of the two latent-image carriers, the angle α, and the angle β are set so that an absolute value of a value obtained by subtracting 1 from the ideal amplitude ratio Y is equal to or smaller than a maximum allowable amplitude ratio indicating a ratio of 10 μm, a maximum allowable amount of the transfer misalignment, to the actual amplitude of the radial run-out of the second driven transmission rotating body:

$$Y=\sqrt{A^2+B^2}\cos(\omega t-C) \tag{1}$$

a period of Y being L/πR, and A, B, and C in the above Equation (1) being defined by the following Equations (12) to (14), respectively:

$$A=\cos(-X+\alpha-\beta)-Z\times\cos(\theta+\beta-180) \tag{12}$$

$$B=\sin(-X+\alpha-\beta)-Z\times\sin(\theta+\beta-180) \tag{13}$$

$$\cos C=\frac{A}{\sqrt{A^2+B^2}} \tag{4}$$

X and Z in the above Equations (12) and (13) being defined by the following Equations (15) and (16), respectively:

$$X[°]=\frac{L-\pi R}{\pi R}\times 360 \tag{15}$$

$$Z=\sqrt{\begin{array}{c}(|A_M|\cos\theta_M+|A_M|\cos(\theta_I+\pi))^2+\\(|A_M|\sin\theta_M+|A_M|\sin(\theta_I+\pi))^2\end{array}} \tag{16}$$

$A_M$ denoting an amplitude of the eccentricity of the second driven transmission rotating body, $\theta_M$ equaling 180−α, and $\theta_I$ equaling β.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below.

A first embodiment of an electro-photographic printer (hereinafter, referred to as just a "printer") as an image forming apparatus according to the present invention is explained below.

Figure 1:
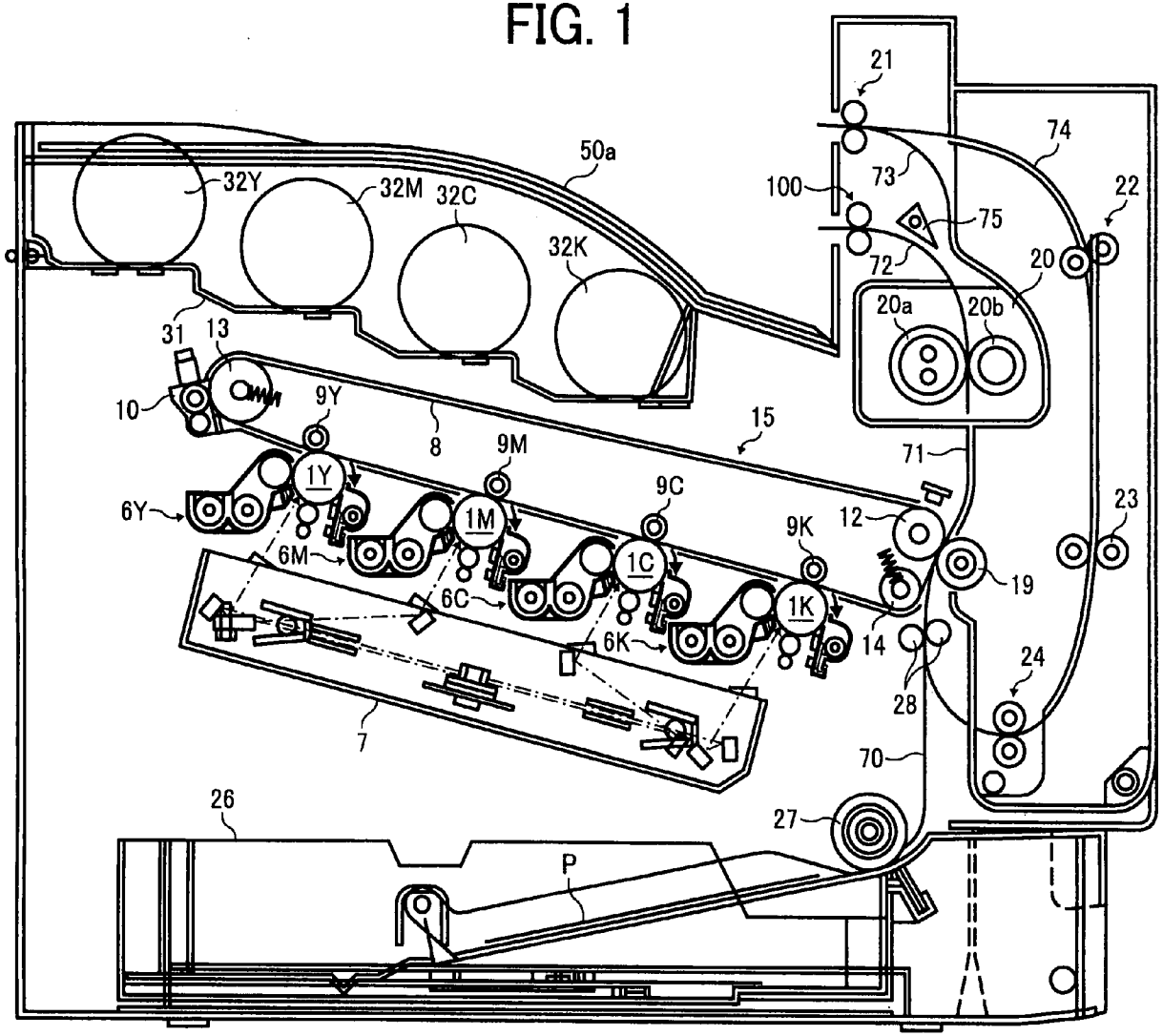
FIG. 1 is a schematic configuration diagram illustrating a printer according to embodiments.

FIG. 1 is a schematic configuration diagram illustrating the printer according to the embodiment.

Figure 2:
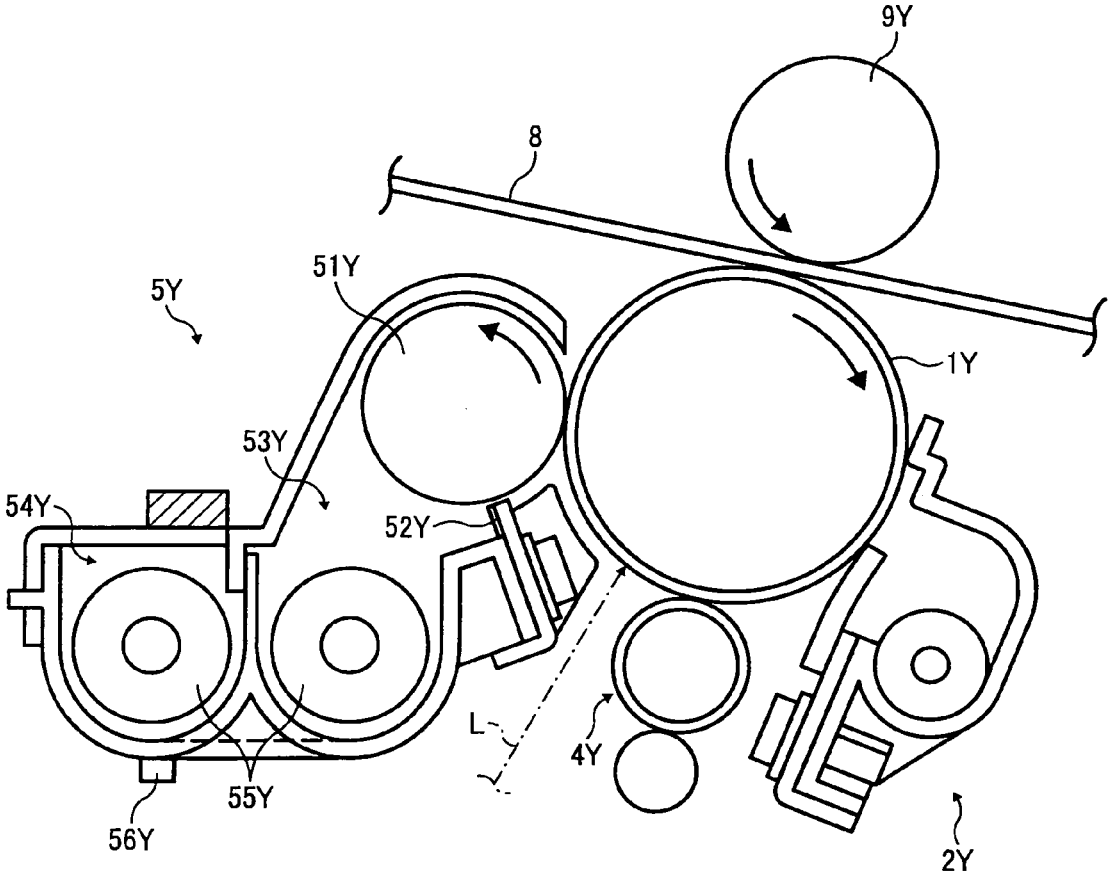
FIG. 2 is a schematic configuration diagram illustrating one of process units in the printer.

As shown in FIG. 1, the printer according to the embodiment includes four process units 6Y, 6M, 6C, and 6K for forming yellow (Y), magenta (M), cyan (C), and black (K) toner images (visible images), respectively. The process units 6Y, 6M, 6C, and 6K have the same configuration except for the color of toner used therein. Each of the process units 6Y, 6M, 6C, and 6K is replaced with new one at the end of life. To take the process unit 6Y for forming a Y-toner image as an example, as shown in FIG. 2, the process unit 6Y includes a drum-shaped photoconductor 1Y as a latent-image carrier, a drum cleaning unit 2Y, a static eliminator (not shown), a charging unit 4Y, a developing unit 5Y, and the like. The process unit 6Y as an image forming unit is removably attached to a main body of the printer so that wear-out parts can be replaced with new ones at a time.

The photoconductor 1Y is driven to rotate in a clockwise direction in the drawing by a drive means (not shown), and the surface of which is uniformly charged by the charging unit 4Y. The uniformly-charged surface of the photoconductor 1Y is exposed to a laser light L, i.e., is scanned by the laser light L, and carries an electrostatic latent image for a Y-color image. The Y electrostatic latent image is developed into a Y-toner image by the developing unit 5Y using Y-developer containing Y-toner and a magnetic carrier. Then, the Y-toner image is intermediately transferred onto an intermediate transfer belt 8, as an object, to be described below. The drum cleaning unit 2Y cleans up residual toner remaining on the surface of the photoconductor 1Y after the intermediate transfer process. The static eliminator removes residual electric charge from the photoconductor 1Y after being cleaned. By the removal of residual electric charge, the surface of the photoconductor 1Y is initialized, and prepared for next image formation. As for in the other process units 6M, 6C, and 6K, in the same manner as in the process unit 6Y, M, C, and K toner images are formed on photoconductors 1M, 1C, and 1K, respectively, and intermediately transferred onto the intermediate transfer belt 8.

The developing unit 5Y includes a developing roller 51Y provided so as to be partially exposed through an opening of a casing thereof. The developing unit 5Y further includes two conveying screws 55Y provided to be parallel to each other, a doctor blade 52Y, a toner-concentration sensor (hereinafter, referred to as a "T sensor") 56Y, and the like.

Inside the casing of the developing unit 5Y, Y-developer (not shown) containing a magnetic carrier and Y-toner is housed. The Y-developer is subjected to frictional electrification while being agitated and conveyed by the two conveying screws 55Y, and after that, the Y-developer is held on the surface of the developing roller 51Y. Then, the thickness of the Y-developer is controlled by the doctor blade 52Y, and after that, the Y-developer is conveyed to a developing area opposed to the photoconductor 1Y. In the developing area, the Y-toner is transferred to the electrostatic latent image on the photoconductor 1. By the transfer of the Y-toner, a Y-toner image is formed on the photoconductor 1. The Y-developer that the Y-toner is consumed by the development is returned into the casing in accordance with rotation of the developing roller 51Y.

A partition is provided between the two conveying screws 55Y. By this partition, inside the casing is separated into a first supply unit 53Y in which the developing roller 51Y, the conveying screw 55Y on the right side in the drawing, and the like are housed and a second supply unit 54Y in which the conveying screw 55Y on the left side in the drawing is housed. The conveying screw 55Y on the right side in the drawing is driven to rotate by a drive means (not shown), and conveys Y-developer in the first supply unit 53Y from the front side to the back side in the drawing to supply the Y-developer to the developing roller 51Y. The Y-developer conveyed to near an end of the first supply unit 53Y by the conveying screw 55Y on the right side in the drawing passes through one of openings (not shown) formed on the partition, and goes into the second supply unit 54Y. In the second supply unit 54Y, the conveying screw 55Y on the left side in the drawing is driven to rotate by a drive means (not shown), and conveys the Y-developer conveyed from the first supply unit 53Y in a direction opposite to that of the conveying screw 55Y on the right side in the drawing. The Y-developer conveyed to near an end of the second supply unit 54Y by the conveying screw 55Y on the left side in the drawing passes through the other opening (not shown) formed on the partition, and goes back into the first supply unit 53Y.

The T sensor 56Y made up of a magnetic permeability sensor is provided to a bottom wall of the second supply unit 54Y, and outputs a voltage of a value depending on a magnetic permeability of the Y-developer passing over the T sensor 56Y. Since a magnetic permeability of two-component developer containing toner and a magnetic carrier has a good correlation with a toner concentration, the T sensor 56Y outputs a voltage of a value depending on a concentration of the Y-toner. The value of output voltage is transmitted to a control unit (not shown). The control unit includes a random access memory (RAM), and Y Vtref, a target value of output voltage from the T sensor 56Y, is stored in the RAM. In the RAM, data on M Vtref, C Vtref, and K Vtref, which are respective target values of output voltage from T sensors (not shown) mounted in the other developing units, is also stored. The Y Vtref is used for drive control of a Y-toner conveying unit to be described below. Specifically, the control unit controls the Y-toner conveying unit (not shown) to replenish inside the second supply unit 54Y with Y-toner so that a value of output voltage from the T sensor 56Y becomes close to the Y Vtref. By the replenishment, the concentration of Y-toner contained in Y-developer in the developing unit 5Y is maintained within a predetermined range. As for in the developing units of the other process units, the same toner-replenishment control is implemented with respective M, C, and K toner conveying units.

As shown in FIG. 1, an optical writing unit 7 as a latent-image forming means is provided below the process units 6Y, 6M, 6C, and 6K. The optical writing unit 7 scans the respective photoconductors in the process units 6Y, 6M, 6C, and 6K by laser lights L emitted on the basis of image information. By the scanning, Y, M, C, and K electrostatic latent images are formed on the photoconductors 1Y, 1M, 1C, and 1K, respectively. Incidentally, the optical writing unit 7 exposes the photoconductors to the laser lights L, which are emitted from a light source and reflected on a polygon mirror driven to rotate by a motor to be deflected in a main scanning direction, via a plurality of optical lenses and mirrors.

On the lower side of the optical writing unit 7 in the drawing, a paper containing means including a paper cassette 26, a paper feed roller 27 built into the paper cassette 26, and the like is provided. The paper cassette 26 contains therein multiple sheets of transfer paper P, which are sheet-like recording media, stacked on top of one another. The paper feed roller 27 is in contact with the top transfer paper P. When the paper feed roller 27 is driven to rotate counterclockwise in the drawing by a drive means (not shown), the top sheet of transfer paper P is fed toward a paper feed path 70.

A pair of registration rollers 28 is provided near an end of the paper feed path 70. The pair of registration rollers 28 rotates to sandwich the transfer paper P between the rollers; soon after sandwiching the transfer paper P between the rollers, the pair of registration rollers 28 temporarily stops rotating. Then, the pair of registration rollers 28 conveys the transfer paper P toward a secondary transfer nip to be described below at an appropriate timing.

On the upper side of the process units 6Y, 6M, 6C, and 6K, a transfer unit 15 causing the intermediate transfer belt 8 as an intermediate transfer medium, an object, to move endlessly while supporting the intermediate transfer belt 8 in a tensioned manner is provided. The transfer unit 15 includes a secondary transfer bias roller 19 and a cleaning unit 10 in addition to the intermediate transfer belt 8. The transfer unit 15 further includes four primary transfer bias rollers 9Y, 9M, 9C, and 9K, a drive roller 12, a cleaning backup roller 13, and a tension roller 14. The intermediate transfer belt 8 moves endlessly in the counterclockwise direction in the drawing in accordance with rotation of the drive roller 12 with the intermediate transfer belt 8 tensioned by being supported by these seven rollers. The endlessly-moving intermediate transfer belt 8 is sandwiched between the primary transfer bias rollers 9Y, 9M, 9C, and 9K and the photoconductors 1Y, 1M, 1C, and 1K, and primary transfer nips are formed between them. This configuration is for a method of applying a transfer bias of a polarity opposite to that of the toner (for example, a transfer bias of a positive polarity) to the back side of the intermediate transfer belt 8 (an inner circumferential surface of the loop). The rollers other than the primary transfer bias rollers 9Y, 9M, 9C, and 9K are all electrically grounded. While the intermediate transfer belt 8 sequentially passes through the respective primary transfer nips for transferring the Y, M, C, and K toner images in accordance with the endless movement, the Y, M, C, and K toner images on the photoconductors 1Y, 1M, 1C, and 1K are primarily transferred onto the intermediate transfer belt 8 in a superimposed manner. As a result, a superimposed four-color toner image (hereinafter, referred to as a "four-color toner image") is formed on the intermediate transfer belt 8.

The intermediate transfer belt 8 is sandwiched between the drive roller 12 and the secondary transfer bias roller 19, and a secondary transfer nip is formed between them. The four-color toner image, which is a visible image, formed on the intermediate transfer belt 8 is secondarily transferred onto the transfer paper P at the secondary transfer nip. The four-color toner image is combined with white color of the transfer paper P, and becomes a full-color toner image. Transfer residual toner, the toner which has not been transferred to the transfer paper P, remains on the intermediate transfer belt 8 after passing through the secondary transfer nip. The cleaning unit 10 cleans up the transfer residual toner remaining on the intermediate transfer belt 8. The transfer paper P on which the four-color toner image is secondarily transferred collectively at the secondary transfer nip is conveyed to a fixing unit 20 through a post-transfer conveying path 71.

The fixing unit 20 includes a fixing roller 20*a* containing a heat generating source, such as a halogen lamp, and a pressure roller 20*b* that rotates with having contact with the fixing roller 20*a* by applying a predetermined pressure to the fixing roller 20*a*; a fixing nip is formed between the fixing roller 20*a* and the pressure roller 20*b*. The transfer paper P conveyed into the fixing unit 20 is sandwiched in the fixing nip with the side on which the unfixed toner image is held being in close contact with the fixing roller 20*a*. The toner in the toner image is softened by the action of heat and pressure, and the full-color image is fixed on the transfer paper P.

After the transfer paper P on which the full-color image is fixed in the fixing unit 20 comes out of the fixing unit 20, the transfer paper P comes to a point branching into a paper discharge path 72 and a pre-reverse conveying path 73. A first switching claw 75 is swingably provided at this branching point, and switches the course of the transfer paper P by swinging. Specifically, if a tip of the first switching claw 75 is moved in a direction close to the pre-reverse conveying path 73, the course of the transfer paper P is directed toward the paper discharge path 72. Conversely, if the tip of the first switching claw 75 is moved in a direction away from the pre-reverse conveying path 73, the course of the transfer paper P is directed toward the pre-reverse conveying path 73.

When the course toward the paper discharge path 72 is selected by the first switching claw 75, the transfer paper P passes through a pair of paper discharge rollers 100 via the paper discharge path 72, and is discharged to the outside of the apparatus, and then stacked on a stack 50*a* provided on a top surface of a printer enclosure. On the other hand, when the course toward the pre-reverse conveying path 73 is selected by the first switching claw 75, the transfer paper P goes into a nip formed between a pair of reverse rollers 21 via the pre-reverse conveying path 73. The pair of reverse rollers 21 sandwiches the transfer paper P between the rollers and conveys the transfer paper P towards the stack 50*a*. Just before a trailing end of the transfer paper P goes into the nip, the pair of reverse rollers 21 rotates in the reverse direction. By the reverse rotation of the pair of reverse rollers 21, the transfer paper P is conveyed in the reverse direction, and goes into a reverse conveying path 74 from the side of the trailing end.

The reverse conveying path 74 has a shape extending from the upper side to the lower side in a vertical direction in a curve. A pair of first reverse conveying rollers 22, a pair of second reverse conveying rollers 23, and a pair of third reverse conveying rollers 24 are provided on the reverse conveying path 74. The transfer paper P is turned upside down by being conveyed while passing through nips formed between these pairs of rollers sequentially. The transfer paper P after being turned upside down is returned to the paper feed path 70, and again reaches the secondary transfer nip. At this time, the transfer paper P goes into the secondary transfer nip with the side on which no image is held being in close contact with the intermediate transfer belt 8, and a second four-color toner image on the intermediate transfer belt is secondarily transferred onto the side collectively. After that, the transfer paper P is stacked on the stack 50*a* on the outside of the apparatus via the post-transfer conveying path 71, the fixing unit 20, the paper discharge path 72, and the pair of paper discharge rollers 100. By such a reverse conveyance, full-color images are formed on the both sides of the transfer paper P.

A bottle supporting unit 31 is provided between the transfer unit 15 and the stack 50*a* located above the transfer unit 15. The bottle supporting unit 31 is equipped with toner bottles 32Y, 32M, 32C, and 32K, which are toner containing units containing Y, M, C, and K toners, respectively. The toner bottles 32Y, 32M, 32C, and 32K are arranged to be horizontally aligned at a slightly-inclined angle with one another, and the positions of the toner bottles 32Y, 32M, 32C, and 32K gradually lower in this order. The Y, M, C, and K toners in the toner bottles 32Y, 32M, 32C, and 32K are each timely supplied to the respective developing units in the process units 6Y, 6M, 6C, and 6K by the respective toner conveying units to be described below. These toner bottles 32Y, 32M, 32C, and 32K are removably attached to the main body of the printer independently from the process units 6Y, 6M, 6C, and 6K.

In a print job in a black-and-white mode, the present printer drives only the photoconductor 1K out of the four photoconductors 1Y, 1M, 1C, and 1K. At this time, by adjusting the posture of the transfer unit 15, the intermediate transfer belt 8 is brought into contact with only the photoconductor 1K out of the four photoconductors 1Y, 1M, 1C, and 1K. On the other hand, in a print job in a color mode, the present printer drives all the four photoconductors 1Y, 1M, 1C, and 1K. At this time, by adjusting the posture of the transfer unit 15, the intermediate transfer belt 8 is brought into contact with all the four photoconductors 1Y, 1M, 1C, and 1K.

A drive unit of the color photoconductors 1Y, 1M, and 1C, which is a characteristic part of the present invention, is explained below.

Figure 3:
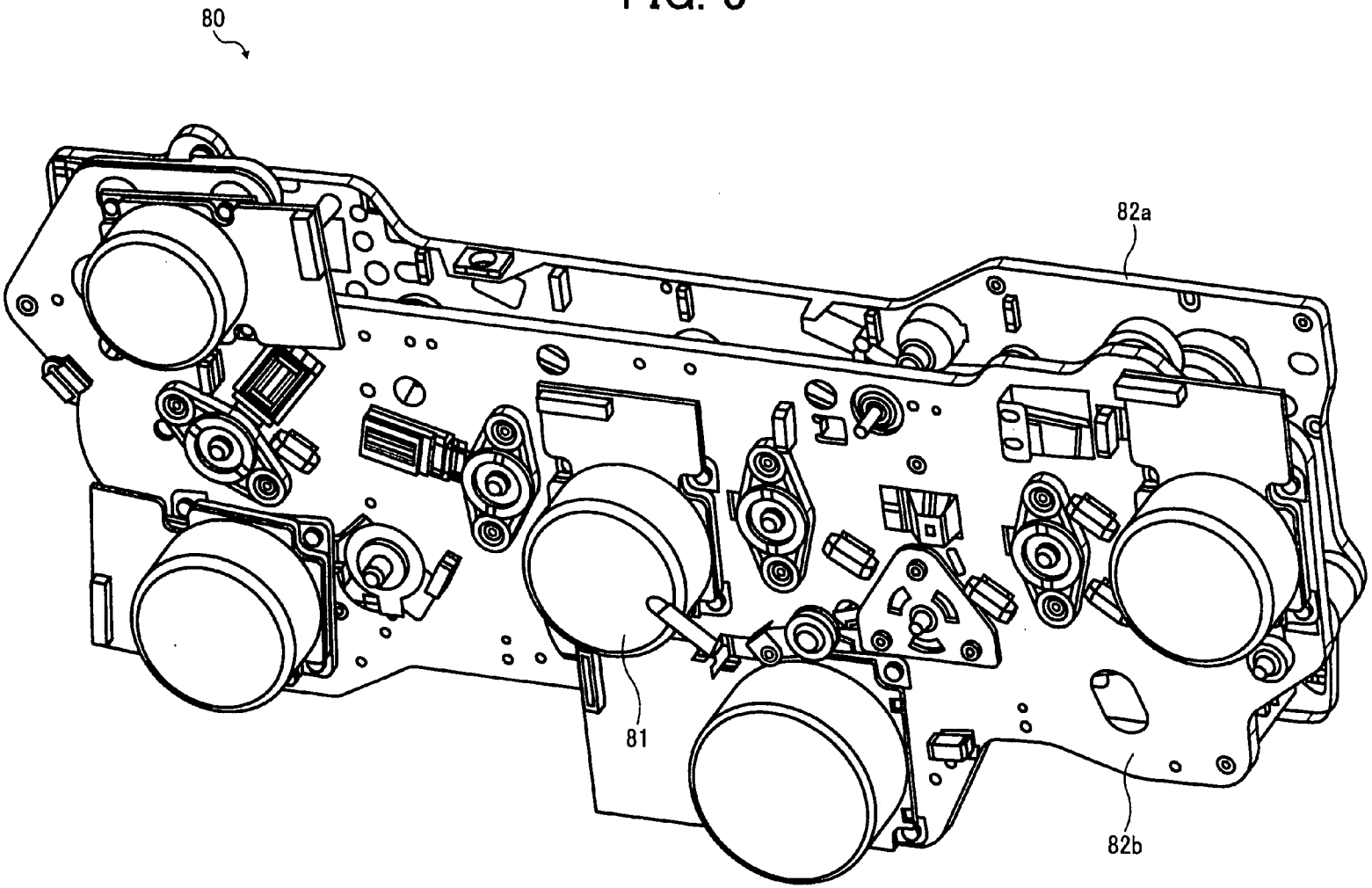
FIG. 3 is a perspective view of a drive unit of three color photoconductors provided to the printer when viewed from the side opposite to that is in FIG. 1.

FIG. 3 is a perspective view of the drive unit of the color photoconductors 1Y, 1M, and 1C when viewed from the side opposite to that is in FIG. 1.

A drive unit 80 is mainly composed of a motor 81 as a drive source, a driving-force transmitting unit for transmitting a rotational driving force from the motor 81 to each of the photoconductors 1Y, 1M, and 1C, and holding members 82*a* and 82*b* for holding these.

Figure 4:
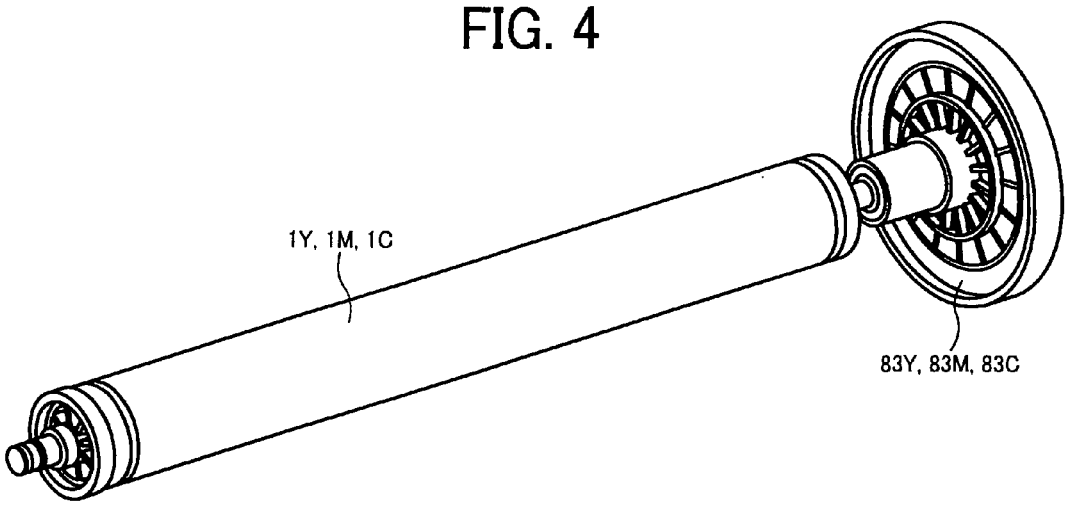
FIG. 4 is a perspective view of the color photoconductor that a photoconductor driving gear is fixed to a rotating shaft thereof.

FIG. 4 is a perspective view of the photoconductor (1Y, 1M, 1C) that a photoconductor driving gear (83Y, 83M, 83C) is fixed to a rotating shaft thereof.

Figure 5:
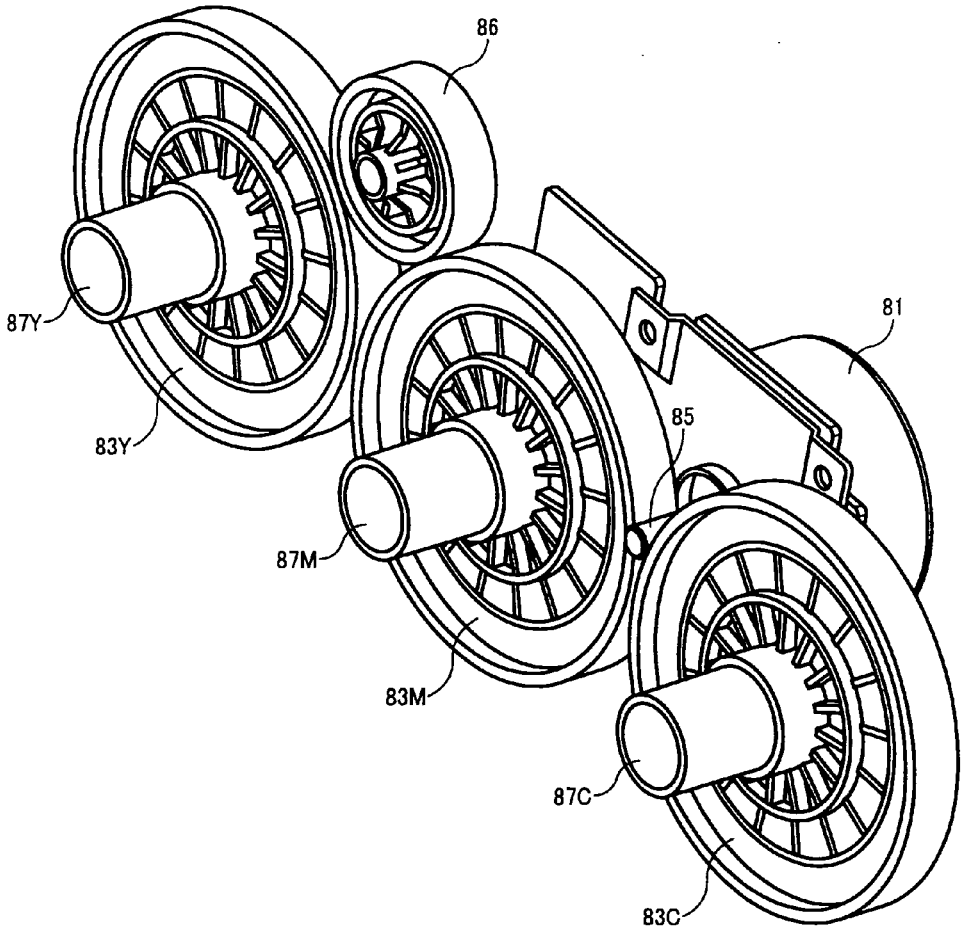
FIG. 5 is a perspective view illustrating a printer-main-body-side driving-force transmitting unit composing a driving-force transmitting unit.

FIG. 5 is a perspective view illustrating a printer-main-body-side driving-force transmitting unit composing the driving-force transmitting unit.

Figure 6:
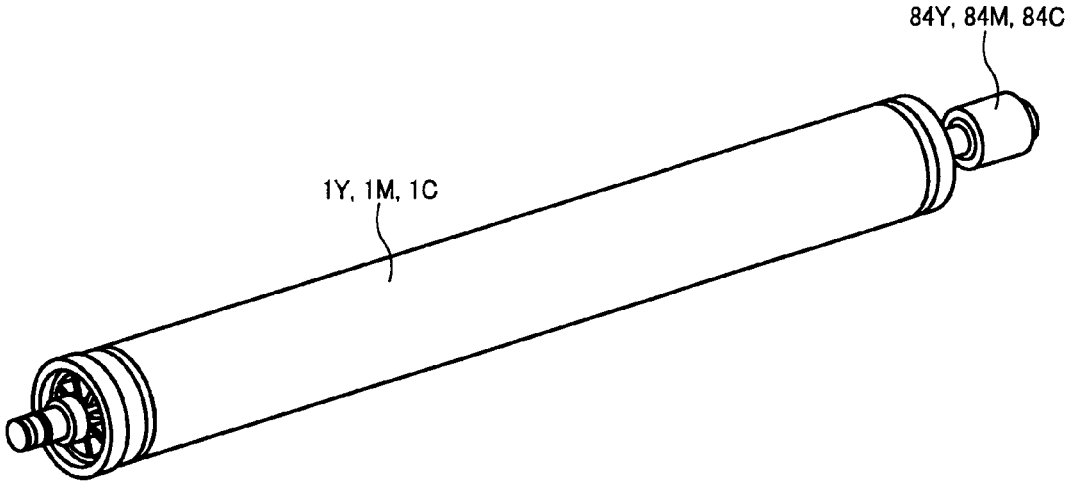
FIG. 6 is a perspective view illustrating a photoconductor-side driving-force transmitting unit composing the driving-force transmitting unit.

FIG. 6 is a perspective view illustrating a photoconductor-side driving-force transmitting unit composing the driving-force transmitting unit.

The driving-force transmitting unit is mainly composed of driven connections 84Y, 84M, and 84C that are respectively provided to the rotating shafts of the photoconductors 1Y, 1M, and 1C, the photoconductor driving gears 83Y, 83M, and 83C that are respectively fixed to the driven connections 84Y, 84M, and 84C, a motor gear 85 that is fixed to a shaft of the motor 81, and an idler gear 86. In the present embodiment, the photoconductor driving gears 83Y, 83M, and 83C are the same gears as one another. The driven connections 84Y, 84M, and 84C, which are respectively provided to the rotating shafts of the photoconductors 1Y, 1M, and 1C, are coaxially connected to drive connections 87Y, 87M, and 87C that are provided to the rotating shafts of the photoconductor driving gears 83Y, 83M, and 83C, respectively. Consequently, the photoconductors 1Y, 1M, and 1C each rotate together with the respective photoconductor driving gears 83Y, 83M, and 83C. Incidentally, the driven connections 84Y, 84M, and 84C, which are provided to the rotating shafts of the photoconductors 1Y, 1M, and 1C, and the photoconductor driving gears 83Y, 83M, and 83C can be integrally formed, or can be separately formed as those in the present embodiment.

Figure 7:
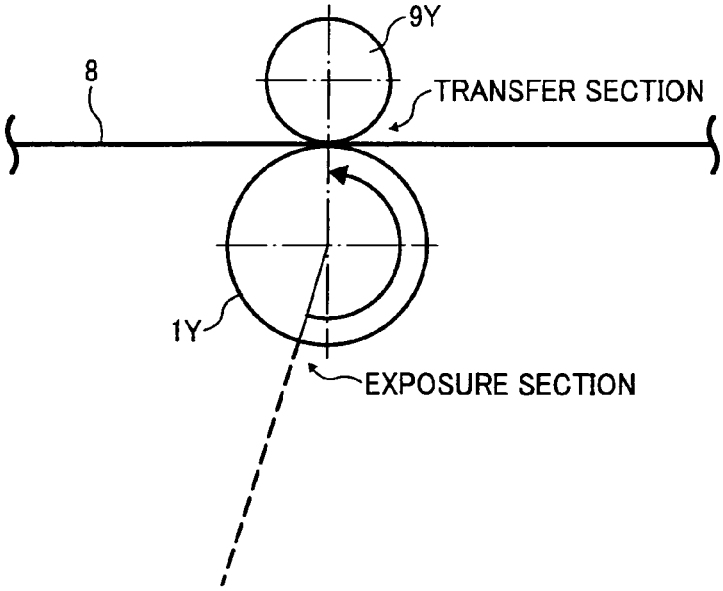
FIG. 7 is an explanatory diagram for explaining a relation between a distance between an exposure section and a transfer section and transfer misalignment (color shift)

Here, to take the photoconductor 1Y for forming a Y-toner image as an example, a relation between a distance between an exposure section where a latent image is formed and a transfer section and transfer misalignment (color shift) is explained with reference to FIG. 7.

If the angular velocity of the photoconductor 1Y fluctuates from any cause, the position of a portion of the photoconductor where an electrostatic latent image is formed at the exposure section when the angular velocity is high is displaced to the downstream side in a surface moving direction of the photoconductor from an original position. Furthermore, the position of a portion of the intermediate transfer belt 8 where a toner image is transferred at the transfer section when the angular velocity of the photoconductor 1Y is high is displaced to the upstream side in an surface moving direction of the intermediate transfer belt from an original position. Conversely, the position of a portion of the photoconductor where an electrostatic latent image is formed at the exposure section when the angular velocity of the photoconductor 1Y is low is displaced to the upstream side in the surface moving direction of the photoconductor from the original position, and the position of a portion of the intermediate transfer belt 8 where a toner image is transferred at the transfer section when the angular velocity of the photoconductor 1Y is low is displaced to the downstream side in the surface moving direction of the intermediate transfer belt from the original position.

However, even when the angular velocity of the photoconductor 1Y fluctuates, if there is no difference between the angular velocity at the time of exposure with respect to a specific point on the photoconductor and the angular velocity at the time of transfer, a toner image is transferred to the original position on the intermediate transfer belt 8. This is because, for example, an electrostatic latent image exposed when the angular velocity of the photoconductor 1Y is high is, as described above, formed at the position displaced to the downstream side in the surface moving direction of the photoconductor; however, if the angular velocity when a toner image corresponding to the electrostatic latent image is transferred at the transfer section is similarly high (is the same velocity), the toner image is, as described above, transferred to the position displaced to the upstream side in the surface moving direction of the intermediate transfer belt from the original position, and as a result, the displacement at the time of exposure and the displacement at the time of transfer are offset by each other. Therefore, if a fluctuation in angular velocity does not cause a difference between the angular velocity at the time of exposure and the angular velocity at the time of transfer, color shift among the photoconductors does not occur.

Subsequently, a gear configuration of the color photoconductors 1Y, 1M, and 1C in the present embodiment is explained.

Figure 8:
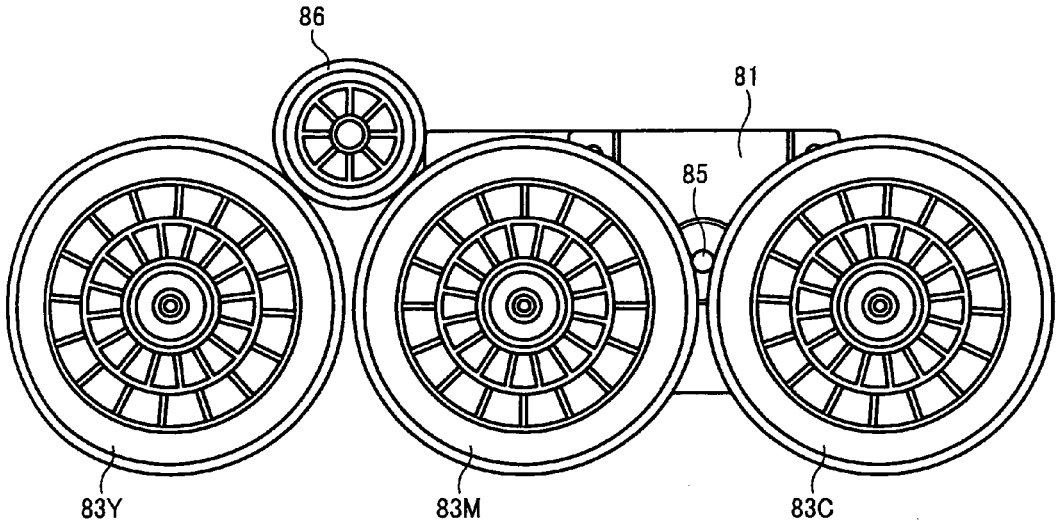
FIG. 8 is a front view illustrating arrangement of the photoconductor driving gears, a motor gear, and an idler gear when viewed from a direction of the rotating shafts of the three color photoconductors according to a first embodiment.

FIG. 8 is a front view illustrating arrangement of the photoconductor driving gears 83Y, 83M, and 83C, the motor gear 85, and the idler gear 86 when viewed from a direction of the rotating shafts of the photoconductors 1Y, 1M, and 1C.

Figure 9:
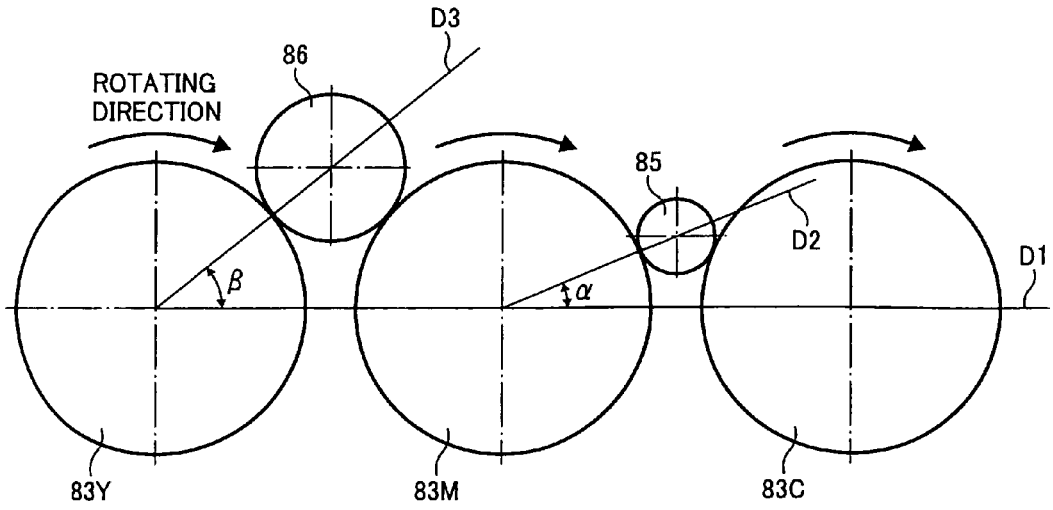
FIG. 9 is a schematic diagram illustrating a relative arrangement relation of the motor gear and the idler gear with respect to the three photoconductor driving gears according to the first embodiment.

FIG. 9 is a schematic diagram illustrating a relative arrangement relation of the motor gear 85 and the idler gear 86 with respect to the photoconductor driving gears 83Y, 83M, and 83C.

In the present embodiment, the motor gear 85, a drive transmission rotating body connected to the motor 81, is directly connected to the M-photoconductor driving gear 83M as a second driven transmission rotating body and the C-photoconductor driving gear 83C as a third driven transmission rotating body. Furthermore, the idler gear 86 as a driven rotating body is directly connected to the Y-photoconductor driving gear 83Y as a first driven transmission rotating body and the M-photoconductor driving gear 83M. Consequently, the three photoconductors 1Y, 1M, and 1C, including the Y-photoconductor 1Y as a first latent-image carrier and the M-photoconductor 1M as a second latent-image carrier, can be driven by a rotational driving force of the motor 81 transmitted through the motor gear 85.

As shown in FIG. 9, in the present embodiment, the idler gear 86 is arranged so that the rotation center of the idler gear 86 is located on the upstream side of a first virtual straight line D1 connecting the rotation center of the Y-photoconductor driving gear 83Y and the rotation center of the M-photoconductor driving gear 83M in a rotating direction of the M-photoconductor driving gear 83M when viewed from a direction of the rotating shaft of the idler gear 86.

Incidentally, in the present embodiment, an angle between the first virtual straight line D1 and a third virtual straight line D3 connecting the rotation center of the Y-photoconductor driving gear 83Y and the rotation center of the idler gear 86 (an idler input angle) is defined as β with a direction opposite to a rotating direction of the Y-photoconductor driving gear 83Y (a counterclockwise direction in FIG. 9) as positive. Therefore, in the present embodiment, the idler input angle β is a positive value.

Furthermore, as shown in FIG. 9, in the present embodiment, the motor gear 85 is arranged so that the rotation center of the motor gear 85 is located on the upstream side of the first virtual straight line D1 in the rotating direction of the M-photoconductor driving gear 83M when viewed from a direction of the rotating shaft of the motor gear 85.

Incidentally, in the present embodiment, an angle between the first virtual straight line D1 and a second virtual straight line D2 connecting the rotation center of the M-photoconductor driving gear 83M and the rotation center of the motor gear 85 (a motor input angle) is defined as α with the direction opposite to the rotating direction of the M-photoconductor driving gear 83M (the counterclockwise direction in FIG. 9) as positive. Therefore, in the present embodiment, the motor input angle α is a positive value.

Figure 10:
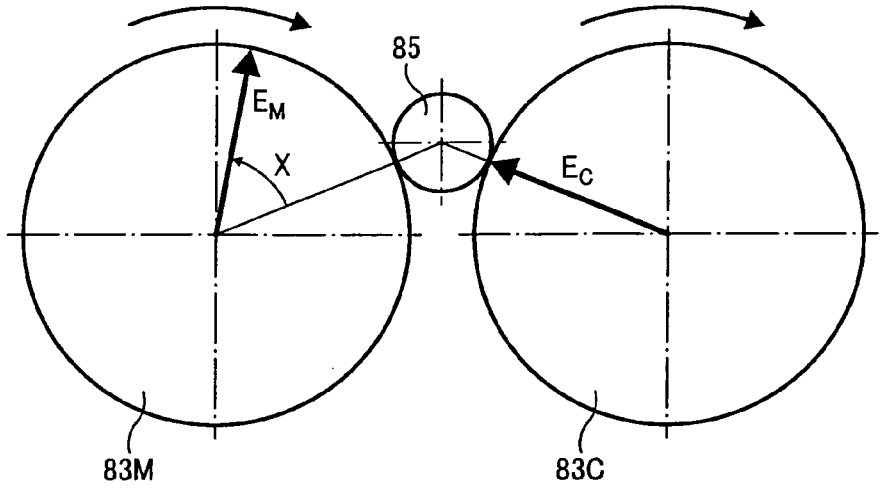
FIG. 10 is an explanatory diagram illustrating a phase relation of radial run-out due to eccentricity of the photoconductor driving gear in the two photoconductor driving gears directly connected to the motor gear according to the first embodiment.

FIG. 10 is an explanatory diagram illustrating a phase relation of radial run-out due to eccentricity of the photoconductor driving gear in the two photoconductor driving gears 83M and 83C directly connected to the motor gear 85.

In FIG. 10, $E_M$ and $E_C$ each denote a vector representing radial run-out due to eccentricity of each of the photoconductor driving gears 83M and 83C (hereinafter, referred to as an "eccentric component"), and a radial direction when the radial run-out due to the eccentricity of each of the photoconductor driving gears 83M and 83C reaches its peak (a radial direction of the longest radius) is set as a reference phase. Therefore, a direction of each of the vectors denoted by $E_M$ and $E_C$ in the drawing represents the reference phase. Furthermore, the length of each of the vectors denoted by $E_M$ and $E_C$ in the drawing represents the magnitude of radial run-out depending on an amount of eccentricity in the direction of each vector. Therefore, the length of each of the vectors denoted by $E_M$ and $E_C$ in the drawing represents an actual amplitude of the phase of eccentricity. However, the direction and length of each of the vectors in the drawing are hypothetical ones, and do not exactly correspond to the configuration in the present embodiment. Much the same is true on vectors described below.

To zero an amount of color shift in the two photoconductors 1M and 1C provided with the photoconductor driving gears 83M and 83C, it is only necessary to adjust a phase of an eccentric component $E_M$ of the photoconductor driving gear 83M at a point of time when a specific point on the intermediate transfer belt 8 (an arbitrary point in the surface moving direction of the intermediate transfer belt) passes through the transfer section of the photoconductor 1M, one of the photoconductors, and a phase of an eccentric component $E_C$ of the photoconductor driving gear 83C at a point of time when the specific point passes through the transfer section of the photoconductor 1C, the other photoconductor, to coincide with each other.

When the reference phases of the eccentric components $E_M$ and $E_C$ each point to the direction of the motor gear 85, the corresponding photoconductor driving gears 83M and 83C have the lowest angular velocity. Consequently, considering based on a point of time when the reference phase of the eccentric component $E_C$ of the photoconductor driving gear 83C of the C-photoconductor 1C located on the downstream side in the surface moving direction of the intermediate transfer belt points to the direction of the motor gear 85, it is only necessary to adjust the M-photoconductor driving gear 83M so that the reference phase of the eccentric component $E_M$ points to the direction that the reference phase of the eccentric component $E_M$ at the rotational position pointing to the direction of the motor gear 85 is counterrotated by X° calculated by the following Equation (7).

$$X[°] = \frac{L \times \text{st_num} - \pi R \times \text{st_num}}{\pi R} \times 360 \tag{7}$$

In the above Equation (7), "st_num" denotes what number photoconductor from the photoconductor as the basis of color shift (in the present embodiment, the C-photoconductor 1C) the M-photoconductor driving gear 83M is, and is 1 here.

Furthermore, in the above Equation (7), "L" denotes a distance between the transfer sections of the two photoconductors 1M and 1C, and "R" denotes a diameter of the two photoconductors 1M and 1C.

Incidentally, in the present embodiment, at least in the color photoconductors 1Y, 1M, and 1C, a distance between the adjacent transfer sections is always L and the diameter is always R because the same photoconductors are used as the color photoconductors 1Y, 1M, and 1C.

Figure 11:
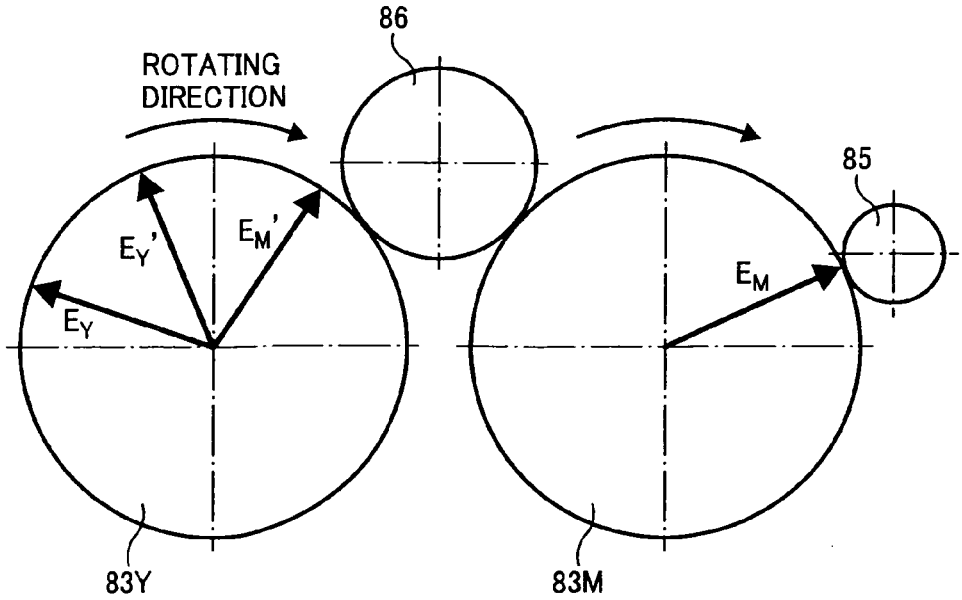
FIG. 11 is an explanatory diagram illustrating a phase relation of eccentric components of the photoconductor driving gears in the two photoconductor driving gears directly connected to the idler gear according to the first embodiment.

FIG. 11 is an explanatory diagram illustrating a phase relation of eccentric components of the photoconductor driving gears in the two photoconductor driving gears 83Y and 83M directly connected to the idler gear 86.

In FIG. 11, $E_Y$ denotes a vector representing radial run-out due to eccentricity of the photoconductor driving gear 83Y, i.e., an eccentric component of the photoconductor driving gear 83Y, and a radial direction when the radial run-out due to the eccentricity of the photoconductor driving gear 83Y reaches its peak (a radial direction of the longest radius) is set as a reference phase. Therefore, a direction of the vector denoted by $E_Y$ in the drawing represents the reference phase. Furthermore, the length of the vector denoted by $E_Y$ in the drawing represents the magnitude of radial run-out depending on an amount of eccentricity in the direction of the vector. Therefore, the length of the vector denoted by $E_Y$ in the drawing represents an actual amplitude of the eccentric component.

As described above, in the photoconductors 1M and 1C provided to the photoconductor driving gears 83M and 83C to which a rotational driving force is transmitted from the motor gear 85 directly, eccentricity of the photoconductor driving gear affecting a fluctuation component of the linear velocity of the corresponding photoconductor is only respective eccentricities of the photoconductor driving gears 83M and 83C. On the other hand, in the photoconductor 1Y provided to the Y-photoconductor driving gear 83Y to which a rotational driving force is transmitted from the idler gear 86, eccentricity of the photoconductor driving gear affecting a fluctuation component of the linear velocity of the corresponding photoconductor includes not only the eccentricity of the Y-photoconductor driving gear 83Y provided to the photoconductor 1Y but also the eccentricity of the M-photoconductor driving gear 83M transmitted via the idler gear 86. Namely, the angular velocity of the Y-photoconductor driving gear 83Y includes a fluctuation component due to a composite wave of eccentric components of the two photoconductor driving gears 83Y and 83M, and as a result, the fluctuation component due to the composite wave is seen as a linear-velocity fluctuation component in the linear velocity of the Y-photoconductor 1Y.

Figure 12:
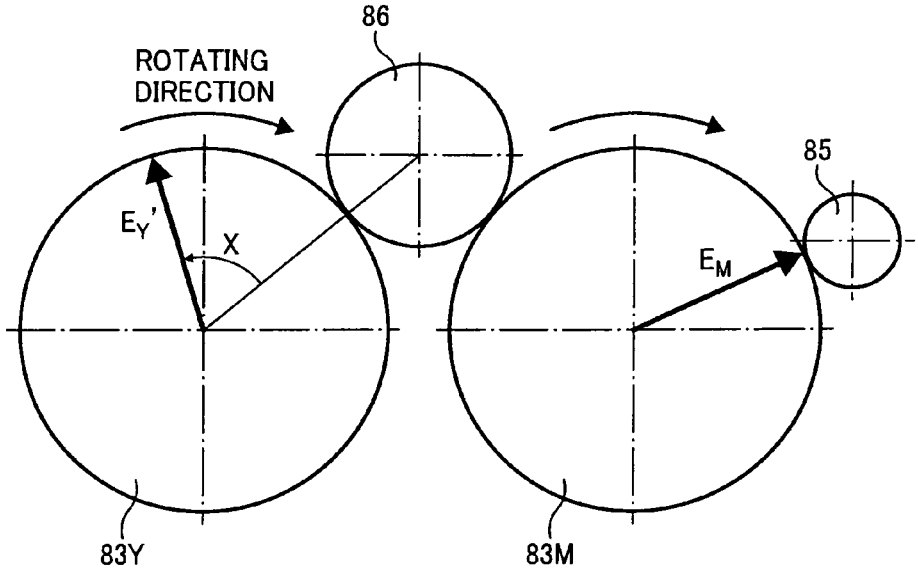
FIG. 12 is an explanatory diagram illustrating a phase relation of a composite eccentric component of the Y-photoconductor driving gear and an eccentric component of the M-photoconductor driving gear according to the first embodiment.

In FIG. 11, the eccentric component of the M-photoconductor driving gear 83M transmitted via the idler gear 86 is denoted by $E_M'$, and the composite wave of the eccentric component $E_M'$ and the eccentric component $E_Y$ of the Y-photoconductor driving gear 83Y (hereinafter, referred to as a "composite eccentric component") is denoted by $E_Y'$. Therefore, when the reference phase of the composite eccentric component $E_Y'$ points to the direction of the idler gear 86, the Y-photoconductor driving gear 83Y has the lowest angular velocity. Consequently, as shown in FIG. 12, considering based on a point of time when the reference phase of the eccentric component $E_M$ of the photoconductor driving gear 83M of the M-photoconductor 1M points to the direction of the motor gear 85, if the Y-photoconductor driving gear 83Y is adjusted so that the reference phase of the composite eccentric component $E_Y'$ points to the direction that the reference phase of the composite eccentric component $E_Y'$ at the rotational position pointing to the direction of the idler gear 86 is counterrotated by X° calculated by the above Equation (7), toner images having the most contracted shape or toner images having the most elongated shape among those on the color photoconductors 1Y, 1M, and 1C are transferred onto the same point on the intermediate transfer belt 8.

Figure 13:
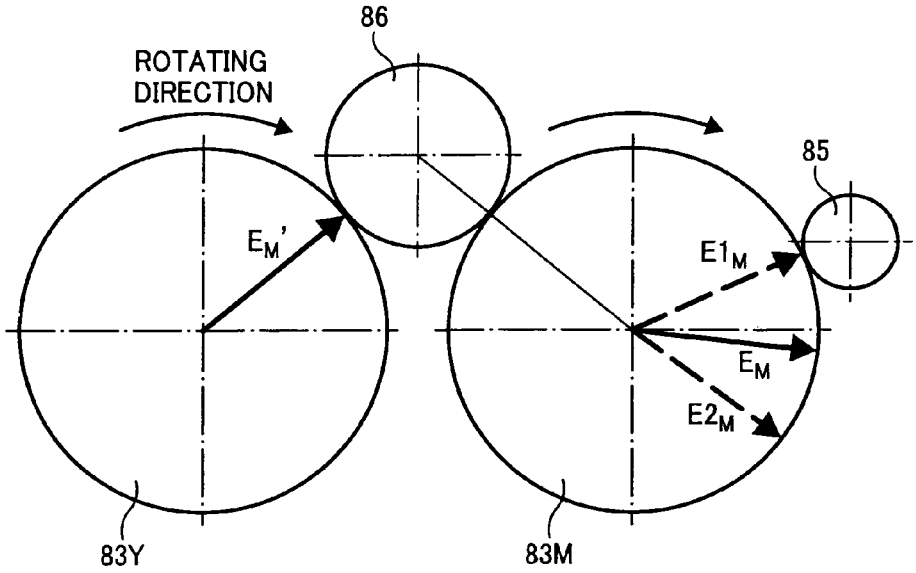
FIG. 13 is an explanatory diagram illustrating a positional relation of an eccentric component of the M-photoconductor driving gear and an eccentric component of the M-photoconductor driving gear transmitted to the Y-photoconductor driving gear via the idler gear according to the first embodiment.

FIG. 13 is an explanatory diagram illustrating a positional relation of the eccentric component $E_M$ of the M-photoconductor driving gear 83M and the eccentric component $E_M'$ of the M-photoconductor driving gear 83M transmitted to the Y-photoconductor driving gear 83Y via the idler gear 86.

When the M-photoconductor driving gear 83M has the lowest angular velocity, i.e., when the M-photoconductor 1M has the lowest angular velocity, the reference phase of the eccentric component $E_M$ of the M-photoconductor driving gear 83M points to the direction of the motor gear 85 (a direction indicated by $E1_M$ in FIG. 13) as described above. Furthermore, it takes the longest time to transmit the angular velocity of the M-photoconductor driving gear 83M to the idler gear 86 when the reference phase of the eccentric component $E_M$ of the M-photoconductor driving gear 83M points to a 180-degree opposite direction to the direction of the idler gear 86 (a direction indicated by $E2_M$ in FIG. 13). Accordingly, when the idler gear 86 has the lowest angular velocity, the reference phase of the eccentric component $E_M$ of the M-photoconductor driving gear 83M points to a direction midway between the direction indicated by $E1_M$ and the direction indicated by $E2_M$. At this time, the idler gear 86 has the lowest angular velocity, which means that the Y-photoconductor driving gear 83Y has the lowest linear velocity. Therefore, at this time, the reference phase of the eccentric component $E_M'$ of the M-photoconductor driving gear 83M transmitted to the Y-photoconductor driving gear 83Y via the idler gear 86 points to the direction of the idler gear 86.

From the above, a rotation angle θ when the idler gear 86 has the lowest angular velocity can be expressed by the following Equation (8). Furthermore, an amplitude amplification factor Z when the amplitude of the eccentric component $E_M$ of the M-photoconductor driving gear 83M is transmitted to the Y-photoconductor driving gear 83Y is defined by the following Equation (9).

$$\theta = \alpha - \frac{\beta + \alpha}{2} \tag{8}$$

$$Z = \sqrt{\begin{array}{l}(|A_M|\cos\theta_M + |A_M|\cos(\theta_I + \pi))^2 + \\ (|A_M|\sin\theta_M + |A_M|\sin(\theta_I + \pi))^2\end{array}} \tag{9}$$

Incidentally, "$A_M$" denotes the amplitude of the eccentricity of the M-photoconductor driving gear 83M; $\theta_M$ equals α; $\theta_I$ equals (180−β).

Figure 14:
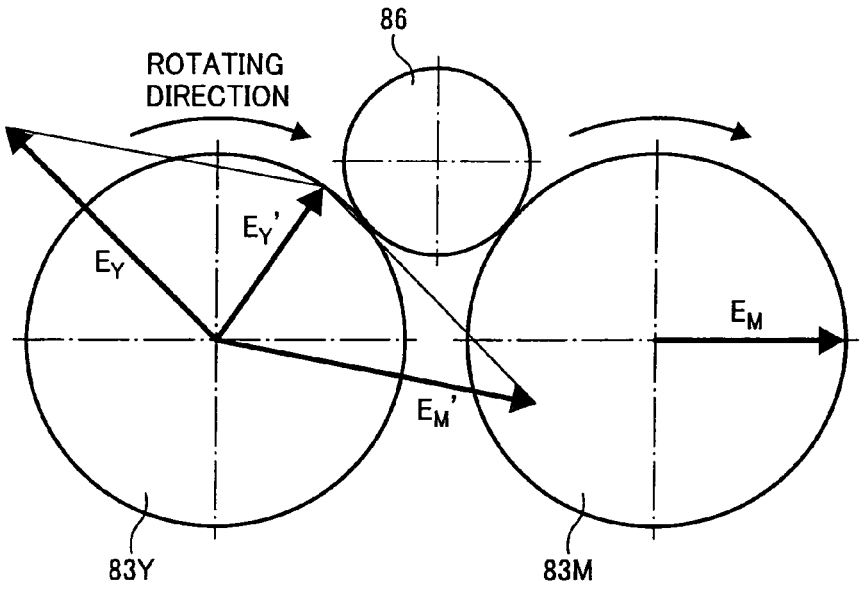
FIG. 14 is an explanatory diagram illustrating a relative rotational position (assembling position) of the Y-photoconductor driving gear with respect to the M-photoconductor driving gear according to the first embodiment.

FIG. 14 is an explanatory diagram illustrating a relative rotational position (assembling position) of the Y-photoconductor driving gear 83Y with respect to the M-photoconductor driving gear 83M.

When the eccentric component $E_M$ of the M-photoconductor driving gear 83M is defined by the following Equation (10), the composite eccentric component $E_Y'$ on the Y-photoconductor driving gear 83Y is expressed by the following Equation (11), and the eccentric component $E_M'$ of the M-photoconductor driving gear 83M transmitted to the Y-photoconductor driving gear 83Y via the idler gear 86 is expressed by the following Equation (12).

$$E_M = 1 \times \cos(\omega t + 0[°]) \tag{10}$$

$$E_Y' = 1 \times \cos(\omega t + (\beta - \alpha - X)) \tag{11}$$

$$E_M' = Z \times \cos(\omega t + (\beta - \theta)) \tag{12}$$

Since the eccentric component $E_Y$ of the Y-photoconductor driving gear 83Y is that the eccentric component $E_M'$ transmitted via the idler gear 86 is subtracted from the composite eccentric component $E_Y'$, the eccentric component $E_Y$ of the Y-photoconductor driving gear 83Y is expressed by the following Equation (13).

$$E_Y=\sqrt{A^2+B^2}\times\cos(\omega t-C) \quad (13)$$

Incidentally, a period of $E_Y$ is $L/\pi R$. Furthermore, A, B, and C in the above Equation (13) are defined by the following Equations (14) to (16), respectively.

$$A=\cos(X+\alpha-\beta)-Z\times\cos(\theta-\beta) \quad (14)$$

$$B=\sin(X+\alpha-\beta)-Z\times\sin(\theta-\beta) \quad (15)$$

$$\cos C=\frac{A}{\sqrt{A^2+B^2}} \quad (16)$$

When the above Equation (10) is compared with the above Equation (13), unless $(A^2+B^2)^{1/2}$, the amplitude of the eccentric component $E_Y$ of the Y-photoconductor driving gear 83Y, is 1, the amplitude of the composite eccentric component $E_Y'$ of the Y-photoconductor driving gear 83Y cannot coincide with the amplitude of the eccentric component $E_M$ of the M-photoconductor driving gear 83M. When these amplitudes are not coincident with each other, even if toner images having the most contracted shape or toner images having the most elongated shape among those on the color photoconductors 1Y, 1M, and 1C are adjusted to be transferred onto the same point on the intermediate transfer belt 8, specific color shift depending on a difference between the amplitudes occurs.

As a method for putting the amplitude $(A^2+B^2)^{1/2}$ of the eccentric component $E_Y$ of the Y-photoconductor driving gear 83Y into 1, there is a method of using a separate gear having a different amount of eccentricity from that of the M-photoconductor driving gear 83M as the Y-photoconductor driving gear 83Y. However, this method is not recommended because the production cost is increased as described above. Therefore, if the amplitude $(A^2+B^2)^{1/2}$ can be put into 1 or approximate 1 as close as possible by another method, specific color shift can be eliminated or reduced in the configuration that the same gears are used as the Y-photoconductor driving gear 83Y and the M-photoconductor driving gear 83M.

So, in the present embodiment, in the configuration that the same gears are used as the photoconductor driving gears 83Y, 83M, and 83C of the color photoconductors 1Y, 1M, and 1C, specific color shift due to the eccentric components $E_Y$, $E_M$, and $E_C$ of the photoconductor driving gears 83Y, 83M, and 83C is eliminated or reduced by employing the following configuration. Incidentally, since specific color shift does not occur in between the two photoconductor driving gears 83M and 83C directly connected to the motor gear 85, if specific color shift occurring in between the two photoconductor driving gears 83Y and 83M directly connected to the idler gear 86 can be eliminated or reduced, it is possible to eliminate or reduce specific color shift among the color photoconductors 1Y, 1M, and 1C.

Incidentally, radial run-out due to the eccentricity of the motor gear 85 or the idler gear 86 can influence the angular velocity of the photoconductors 1Y, 1M, and 1C; however, such an influence can be cancelled by configuring the motor gear 85 or the idler gear 86 to rotate an integer number of times while the photoconductors 1Y, 1M, and 1C each rotate from the exposure section to the transfer section. If it is configured like this, a point passing through the exposure section when the photoconductor has the highest angular velocity (linear velocity) because of the radial run-out due to the eccentricity of the motor gear 85 or the idler gear 86 passes through the transfer section when the photoconductor has the highest linear velocity. Therefore, if it is configured like this, there is no difference between the angular velocity at the time of exposure and the angular velocity at the time of transfer, and color shift due to the eccentricity of the motor gear 85 or the idler gear 86 does not occur as explained with reference to FIG. 7.

In general, it seems unlikely that the motor gear 85 and the idler gear 86 are bigger than the photoconductor driving gear, and thus the practically possible motor input angle $\alpha$ in the present embodiment is within a range of 0° to +60°, and the practically possible idler input angle $\beta$ in the present embodiment is also within a range of 0° to +60°.

Figure 15:
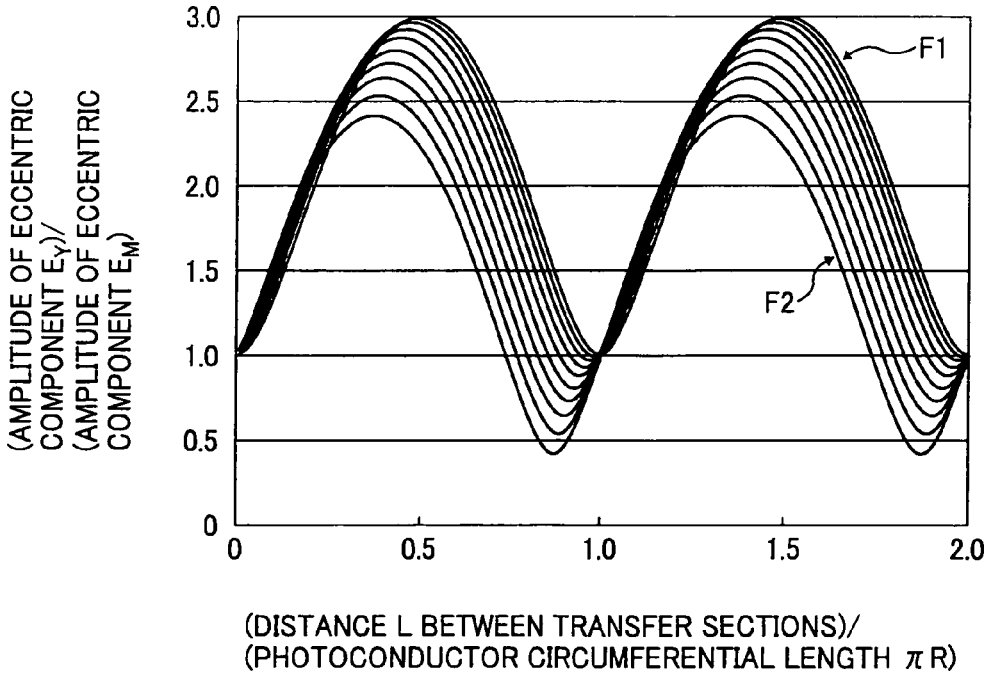
FIG. 15 is a graph illustrating a relation between an ideal amplitude ratio, which indicates a ratio of an ideal amplitude of an eccentric component of the Y-photoconductor driving gear that can theoretically zero specific color shift to an actual amplitude of an eccentric component of the M-photoconductor driving gear, and a value obtained by dividing a distance between transfer sections by a photoconductor circumferential length according to the first embodiment.

FIG. 15 is a graph illustrating a relation between an ideal amplitude ratio Y, which indicates a ratio of an ideal amplitude of the eccentric component $E_Y$ of the Y-photoconductor driving gear 83Y that can theoretically zero specific color shift to an actual amplitude of the eccentric component $E_M$ of the M-photoconductor driving gear 83M, and a value obtained by dividing a distance L between the transfer sections by a photoconductor circumferential length $\pi R$ in the configuration according to the present embodiment. The Y-axis of the graph denotes a ratio of the amplitude of the eccentric component $E_Y$ of the Y-photoconductor driving gear 83Y to the amplitude of the eccentric component $E_M$ of the M-photoconductor driving gear 83M.

A plurality of graphs depicted in FIG. 15 show trajectories of the ideal amplitude ratio Y that are depicted with run-out of a value obtained by dividing the distance L between the transfer sections by the photoconductor circumferential length $\pi R$ in conditions that the motor input angle $\alpha$ and the idler input angle $\beta$ are fixed. Specifically, the graph denoted by F1 is obtained in conditions that the motor input angle $\alpha$ and the idler input angle $\beta$ are the same angle, and the graph denoted by F2 is obtained in conditions that the motor input angle $\alpha$ is 30° and the idler input angle $\beta$ is 60°.

As shown in these graphs, if values of the motor input angle $\alpha$ and the idler input angle $\beta$ are changed, the relation of the ideal amplitude ratio Y and a value obtained by dividing the distance L between the transfer sections by the photoconductor circumferential length $\pi R$ is changed; however, in each case, a ratio of the amplitude of the eccentric component $E_Y$ to the amplitude of the eccentric component $E_M$ is inevitably 1, and a value obtained by dividing the distance L between the transfer sections by the photoconductor circumferential length $\pi R$ inevitably runs through a point of a positive integer. This means that even when the same gears having the same eccentric component are used as the Y-photoconductor driving gear 83Y and the M-photoconductor driving gear 83M, if the distance L between the transfer sections is configured to be equal to an integral multiple of the photoconductor circumferential length $\pi R$, specific color shift can be eliminated regardless of values of the motor input angle $\alpha$ and the idler input angle $\beta$. However, such a configuration is used mostly to make the distance L between the transfer sections smaller than a value of the integral multiple of the photoconductor circumferential length $\pi R$, especially to make the distance L between the transfer sections smaller than the photoconductor circumferential length $\pi R$ for downsizing of the present printer.

The graphs shown in FIG. 15 except the graph denoted by F1 run through a point where a ratio of the amplitude of the eccentric component $E_Y$ to the amplitude of the eccentric component $E_M$ is 1 when the distance L between the transfer sections is smaller than a value of the integral multiple of the photoconductor circumferential length $\pi R$. In the present embodiment, since the same gears are used as the Y-photoconductor driving gear 83Y and the M-photoconductor driving gear 83M, the ratio of the amplitude of the eccentric component $E_Y$ to the amplitude of the eccentric component $E_M$ is 1. Therefore, to cite the graph denoted by F2 as an example, if the motor input angle α is set at 30°, the idler input angle β is set at 60°, and the distance L between the transfer sections and the photoconductor circumferential length πR are set so that a value obtained by dividing the distance L between the transfer sections by the photoconductor circumferential length πR is equal to a value of the X-axis when the Y-axis of the graph (a ratio of the amplitude of the eccentric component $E_Y$ to the amplitude of the eccentric component $E_M$) is 1, even when the same gears are used as the Y-photoconductor driving gear 83Y and the M-photoconductor driving gear 83M, specific color shift can be eliminated with the distance L between the transfer sections set to be smaller than a value of the integral multiple of the photoconductor circumferential length πR.

Incidentally, there is no need to completely eliminate specific color shift in general, and it is only necessary to reduce the specific color shift to be within a required allowable range of an amount of specific color shift. The maximum allowable amount of specific color shift is supposedly set at about 10 μm in response to recent demands for high image quality. Thus, in the present embodiment, the diameter R of the photoconductors 1Y, 1M, and 1C, the distance L between the transfer sections, the motor input angle α, and the idler input angle β are set so that an absolute value of a value obtained by subtracting 1 from the ideal amplitude ratio Y is equal to or less than a maximum allowable amplitude ratio indicating a ratio of 10 μm, which is the maximum allowable amount with respect to an actual amplitude of the eccentric component $E_M$ of the M-photoconductor driving gear 83M.

If the actual amplitude of the eccentric component $E_M$ of the M-photoconductor driving gear 83M is 15 μm, the maximum allowable amplitude ratio is about 0.7. In this case, by setting the diameter R of the photoconductors 1Y, 1M, and 1C, the distance L between the transfer sections, the motor input angle α, and the idler input angle β so that the ideal amplitude ratio Y is within a range of 0.3 to 1.7, an amount of specific color shift can be suppressed to 10 μm or less with the distance L between the transfer sections set to be smaller than a value of the integral multiple of the photoconductor circumferential length πR even when the same gears are used as the Y-photoconductor driving gear 83Y and the M-photoconductor driving gear 83M.

Subsequently, an example of a phase adjusting means, which is a rotational-position adjusting means for adjusting relative rotational positions (assembling positions) of the photoconductor driving gears 83Y, 83M, and 83C, is explained.

Figure 16:
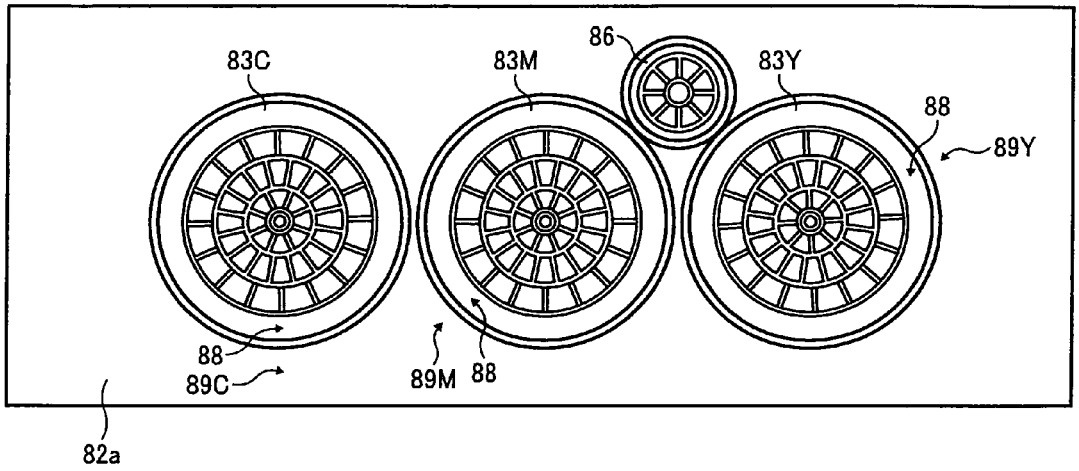
FIG. 16 is an explanatory diagram illustrating an example of a phase adjusting means that can be used in the first embodiment.

FIG. 16 is an explanatory diagram illustrating an example of the phase adjusting means that can be used in the present embodiment.

As the phase adjusting means, a phasing reference mark 88 is made on an axial end surface of each gear used as the photoconductor driving gears 83Y, 83M, and 83C. The mark 88 moves in circles centering around the gear shaft in accordance with the rotation of each of the photoconductor driving gears 83Y, 83M, and 83C. On the other hand, on the side of the holding member 82*a*, marks 89Y, 89M, and 89C are made on portions opposed (or closest) to the marks 88 when the rotational positions of the photoconductor driving gears 83Y, 83M, and 83C are adjusted as described above. Therefore, just by assembling these photoconductor driving gears 83Y, 83M, and 83C with the rotational positions adjusted so that the marks 88 are respectively opposed to the marks 89Y, 89M, and 89C, the rotational positions of the photoconductor driving gears 83Y, 83M, and 83C can be adjusted as described above, and color shift (including specific color shift) due to the eccentricities of the photoconductor driving gears 83Y, 83M, and 83C can be eliminated or reduced.

Figure 17:
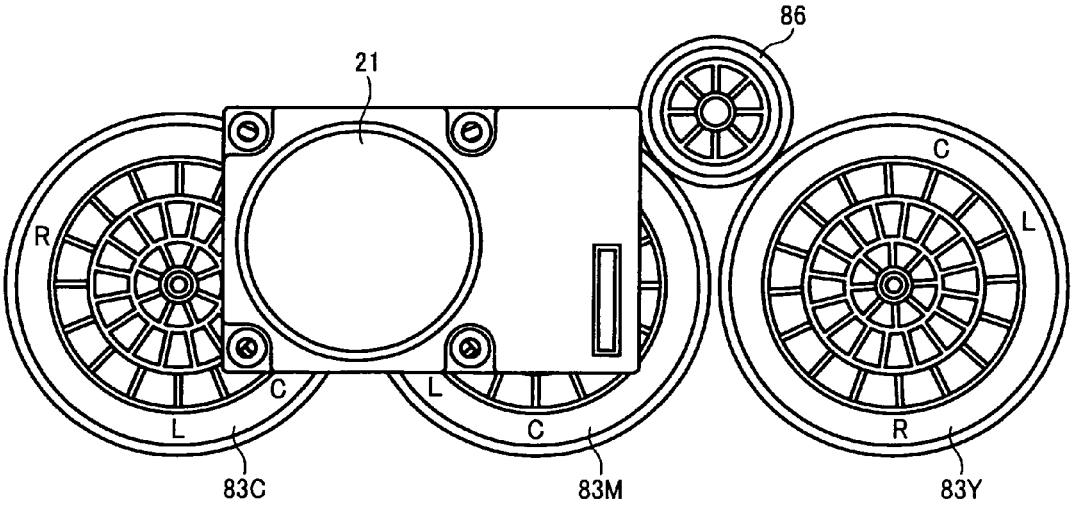
FIG. 17 is an explanatory diagram illustrating another example of the phase adjusting means that can be used in the first embodiment.

FIG. 17 is an explanatory diagram illustrating another example of the phase adjusting means that can be used in the embodiment.

In the phase adjusting means shown in FIG. 16, the positions of the marks 89Y, 89M, and 89C made on the side of the holding member 82*a* are limited, so an assembly worker may have difficulty seeing the marks 89Y, 89M, and 89C because the marks 89Y, 89M, and 89C are hidden behind other parts, or it may be difficult to make the marks 89Y, 89M, and 89C.

In the phase adjusting means shown in FIG. 17, three phasing reference marks R, C, and L corresponding to the photoconductor driving gears 83Y, 83M, and 83C, respectively, are made on the axial end surface of each gear used as the photoconductor driving gears 83Y, 83M, and 83C. The marks R, C, and L are made at the positions on the axial end surface of each gear so that the mark R on the Y-photoconductor driving gear 83Y, the mark C on the M-photoconductor driving gear 83M, and the mark L on the C-photoconductor driving gear 83C are located at the same rotational positions as one another (for example, at the positions on the lower side in the case shown in FIG. 17) after the adjustment of the rotational positions. Therefore, just by assembling these photoconductor driving gears 83Y, 83M, and 83C with the rotational positions adjusted so that the corresponding marks R, C, and L on the photoconductor driving gears 83Y, 83M, and 83C are located at the same rotational positions as one another, the rotational positions of the photoconductor driving gears 83Y, 83M, and 83C can be adjusted as described above, and color shift (including specific color shift) due to the eccentricities of the photoconductor driving gears 83Y, 83M, and 83C can be eliminated or reduced.

Figure 18:
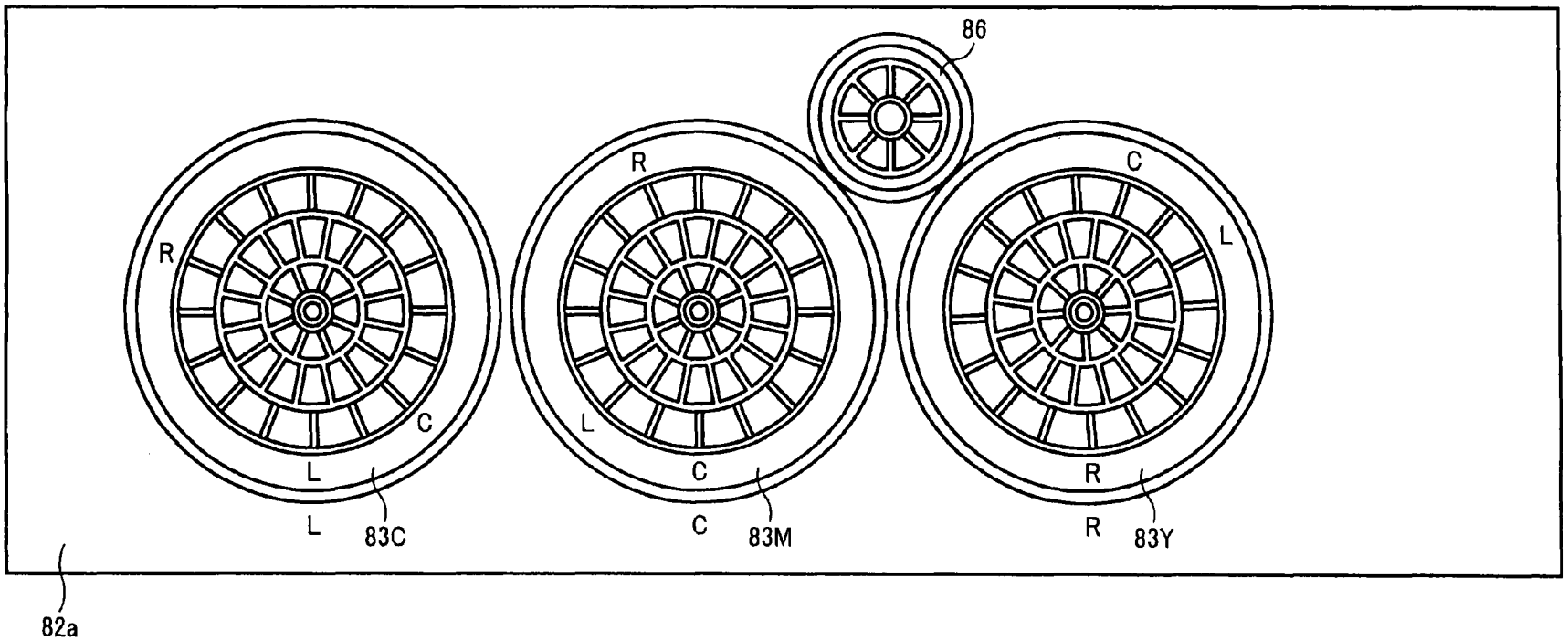
FIG. 18 is an explanatory diagram illustrating still another example of the phase adjusting means that can be used in the first embodiment.

FIG. 18 is an explanatory diagram illustrating still another example of the phase adjusting means that can be used in the embodiment.

In this example, in the same manner as the example shown in FIG. 17, three phasing reference marks R, C, and L corresponding to the photoconductor driving gears 83Y, 83M, and 83C, respectively, are made on the axial end surface of each gear used as the photoconductor driving gears 83Y, 83M, and 83C. Furthermore, on the side of the holding member 82*a*, the same marks R, C, and L are made on portions opposed (or closest) to the corresponding marks R, C, and L when the rotational positions of the photoconductor driving gears 83Y, 83M, and 83C are adjusted as described above. Therefore, just by assembling these photoconductor driving gears 83Y, 83M, and 83C with the rotational positions adjusted so that the marks R as for the Y-photoconductor driving gear 83Y, the marks C as for the M-photoconductor driving gear 83M, and the marks L as for the C-photoconductor driving gear 83C are opposed to each other, the rotational positions of the photoconductor driving gears 83Y, 83M, and 83C can be adjusted as described above, and color shift (including specific color shift) due to the eccentricities of the photoconductor driving gears 83Y, 83M, and 83C can be eliminated or reduced.

Figure 19:
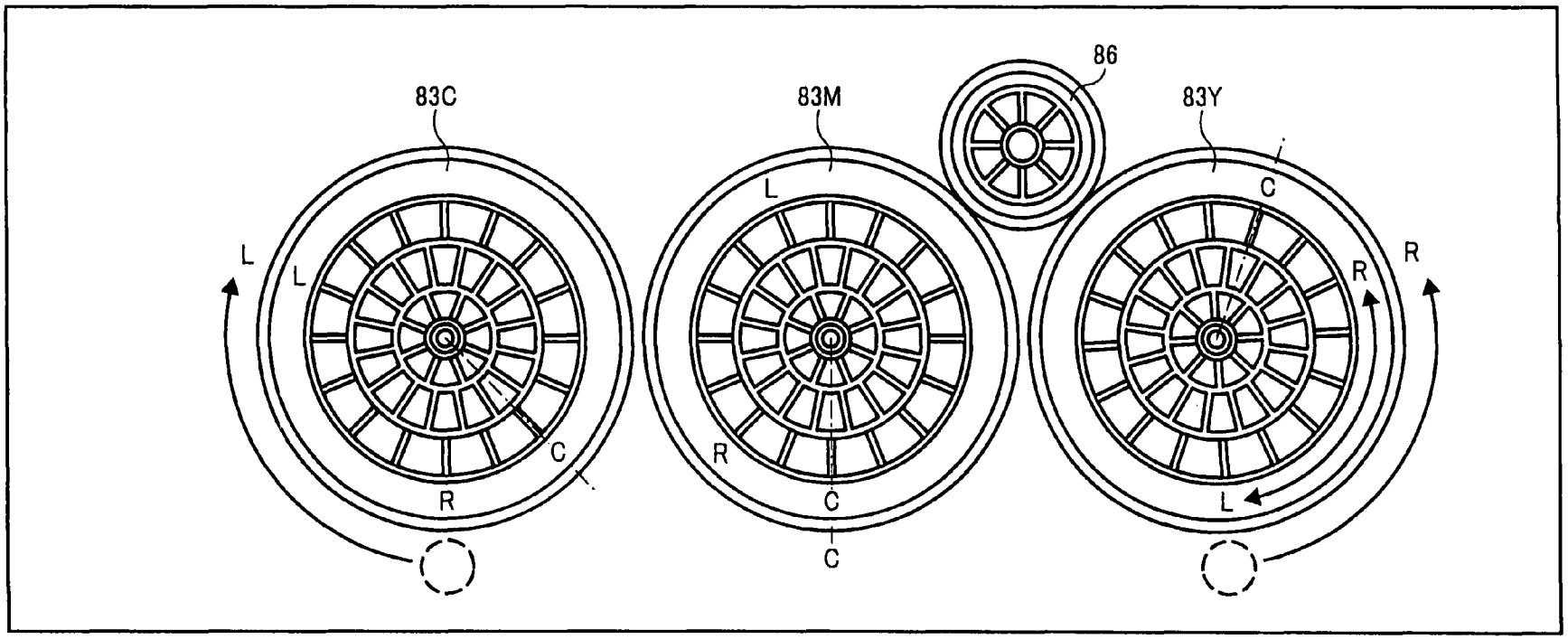
FIG. 19 is an explanatory diagram for explaining an example of how the phase adjusting means according to the first embodiment is used.

Furthermore, according to this example, if one wants to move the position of any of the marks R, C, and L on the side of the holding member 82*a* (for example, the mark for the Y-photoconductor driving gear 83Y), as shown in FIG. 19, for example, the mark corresponding to the Y-photoconductor driving gear 83Y and the mark corresponding to the C-photoconductor driving gear 83C are replaced with each other. Then, on the side of the holding member 82*a*, the same marks L, C, and R are made on portions opposed (or closest) to the corresponding marks L, C, and R after being subjected to the replacement when the rotational positions of the photoconductor driving gears 83Y, 83M, and 83C are adjusted as described above. In this manner, the positions of the marks on the side of the holding member 82*a* can be changed with the relation of the rotational positions of the photoconductor driving gears 83Y, 83M, and 83C shown in FIG. 18 remaining unchanged. Namely, by changing the positions of the marks on the side of the gears, the positions of the marks on the side of the holding member 82*a* can be freely changed. Consequently, it is possible to arrange the marks on the side of the gears or the marks on the side of the holding member 82*a* without hiding the marks behind other parts.

Variation of the First Embodiment

Subsequently, a variation of the drive unit of the color photoconductors 1Y, 1M, and 1C in the above embodiment is explained.

Figure 20:
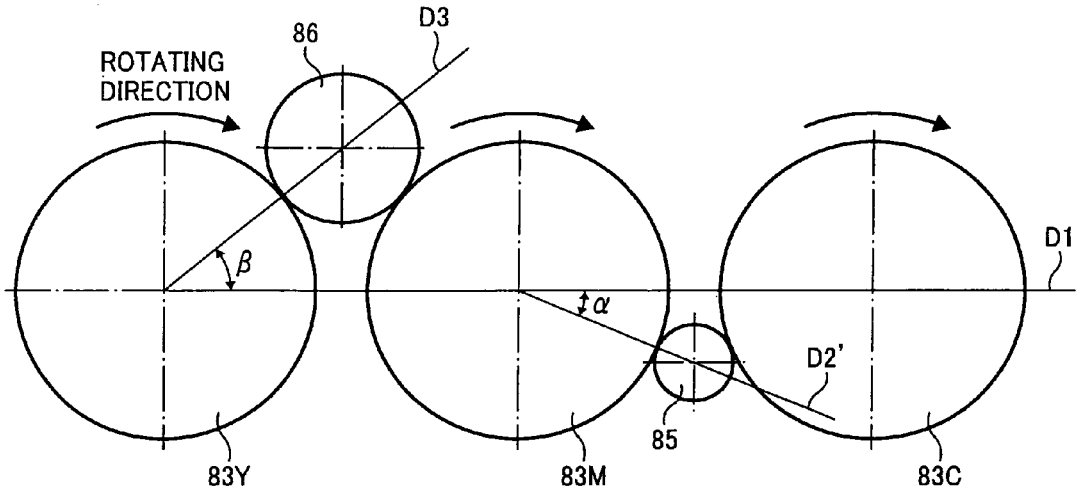
FIG. 20 is a schematic diagram illustrating a relative arrangement relation of the motor gear and the idler gear with respect to the three photoconductor driving gears according to a variation of the first embodiment.

FIG. 20 is a schematic diagram illustrating a relative arrangement relation of the motor gear 85 and the idler gear 86 with respect to the photoconductor driving gears 83Y, 83M, and 83C according to the present variation.

In the present variation, the motor gear 85 is arranged so that the rotation center of the motor gear 85 is located on the downstream side of the first virtual straight line D1 in the rotating direction of the M-photoconductor driving gear 83M when viewed from the direction of the rotating shaft of the motor gear 85. Thus, an angle (a motor input angle) $\alpha$ between the first virtual straight line D1 and a second virtual straight line D2' connecting the rotation center of the M-photoconductor driving gear 83M and the rotation center of the motor gear 85 is a negative value if a direction opposite to the rotating direction of the M-photoconductor driving gear 83M (the counterclockwise direction in FIG. 9) is positive in the same manner as in the above embodiment. Furthermore, an idler input angle $\beta$ is a positive value in the same manner as in the above embodiment. Incidentally, the other configurations are identical to those in the above embodiment.

Figure 21:
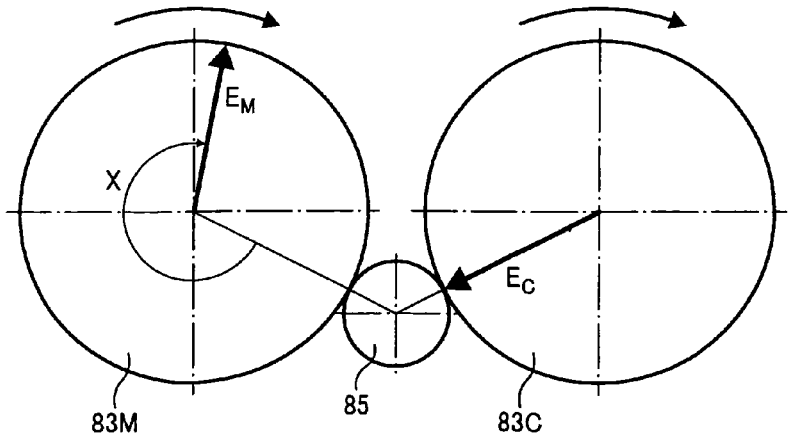
FIG. 21 is an explanatory diagram illustrating a phase relation of radial run-out due to eccentricity of the photoconductor driving gear in the two photoconductor driving gears directly connected to the motor gear according to the variation of the first embodiment.

FIG. 21 is an explanatory diagram illustrating a phase relation of radial run-out due to eccentricity of the photoconductor driving gear in the two photoconductor driving gears 83M and 83C directly connected to the motor gear 85 according to the present variation.

Considering based on a point of time when the reference phase of the eccentric component $E_C$ of the photoconductor driving gear 83C of the C-photoconductor 1C located on the downstream side in the surface moving direction of the intermediate transfer belt points to the direction of the motor gear 85, it is only necessary to adjust the M-photoconductor driving gear 83M so that the reference phase of the eccentric component $E_M$ points to the direction that the reference phase of the eccentric component $E_M$ at the rotational position pointing to the direction of the motor gear 85 is rotated by X° calculated by the above Equation (7).

Figure 22:
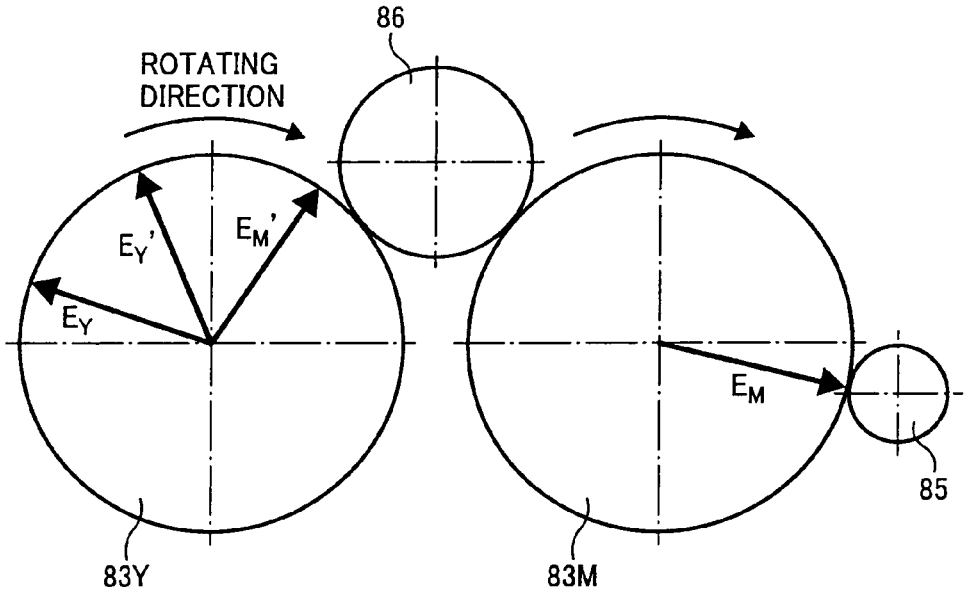
FIG. 22 is an explanatory diagram illustrating a phase relation of eccentric components of the photoconductor driving gears in the two photoconductor driving gears directly connected to the idler gear according to the variation of the first embodiment.

FIG. 22 is an explanatory diagram illustrating a phase relation of eccentric components of the photoconductor driving gears in the two photoconductor driving gears 83Y and 83M directly connected to the idler gear 86 according to the present variation.

Figure 23:
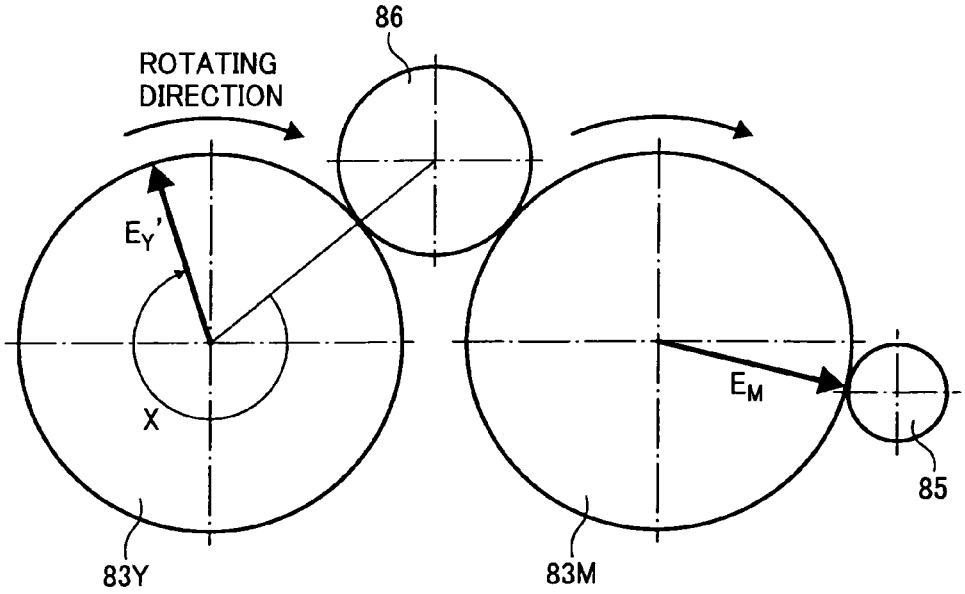
FIG. 23 is an explanatory diagram illustrating a phase relation of a composite eccentric component of the Y-photoconductor driving gear and an eccentric component of the M-photoconductor driving gear according to the variation of the first embodiment.

In the same manner as in the embodiment described above, the Y-photoconductor driving gear 83Y has the lowest angular velocity when the reference phase of the composite eccentric component $E_Y'$ points to the direction of the idler gear 86. Thus, as shown in FIG. 23, considering based on a point of time when the reference phase of the eccentric component $E_M$ of the photoconductor driving gear 83M of the M-photoconductor 1M points to the direction of the motor gear 85, if the Y-photoconductor driving gear 83Y is adjusted so that the reference phase of the composite eccentric component $E_Y'$ points to the direction that the reference phase of the composite eccentric component $E_Y'$ at the rotational position pointing to the direction of the idler gear 86 is rotated by X° calculated by the above Equation (7), toner images having the most contracted shape or toner images having the most elongated shape among those on the color photoconductors 1Y, 1M, and 1C are transferred onto the same point on the intermediate transfer belt 8.

Figure 24:
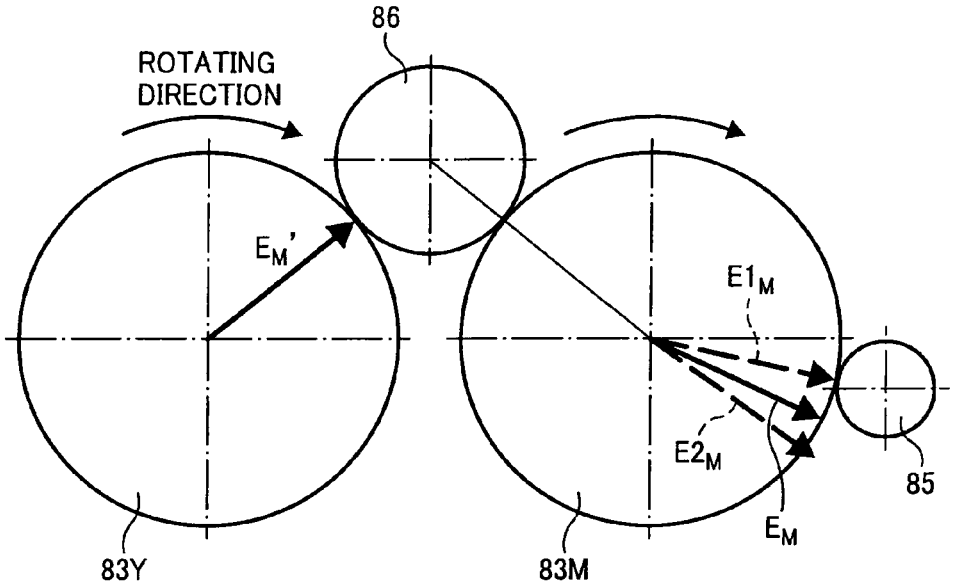
FIG. 24 is an explanatory diagram illustrating a positional relation of an eccentric component of the M-photoconductor driving gear and an eccentric component of the M-photoconductor driving gear transmitted to the Y-photoconductor driving gear via the idler gear according to the variation of the first embodiment.

FIG. 24 is an explanatory diagram illustrating a positional relation of the eccentric component $E_M$ of the M-photoconductor driving gear 83M and the eccentric component $E_M'$ of the M-photoconductor driving gear 83M transmitted to the Y-photoconductor driving gear 83Y via the idler gear 86 according to the present variation.

Also in the present variation, when the idler gear 86 has the lowest angular velocity, the reference phase of the eccentric component $E_M$ of the M-photoconductor driving gear 83M points to the direction midway between the direction indicated by $E1_m$ and the direction indicated by $E2_M$. At this time, the idler gear 86 has the lowest angular velocity, which means that the Y-photoconductor driving gear 83Y has the lowest linear velocity. Therefore, at this time, the reference phase of the eccentric component $E_M'$ of the M-photoconductor driving gear 83M transmitted to the Y-photoconductor driving gear 83Y via the idler gear 86 points to the direction of the idler gear 86.

A rotation angle $\theta$ when the idler gear 86 has the lowest angular velocity can be expressed by the above Equation (8) in the same manner as in the above embodiment, and an amplitude amplification factor Z when the amplitude of the eccentric component $E_M$ of the M-photoconductor driving gear 83M is transmitted to the Y-photoconductor driving gear 83Y is defined by the above Equation (9) in the same manner as in the above embodiment. Furthermore, when the eccentric component $E_M$ of the M-photoconductor driving gear 83M is defined by the above Equation (10), the composite eccentric component $E_Y'$ on the Y-photoconductor driving gear 83Y is expressed by the above Equation (11) in the same manner as in the above embodiment, and the eccentric component $E_M'$ of the M-photoconductor driving gear 83M transmitted to the Y-photoconductor driving gear 83Y via the idler gear 86 is expressed by the above Equation (12) in the same manner as in the above embodiment. Therefore, also in the present variation, unless $(A^2+B^2)^{1/2}$, the amplitude of the eccentric component $E_Y$ of the Y-photoconductor driving gear 83Y, is 1, the amplitude of the composite eccentric component $E_Y'$ of the Y-photoconductor driving gear 83Y cannot coincide with the amplitude of the eccentric component $E_M$ of the M-photoconductor driving gear 83M. When these amplitudes are not coincident with each other, even if toner images having the most contracted shape or toner images having the most elongated shape among those on the color photoconductors 1Y, 1M, and 1C are adjusted to be transferred onto the same point on the intermediate transfer belt 8, specific color shift depending on a difference between the amplitudes occurs.

Also in the present variation, in the configuration that the same gears are used as the photoconductor driving gears 83Y, 83M, and 83C of the color photoconductors 1Y, 1M, and 1C, specific color shift due to the eccentric components $E_Y$, $E_M$, and $E_C$ of the photoconductor driving gears 83Y, 83M, and 83C is eliminated or reduced by employing the same configuration as the above embodiment. Incidentally, in general, it seems unlikely that the motor gear 85 and the idler gear 86 are bigger than the photoconductor driving gear, and thus the practically possible motor input angle $\alpha$ in the present embodiment is within a range of 0° to −60°, and the practically possible idler input angle β in the present embodiment is within a range of 0° to +60°.

Figure 25:
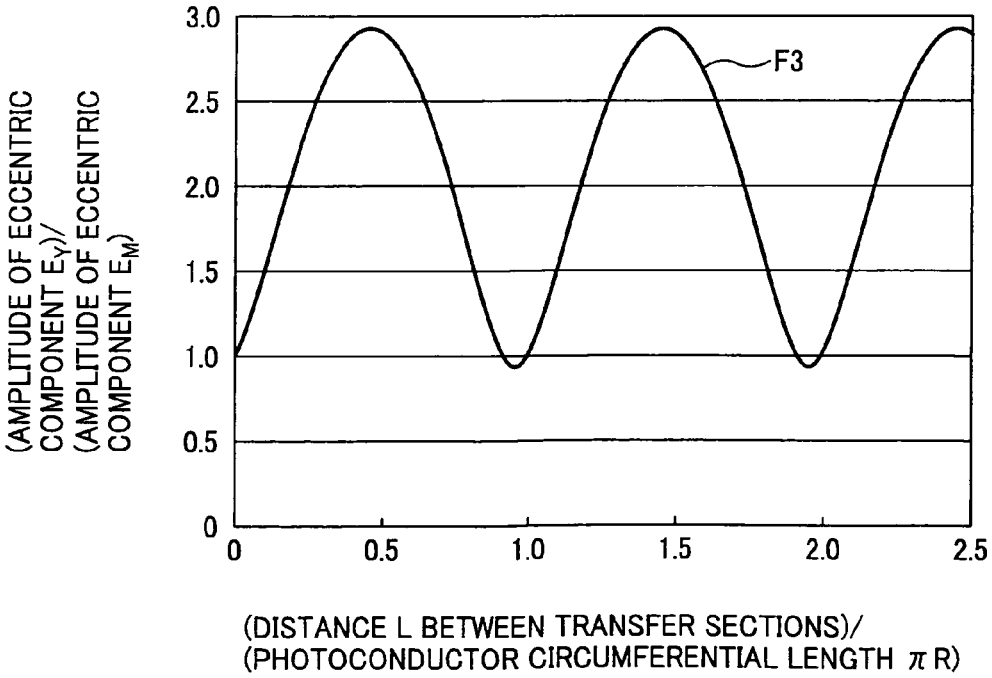
FIG. 25 is a graph illustrating a relation between an ideal amplitude ratio, which indicates a ratio of an ideal amplitude of an eccentric component of the Y-photoconductor driving gear that can theoretically zero specific color shift to an actual amplitude of an eccentric component of the M-photoconductor driving gear, and a value obtained by dividing a distance between the transfer sections by the photoconductor circumferential length according to the variation of the first embodiment.

FIG. 25 is a graph illustrating a relation between an ideal amplitude ratio Y, which indicates a ratio of an ideal amplitude of the eccentric component $E_Y$ of the Y-photoconductor driving gear 83Y that can theoretically zero specific color shift to an actual amplitude of the eccentric component $E_M$ of the M-photoconductor driving gear 83M, and a value obtained by dividing the distance L between the transfer sections by the photoconductor circumferential length πR in the configuration according to the present variation. The Y-axis of the graph denotes a ratio of the amplitude of the eccentric component $E_Y$ of the Y-photoconductor driving gear 83Y to the amplitude of the eccentric component $E_M$ of the M-photoconductor driving gear 83M.

A graph F3 showing a trajectory of the ideal amplitude ratio depicted in FIG. 25 is obtained in conditions that the motor input angle α is −10° and the idler input angle β is 40°. Also in the present variation, if values of the motor input angle α and the idler input angle β are changed, the relation between the ideal amplitude ratio Y and a value obtained by dividing the distance L between the transfer sections by the photoconductor circumferential length πR is changed. However, as described above, even when values of the motor input angle α and the idler input angle β are changed, a ratio of the amplitude of the eccentric component $E_Y$ to the amplitude of the eccentric component $E_M$ is inevitably 1, and a value obtained by dividing the distance L between the transfer sections by the photoconductor circumferential length πR inevitably runs through a point of a positive integer. This means that even when the same gears having the same eccentric component are used as the Y-photoconductor driving gear 83Y and the M-photoconductor driving gear 83M, if the distance L between the transfer sections is configured to be equal to an integral multiple of the photoconductor circumferential length πR, specific color shift can be eliminated regardless of values of the motor input angle α and the idler input angle β. However, such a configuration is used mostly to make the distance L between the transfer sections smaller than a value of the integral multiple of the photoconductor circumferential length πR, especially to make the distance L between the transfer sections smaller than the photoconductor circumferential length πR for downsizing of the present printer, so is not employed also in the present variation.

The graph F3 shown in FIG. 25 runs through a point where a ratio of the amplitude of the eccentric component $E_Y$ to the amplitude of the eccentric component $E_M$ is 1 when the distance L between the transfer sections is smaller than a value of the integral multiple of the photoconductor circumferential length πR, specifically, when a value obtained by dividing the distance L between the transfer sections by the photoconductor circumferential length πR is around 0.9. In the present variation, since the same gears are used as the Y-photoconductor driving gear 83Y and the M-photoconductor driving gear 83M, the ratio of the amplitude of the eccentric component $E_Y$ to the amplitude of the eccentric component $E_M$ is 1. Therefore, in a case of the graph F3, if the motor input angle α is set at −10°, the idler input angle β is set at 40°, and the distance L between the transfer sections and the photoconductor circumferential length πR are set so that a value obtained by dividing the distance L between the transfer sections by the photoconductor circumferential length πR equals a value of the X-axis (around 0.9) when the Y-axis of the graph (a ratio of the amplitude of the eccentric component $E_Y$ to the amplitude of the eccentric component $E_M$) is 1, even when the same gears are used as the Y-photoconductor driving gear 83Y and the M-photoconductor driving gear 83M, specific color shift can be eliminated with the distance L between the transfer sections set to be smaller than a value of the integral multiple of the photoconductor circumferential length πR.

As described above, since there is no need to completely eliminate specific color shift in general, in the present variation, the diameter R of the photoconductors 1Y, 1M, and 1C, the distance L between the transfer sections, the motor input angle α, and the idler input angle β are set so that an absolute value of a value obtained by subtracting 1 from the ideal amplitude ratio Y is equal to or less than a maximum allowable amplitude ratio indicating a ratio of 10 μm, the maximum allowable amount, to an actual amplitude of the eccentric component $E_M$ of the M-photoconductor driving gear 83M. If the actual amplitude of the eccentric component $E_M$ of the M-photoconductor driving gear 83M is 15 μm, the maximum allowable amplitude ratio is about 0.7. In this case, by setting the diameter R of the photoconductors 1Y, 1M, and 1C, the distance L between the transfer sections, the motor input angle α, and the idler input angle β so that the ideal amplitude ratio Y is within a range of 0.3 to 1.7, an amount of specific color shift can be suppressed to 10 μm or less with the distance L between the transfer sections set to be smaller than a value of the integral multiple of the photoconductor circumferential length πR even when the same gears are used as the Y-photoconductor driving gear 83Y and the M-photoconductor driving gear 83M.

In this manner, the printer according to the present embodiment (including the above variation) is a so-called tandem-type image forming apparatus that includes the photoconductors 1Y, 1M, 1C, and 1K, as two or more latent-image carriers of which the surfaces go around the respective latent-image carriers, to be aligned in the surface moving direction of the intermediate transfer belt 8, as an object onto which a toner image is to be transferred, and obtains a final image in such a manner that the image forming apparatus causes the surfaces of the photoconductors 1Y, 1M, 1C, and 1K to go around the respective photoconductors by transmitting a rotational driving force from the motor 81, as a drive source, to the photoconductor driving gears 83Y, 83M, 83C, and 83K, as respective driven transmission rotating bodies provided to the photoconductors, and transfers visible images (toner images), which are obtained by developing latent images on the surfaces of the photoconductors formed at predetermined latent-image forming points, onto the intermediate transfer belt 8 in a superimposed manner. The printer is configured so that a distance L between transfer sections of the two photoconductors 1Y and 1M having the same diameter R deviates from a value of the integral multiple of the circumferential length πR of the two photoconductors 1Y and 1M, and the Y-photoconductor driving gear 83Y as a first driven transmission rotating body provided to the Y-photoconductor 1Y as a first photoconductor located on the upstream side in the surface moving direction of the intermediate transfer belt out of the two photoconductors 1Y and 1M and the M-photoconductor driving gear 83M as a second driven transmission rotating body provided to the M-photoconductor 1M as a second photoconductor located on the downstream side in the surface moving direction of the intermediate transfer belt are each made up of the same gear (rotating body) as each other. In this printer, relative rotational positions of the Y-photoconductor driving gear 83Y and the M-photoconductor driving gear 83M are set so that a phase of a fluctuation component of the angular velocity of the Y-photoconductor driving gear 83Y due to the eccentricity of the Y-photoconductor driving gear 83Y and the eccentricity of the M-photoconductor driving gear 83M at a point of time when a specific point on the intermediate transfer belt 8 passes through the transfer section of the Y-photoconductor 1Y coincides with a phase of a fluctuation component of the angular velocity of the M-photoconductor driving gear 83M due to the eccentricity of the M-photoconductor driving gear 83M at a point of time when the specific point passes through the transfer section of the M-photoconductor 1M. Consequently, toner images having the most contracted shape or toner images having the most elongated shape in the two photoconductors 1Y and 1M are transferred onto the same point on the intermediate transfer belt 8. Furthermore, the motor gear 85, as a drive transmission rotating body connected to the side of the motor 81, is directly connected to the M-photoconductor driving gear 83M, and the idler gear 86, as a driven rotating body that rotates dependently, is directly connected to the Y-photoconductor driving gear 83Y and the M-photoconductor driving gear 83M, so both the Y-photoconductor 1Y and the M-photoconductor 1M are driven by a rotational driving force transmitted through the motor gear 85. Thus, specific color shift occurs as described above. Therefore, in the present embodiment, the idler gear 86 is arranged so that the rotation center of the idler gear 86 is located on the downstream side of a first virtual straight line D1 connecting the rotation center of the Y-photoconductor driving gear 83Y and the rotation center of the M-photoconductor driving gear 83M in the rotating direction of the M-photoconductor driving gear 83M when viewed from the direction of the rotating shaft of the idler gear 86, and on the assumption that an angle between the first virtual straight line D1 and a second virtual straight line D2, D2' connecting the rotation center of the M-photoconductor driving gear 83M and the rotation center of the motor gear 85 when viewed from the direction of the rotating shaft of the idler gear 86 is defined as a with the direction opposite to the rotating direction of the M-photoconductor driving gear 83M as positive, and an angle between the first virtual straight line D1 and a third virtual straight line D3 connecting the rotation center of the Y-photoconductor driving gear 83Y and the rotation center of the idler gear 86 when viewed from the direction of the rotating shaft of the idler gear 86 is defined as β with the direction opposite to the rotating direction of the Y-photoconductor driving gear 83Y as positive, when an ideal amplitude ratio Y, which indicates a ratio of an ideal amplitude of the eccentric component of the Y-photoconductor driving gear 83Y that can theoretically zero relative transfer misalignment (specific color shift) which occurs between the Y-photoconductor 1Y and the M-photoconductor 1M due to the eccentricities of the Y-photoconductor driving gear 83Y and the M-photoconductor driving gear 83M to an actual amplitude of the eccentric component $E_M$, i.e., radial run-out of the M-photoconductor driving gear 83M due to the eccentricity that the M-photoconductor driving gear 83M has is defined by the above Equation (1), the diameter R of the two photoconductors 1Y and 1M, the distance L between the transfer sections of the two photoconductors 1Y and 1M, the motor input angle α, and the idler input angle β are set so that an absolute value of a value obtained by subtracting 1 from the ideal amplitude ratio Y is equal to or smaller than a maximum allowable amplitude ratio indicating a ratio of 10 μm, a maximum allowable amount of the specific color shift, to the actual amplitude of the eccentric component $E_M$ of the M-photoconductor driving gear 83M. Consequently, even when the distance L between the transfer sections is configured to deviate from a value of the integral multiple of the photoconductor circumferential length πR for the purpose of downsizing or the like, an amount of specific color shift that may occur between the two photoconductor driving gears 83Y and 83M connected to each other via the idler gear 86 can be reduced to 10 μm or less.

Specifically, if the absolute value of the value obtained by subtracting 1 from the ideal amplitude ratio Y is set to 0.7 or less, even when a gear having a general amount of eccentricity is used as the photoconductor driving gears 83Y and 83M, an amount of specific color shift can be reduced to 10 μm or less.

Furthermore, if the absolute value of the value obtained by subtracting 1 from the ideal amplitude ratio Y is set to 0.06 or less, an amount of specific color shift can be significantly reduced, and thus it is possible to achieve a higher image quality. Moreover, as a result of the significant reduction in amount of specific color shift, an allowable amount of color shift caused by other color-shift variation factors can be relatively increased, and thus it is possible to achieve benefits such as an increase in degree of freedom of the design of the entire apparatus and the like.

Furthermore, in the present embodiment, the motor gear 85 and the idler gear 86 are configured to rotate an integer number of times while the surfaces of the two photoconductors 1Y and 1M each move from a predetermined latent-image forming section (the exposure section) to the transfer section onto the intermediate transfer belt 8. Thus, it is possible to prevent influences of eccentricities of the motor gear 85 and the idler gear 86 from showing up as color shift.

Moreover, as in the present embodiment, by providing the phase adjusting means as a rotational-position adjusting means for adjusting relative rotational positions of the Y-photoconductor driving gear 83Y and the M-photoconductor driving gear 83M, the adjustment can be made easily.

Specifically, as described above, as the phase adjusting means, a first mark R and a second mark C are made on the same gears used as the Y-photoconductor driving gear 83Y and the M-photoconductor driving gear 83M so that the first mark R and the second mark C move in accordance with rotation of the gears, and specifically, the first mark R and the second mark C are made so that the first mark R on the Y-photoconductor driving gear 83Y and the second mark C on the M-photoconductor driving gear 83M are located at the same rotational positions as each other after the adjustment of the relative rotational positions, whereby the adjustment can be made easily without any interference of other parts.

Furthermore, as described above, as the phase adjusting means, the first mark R and the second mark C are made on the same gears used as the Y-photoconductor driving gear 83C and the M-photoconductor driving gear 83M so that the first mark R and the second mark C move in accordance with rotation of the gears, and a third mark R corresponding to the first mark R and a fourth mark C corresponding to the second mark C are made on the holding member 82*a* as a holding member for holding the Y-photoconductor driving gear 83Y and the M-photoconductor driving gear 83M; the first mark R is made, if the gear is used as the Y-photoconductor driving gear 83Y, so as to be located at the rotational position closest to the third mark R on the holding member 82*a* after the adjustment of the relative rotational positions, and the second mark C is made, if the gear is used as the M-photoconductor driving gear 83M, so as to be located at the rotational position closest to the fourth mark C on the holding member 82*a* after the adjustment of the relative rotational positions, and thus the adjustment can be made just by aligning the mark on the gear with the mark on the holding member 82*a*, so it is easy to make the adjustment.

Subsequently, a different configuration from that in the first embodiment is explained. Namely, in a second embodiment, the arrangement of the photoconductor driving gears and the idler gear is different from that in the first embodiment. Incidentally, a configuration of an image forming apparatus is the same as that shown in FIGS. 1 to 4 and FIG. 6, and description of the identical portions is omitted here.

A gear structure (arrangement) of the color photoconductors 1Y, 1M, and 1C in the second embodiment is explained.

Figure 26:
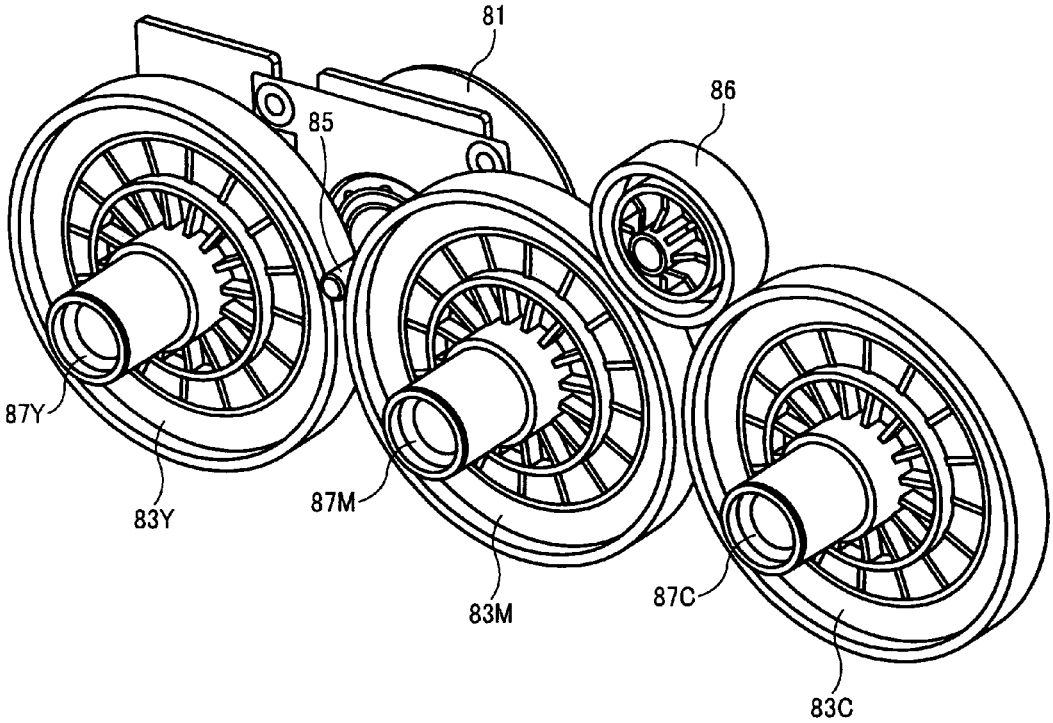
FIG. 26 is a perspective view illustrating a printer-main-body-side driving-force transmitting unit composing a driving-force transmitting unit according to a second embodiment.

FIG. 26 is a perspective view illustrating a printer-main-body-side driving-force transmitting unit composing a driving-force transmitting unit according to the second embodiment.

Figure 27:
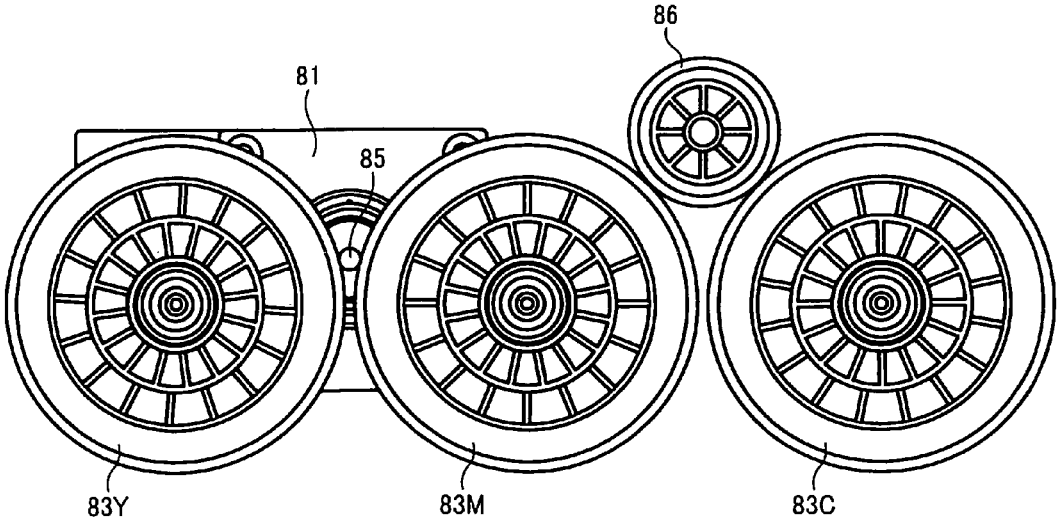
FIG. 27 is a front view illustrating arrangement of the photoconductor driving gears, the motor gear, and the idler gear when viewed in the direction of the rotating shafts of the three color photoconductors according to the second embodiment.

FIG. 27 is a front view illustrating arrangement of the photoconductor driving gears 83Y, 83M, and 83C, the motor gear 85, and the idler gear 86 when viewed in the direction of the rotating shafts of the color photoconductors 1Y, 1M, and 1C.

Figure 28:
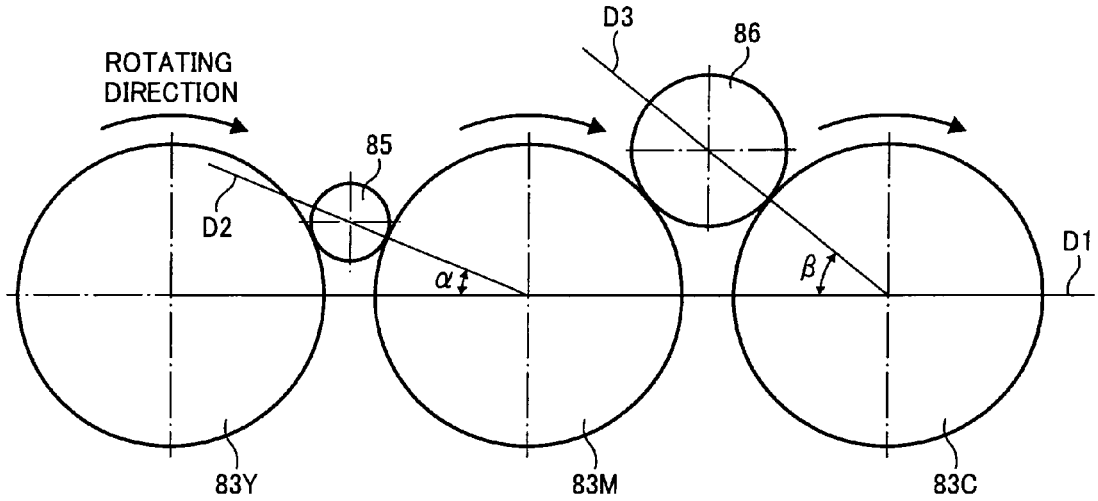
FIG. 28 is a schematic diagram illustrating a relative arrangement relation of the motor gear and the idler gear with respect to the three photoconductor driving gears according to the second embodiment.

FIG. 28 is a schematic diagram illustrating a relative arrangement relation of the motor gear 85 and the idler gear 86 with respect to the photoconductor driving gears 83Y, 83M, and 83C.

In the present embodiment, the motor gear 85, a drive transmission rotating body connected to the motor 81, is directly connected to the M-photoconductor driving gear 83M as a second driven transmission rotating body and the Y-photoconductor driving gear 83Y as a third driven transmission rotating body. Furthermore, the idler gear 86 as a driven rotating body is directly connected to the C-photoconductor driving gear 83C as a first driven transmission rotating body and the M-photoconductor driving gear 83M. Consequently, the three photoconductors 1Y, 1M, and 1C, including the C-photoconductor 1C as a first latent-image carrier and the M-photoconductor 1M as a second latent-image carrier, can be driven by a rotational driving force of the motor 81 transmitted through the motor gear 85.

As shown in FIG. 28, in the present embodiment, the idler gear 86 is arranged so that the rotation center of the idler gear 86 is located on the upstream side of a first virtual straight line D1, connecting the rotation center of the C-photoconductor driving gear 83C and the rotation center of the M-photoconductor driving gear 83M, in the rotating direction of the M-photoconductor driving gear 83M when viewed in a direction of the rotating shaft of the idler gear 86.

Incidentally, in the present embodiment, an angle between the first virtual straight line D1 and a third virtual straight line D3 connecting the rotation center of the C-photoconductor driving gear 83C and the rotation center of the idler gear 86 (an idler input angle) is defined as β, with the rotating direction of the C-photoconductor driving gear 83C (a clockwise direction in FIG. 28) as positive. Therefore, in the present embodiment, the idler input angle β is a positive value.

Furthermore, as shown in FIG. 28, in the present embodiment, the motor gear 85 is arranged so that the rotation center of the motor gear 85 is located on the up downstream side of the first virtual straight line D1 in the rotating direction of the M-photoconductor driving gear 83M when viewed in a direction of the rotating shaft of the motor gear 85.

Incidentally, in the present embodiment, an angle between the first virtual straight line D1 and a second virtual straight line D2 connecting the rotation center of the M-photoconductor driving gear 83M and the rotation center of the motor gear 85 (a motor input angle) is defined as α, with the rotating direction of the M-photoconductor driving gear 83M (the clockwise direction in FIG. 28) as positive. Therefore, in the present embodiment, the motor input angle α is a positive value.

Figure 29:
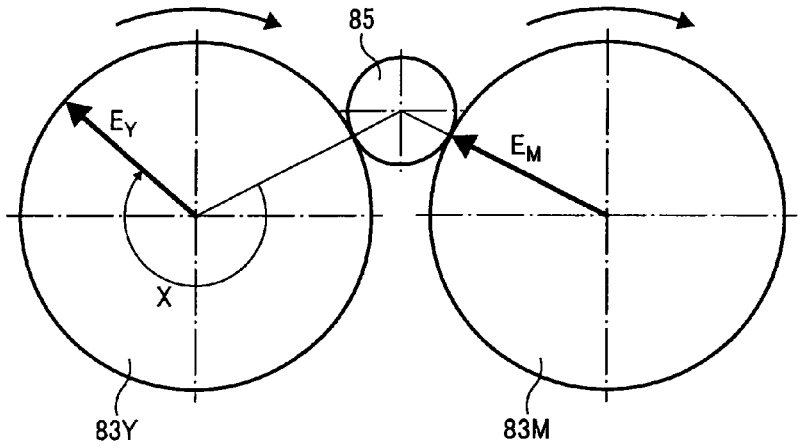
FIG. 29 is an explanatory diagram illustrating a phase relation of radial run-out due to eccentricity of the photoconductor driving gear in the two photoconductor driving gears directly connected to the motor gear according to the second embodiment.

FIG. 29 is an explanatory diagram illustrating a phase relation of radial run-out due to eccentricity of the photoconductor driving gear in the two photoconductor driving gears 83M and 83Y directly connected to the motor gear 85.

In FIG. 29, $E_M$ and $E_Y$ each denote a vector representing radial run-out due to eccentricity of each of the photoconductor driving gears 83M and 83Y (hereinafter, referred to as an "eccentric component"), and a radial direction when the radial run-out due to the eccentricity of each of the photoconductor driving gears 83M and 83Y reaches its peak (a radial direction of the longest radius) is set as a reference phase. Therefore, a direction of each of the vectors denoted by $E_M$ and $E_Y$ in the drawing represents the reference phase. Furthermore, the length of each of the vectors denoted by $E_M$ and $E_Y$ in the drawing represents the magnitude of radial run-out depending on an amount of eccentricity in the direction of each vector. Therefore, the length of each of the vectors denoted by $E_M$ and $E_Y$ in the drawing represents an actual amplitude of the phase of eccentricity. However, the direction and length of each of the vectors in the drawing are hypothetical ones, and do not exactly correspond to the configuration in the present embodiment. Much the same is true on vectors described below.

To zero an amount of color shift in the two photoconductors 1M and 1Y provided with the photoconductor driving gears 83M and 83Y, it is only necessary to adjust a phase of an eccentric component $E_M$ of the photoconductor driving gear 83M at a point of time when a specific point on the intermediate transfer belt 8 (an arbitrary point in the surface moving direction of the intermediate transfer belt) passes through the transfer section of the photoconductor 1M, one of the photoconductors, and a phase of an eccentric component $E_Y$ of the photoconductor driving gear 83Y at a point of time when the specific point passes through the transfer section of the photoconductor 1Y, the other photoconductor, to coincide with each other.

When the reference phase of any of the eccentric components $E_M$ and $E_Y$ points to the direction of the motor gear 85, corresponding one of the photoconductor driving gears 83M and 83Y has the lowest angular velocity. Consequently, considering based on a point of time when the reference phase of the eccentric component $E_M$ of the photoconductor driving gear 83M of the M-photoconductor 1M located on the downstream side in the surface moving direction of the intermediate transfer belt points to the direction of the motor gear 85, it is only necessary to adjust the Y-photoconductor driving gear 83Y so that the reference phase of the eccentric component $E_Y$ points to the direction that the reference phase of the eccentric component $E_Y$ at the rotational position pointing to the direction of the motor gear 85 is rotated by X° calculated by the following Equation (17).

$$X[°] = \frac{L \times \text{st_num} - \pi R \times \text{st_num}}{\pi R} \times 360 \tag{17}$$

In the above Equation (17), "st_num" denotes what number photoconductor from the photoconductor as the basis of color shift (in the present embodiment, the M-photoconductor 1M) the Y-photoconductor driving gear 83Y is, and is 1 here.

Furthermore, in the above Equation (17), "L" denotes a distance between the transfer sections of the two photoconductors 1M and 1Y, and "R" denotes a diameter of the two photoconductors 1M and 1Y.

Incidentally, in the present embodiment, at least in the color photoconductors 1Y, 1M, and 1C, a distance between the adjacent transfer sections is always L and the diameter is always R because the same photoconductors are used as the color photoconductors 1Y, 1M, and 1C.

Figure 30:
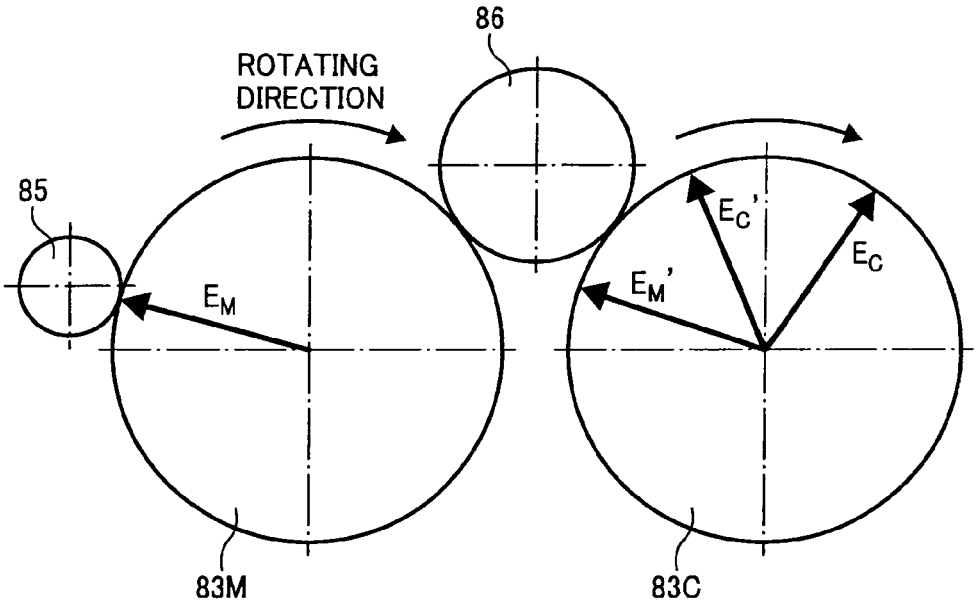
FIG. 30 is an explanatory diagram illustrating a phase relation of eccentric components of the photoconductor driving gears in the two photoconductor driving gears directly connected to the idler gear according to the second embodiment.

FIG. 30 is an explanatory diagram illustrating a phase relation of eccentric components of the photoconductor driving gears in the two photoconductor driving gears 83C and 83M directly connected to the idler gear 86.

In FIG. 30, $E_C$ denotes a vector representing radial run-out due to eccentricity of the photoconductor driving gear 83C, i.e., an eccentric component of the photoconductor driving gear 83C, and a radial direction, when the radial run-out due to the eccentricity of the photoconductor driving gear 83C reaches its peak (a radial direction of the longest radius), is set as a reference phase. Therefore, a direction of the vector denoted by $E_C$ in the drawing represents the reference phase. Furthermore, the length of the vector denoted by $E_C$ in the drawing represents the magnitude of radial run-out depending on an amount of eccentricity in the direction of the vector. Therefore, the length of the vector denoted by $E_C$ in the drawing represents an actual amplitude of the eccentric component.

As described above, in the photoconductors 1M and 1Y provided to the photoconductor driving gears 83M and 83Y to which a rotational driving force is transmitted from the motor gear 85 directly, eccentricity of the photoconductor driving gear affecting a fluctuation component of the linear velocity of the corresponding photoconductor is only respective eccentricities of the photoconductor driving gears 83M and 83Y. On the other hand, in the photoconductor 1C provided to the C-photoconductor driving gear 83C to which a rotational driving force is transmitted from the idler gear 86, eccentricity of the photoconductor driving gear affecting a fluctuation component of the linear velocity of the corresponding photoconductor includes not only the eccentricity of the C-photoconductor driving gear 83C provided to the photoconductor 1C but also the eccentricity of the M-photoconductor driving gear 83M transmitted via the idler gear 86. Namely, the angular velocity of the C-photoconductor driving gear 83C includes a fluctuation component due to a composite wave of eccentric components of the two photoconductor driving gears 83C and 83M, and as a result, the fluctuation component due to the composite wave is seen as a linear-velocity fluctuation component in the linear velocity of the C-photoconductor 1C.

Figure 31:
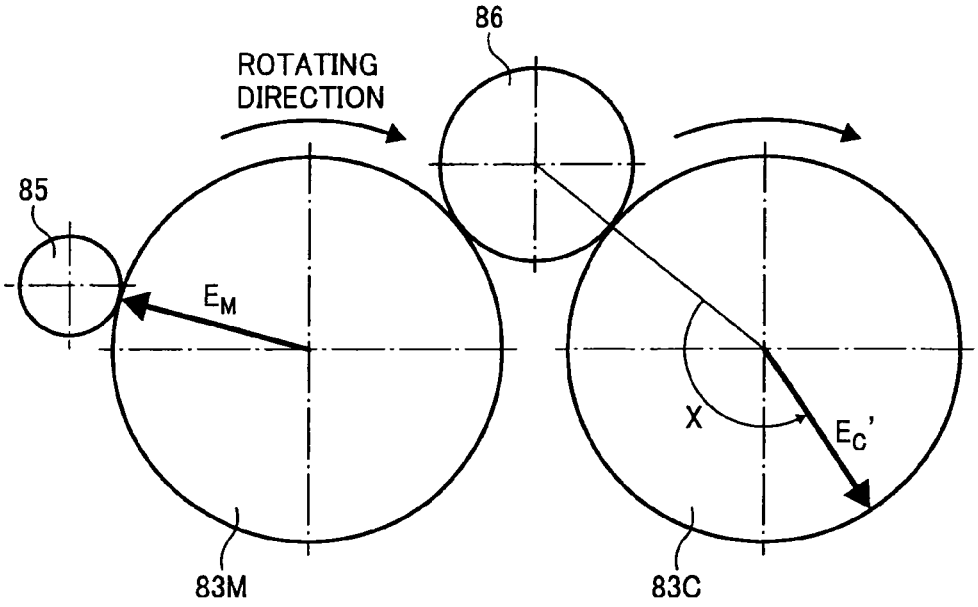
FIG. 31 is an explanatory diagram illustrating a phase relation of a composite eccentric component of the C-photoconductor driving gear and an eccentric component of the M-photoconductor driving gear according to the second embodiment.

In FIG. 30, the eccentric component of the M-photoconductor driving gear 83M transmitted via the idler gear 86 is denoted by $E_M'$, and the composite wave of the eccentric component $E_M'$ and the eccentric component $E_C$ of the C-photoconductor driving gear 83C (hereinafter, referred to as a "composite eccentric component") is denoted by $E_C'$. Therefore, when the reference phase of the composite eccentric component $E_C'$ points to the direction to the idler gear 86, the C-photoconductor driving gear 83C has the lowest angular velocity. Consequently, as shown in FIG. 31, considering based on a point of time when the reference phase of the eccentric component $E_M$ of the photoconductor driving gear 83M of the M-photoconductor 1M points to the direction of the motor gear 85, if the C-photoconductor driving gear 83C is adjusted so that the reference phase of the composite eccentric component $E_C'$ points to the direction that the reference phase of the composite eccentric component $E_C'$ at the rotational position pointing to the direction of the idler gear 86 is rotated by X° calculated by the above Equation (17), toner images having the most contracted shape or toner images having the most elongated shape among those on the color photoconductors 1Y, 1M, and 1C are transferred onto the same point on the intermediate transfer belt 8.

Figure 32:
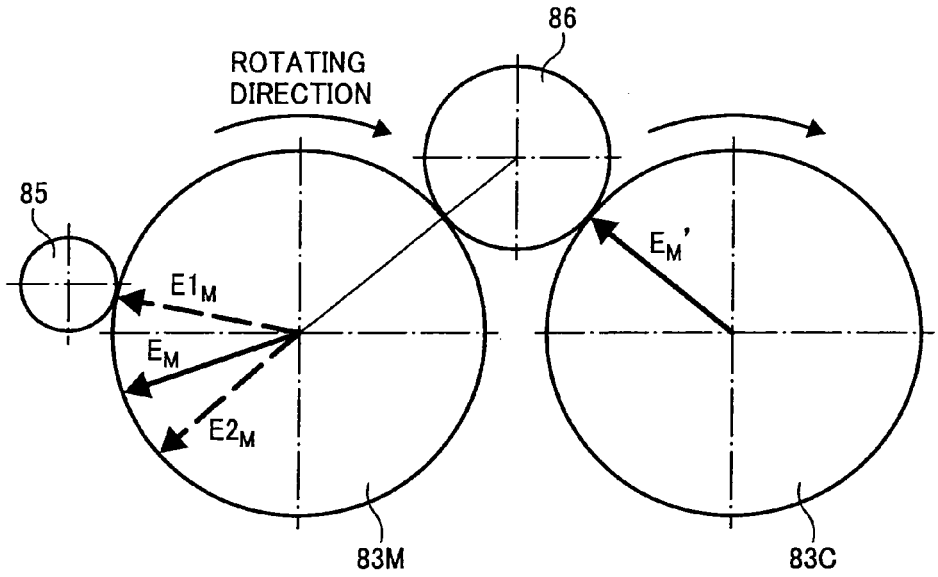
FIG. 32 is an explanatory diagram illustrating a positional relation of an eccentric component of the M-photoconductor driving gear and an eccentric component of the M-photoconductor driving gear transmitted to the C-photoconductor driving gear via the idler gear according to the second embodiment.

FIG. 32 is an explanatory diagram illustrating a positional relation of the eccentric component $E_M$ of the M-photoconductor driving gear 83M and the eccentric component $E_M'$ of the M-photoconductor driving gear 83M transmitted to the C-photoconductor driving gear 83C via the idler gear 86.

When the M-photoconductor driving gear 83M has the lowest angular velocity, i.e., when the M-photoconductor 1M has the lowest angular velocity, the reference phase of the eccentric component $E_M$ of the M-photoconductor driving gear 83M points to the direction of the motor gear 85 (a direction indicated by $E1_M$ in FIG. 32) as described above. Furthermore, it takes the longest time to transmit the angular velocity of the M-photoconductor driving gear 83M to the idler gear 86 when the reference phase of the eccentric component $E_M$ of the M-photoconductor driving gear 83M points to a 180-degree opposite direction to the direction of the idler gear 86 (a direction indicated by $E2_M$ in FIG. 32). Accordingly, when the idler gear 86 has the lowest angular velocity, the reference phase of the eccentric component $E_M$ of the M-photoconductor driving gear 83M points to a direction midway between the direction indicated by $E1_M$ and the direction indicated by $E2_M$. At this time, the idler gear 86 has the lowest angular velocity, which means that the C-photoconductor driving gear 83C has the lowest linear velocity. Therefore, at this time, the reference phase of the eccentric component $E_M'$ of the M-photoconductor driving gear 83M transmitted to the C-photoconductor driving gear 83C via the idler gear 86 points to the direction of the idler gear 86.

From the above, a rotation angle θ when the idler gear 86 has the lowest angular velocity can be expressed by the following Equation (18). Furthermore, an amplitude amplification factor Z, when the amplitude of the eccentric component $E_M$ of the M-photoconductor driving gear 83M is transmitted to the C-photoconductor driving gear 83C, is defined by the following Equation (19).

$$\theta = 180 - \left(\alpha - \frac{\beta + \alpha}{2}\right) \tag{18}$$

$$Z = \sqrt{\begin{array}{l}(|A_M|\cos\theta_M + |A_M|\cos(\theta_I + \pi))^2 + \\ (|A_M|\sin\theta_M + |A_M|\sin(\theta_I + \pi))^2\end{array}} \tag{19}$$

Incidentally, "$A_M$" denotes the amplitude of the eccentricity of the M-photoconductor driving gear 83M; $\theta_M$ equals 180−α; and $\theta_I$ equals −β.

Figure 33:
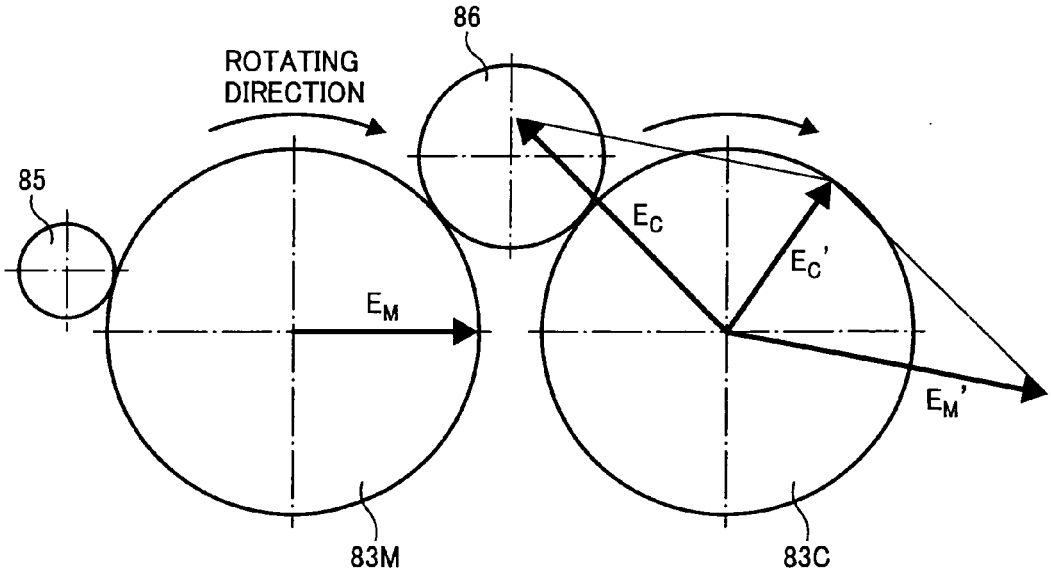
FIG. 33 is an explanatory diagram illustrating a relative rotational position (assembling position) of the C-photoconductor driving gear with respect to the M-photoconductor driving gear according to the second embodiment.

FIG. 33 is an explanatory diagram illustrating a relative rotational position (assembling position) of the C-photoconductor driving gear 83C with respect to the M-photoconductor driving gear 83M.

When the eccentric component $E_M$ of the M-photoconductor driving gear 83M is defined by the following Equation (20), the composite eccentric component $E_C'$ on the C-photoconductor driving gear 83C is expressed by the following Equation (21). And the eccentric component $E_M'$ of the M-photoconductor driving gear 83M, transmitted to the C-photoconductor driving gear 83C via the idler gear 86, is expressed by the following Equation (22).

$$E_M = 1\times\cos(\omega t + 0[°]) \tag{20}$$

$$E_C' = 1\times\cos(\omega t + (\beta - \alpha - (-X))) \tag{21}$$

$$E_M' = Z\times\cos(\omega t + (180 - \beta - \theta)) \tag{22}$$

Since the eccentric component $E_C$ of the C-photoconductor driving gear 83C is that the eccentric component $E_M'$ transmitted via the idler gear 86 is subtracted from the composite eccentric component $E_C'$, the eccentric component $E_C$ of the C-photoconductor driving gear 83C is expressed by the following Equation (23).

$$E_C=\sqrt{A^2+B^2}\times\cos(\omega t-C) \quad 23)$$

Incidentally, a period of $E_C$ is $L/\pi R$. Furthermore, A, B, and C in the above Equation (23) are defined by the following Equations (24) to (26), respectively.

$$A = \cos(-X+\alpha-\beta) - Z\times\cos(\theta+\beta-180) \quad (24)$$

$$B = \sin(-X+\alpha-\beta) - Z\times\sin(\theta+\beta-180) \quad (25)$$

$$\cos C = \frac{A}{\sqrt{A^2+B^2}} \quad (26)$$

When the above Equation (20) is compared with the above Equation (23), unless $(A^2+B^2)^{1/2}$, the amplitude of the eccentric component $E_C$ of the C-photoconductor driving gear 83C, is 1, the amplitude of the composite eccentric component $E_C'$ of the C-photoconductor driving gear 83C cannot coincide with the amplitude of the eccentric component $E_M$ of the M-photoconductor driving gear 83M. When these amplitudes are not coincident with each other, even if toner images having the most contracted shape or toner images having the most elongated shape among those on the color photoconductors 1Y, 1M, and 1C are adjusted to be transferred onto the same point on the intermediate transfer belt 8, specific color shift depending on a difference between the amplitudes occurs.

In order to put the amplitude $(A^2+B^2)^{1/2}$ of the eccentric component $E_C$ of the C-photoconductor driving gear 83C into 1, there is a method of using a separate gear having a different amount of eccentricity from that of the M-photoconductor driving gear 83M as the C-photoconductor driving gear 83C. However, this method is not recommended because the production cost increases as described above. Therefore, if the amplitude $(A^2+B^2)^{1/2}$ can be put into 1 or approximate 1 as close as possible by another method, specific color shift can be eliminated or reduced in the configuration that the same gears are used as the C-photoconductor driving gear 83C and the M-photoconductor driving gear 83M.

So, in the present embodiment, in the configuration that the same gears are used as the photoconductor driving gears 83Y, 83M, and 83C of the color photoconductors 1Y, 1M, and 1C, specific color shift due to the eccentric components $E_Y$, $E_M$, and $E_C$ of the photoconductor driving gears 83Y, 83M, and 83C can be eliminated or reduced by employing the following configuration. Incidentally, since specific color shift does not occur in between the two photoconductor driving gears 83M and 83Y directly connected to the motor gear 85, if specific color shift occurring in between the two photoconductor driving gears 83C and 83M each directly connected to the idler gear 86 can be eliminated or reduced, it is possible to eliminate or reduce specific color shift among the color photoconductors 1Y, 1M, and 1C.

Incidentally, radial run-out due to the eccentricity of the motor gear 85 or the idler gear 86 can influence the angular velocity of each of the photoconductors 1Y, 1M, and 1C; however, such an influence can be cancelled by configuring the motor gear 85 or the idler gear 86 to rotate an integer number of times while each of the photoconductors 1Y, 1M, and 1C rotates from the exposure section to the transfer section. If it is configured like this, a point passing through the exposure section when the photoconductor has the highest angular velocity (linear velocity) because of the radial run-out due to the eccentricity of the motor gear 85 or the idler gear 86 passes through the transfer section when the photoconductor has the highest linear velocity. Therefore, if it is configured like this, there is no difference between the angular velocity at the time of exposure and the angular velocity at the time of transfer, and color shift due to the eccentricity of the motor gear 85 or the idler gear 86 does not occur as explained with reference to FIG. 7.

In general, it seems unlikely that the motor gear 85 and the idler gear 86 are bigger than the photoconductor driving gear, and thus the practically possible motor input angle $\alpha$ in the present embodiment is within a range of 0° to +60°, and the practically possible idler input angle $\beta$ in the present embodiment is also within a range of 0° to +60°.

Figure 34:
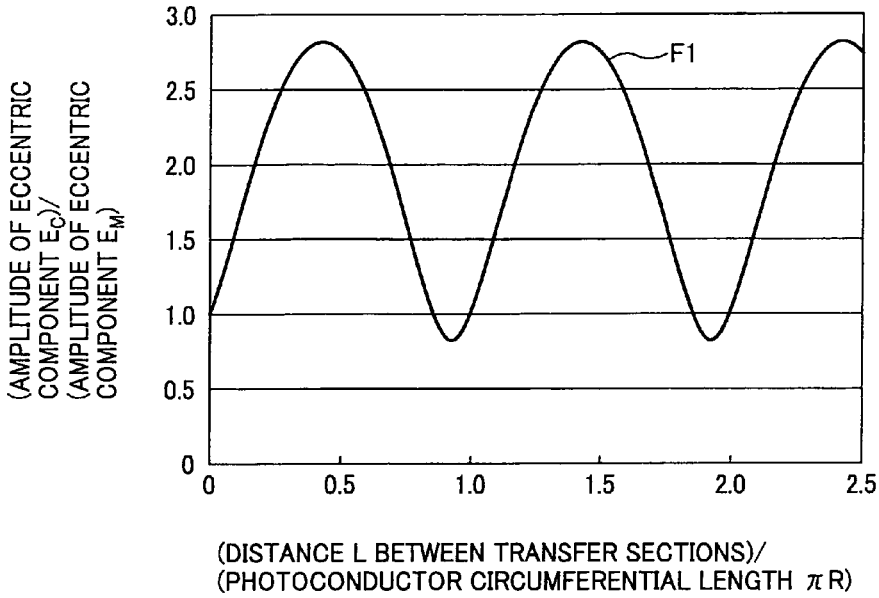
FIG. 34 is a graph illustrating a relation between an ideal amplitude ratio, which indicates a ratio of an ideal amplitude of an eccentric component of the C-photoconductor driving gear that can theoretically zero specific color shift to an actual amplitude of an eccentric component of the M-photoconductor driving gear, and a value obtained by dividing a distance between the transfer sections by the photoconductor circumferential length according to the second embodiment.

FIG. 34 is a graph illustrating a relation between an ideal amplitude ratio Y, which indicates a ratio of an ideal amplitude of the eccentric component $E_C$ of the C-photoconductor driving gear 83C that can theoretically zero specific color shift to an actual amplitude of the eccentric component $E_M$ of the M-photoconductor driving gear 83M, and a value obtained by dividing a distance L between the transfer sections by a photoconductor circumferential length $\pi R$ in the configuration according to the present embodiment. The Y-axis of the graph denotes a ratio of the amplitude of the eccentric component $E_C$ of the C-photoconductor driving gear 83C to the amplitude of the eccentric component $E_M$ of the M-photoconductor driving gear 83M.

A graph F1 depicted in FIG. 34 shows a trajectory of the ideal amplitude ratio Y that is depicted by run-out of a value obtained by dividing the distance L between the transfer sections by the photoconductor circumferential length $\pi R$ when the motor input angle $\alpha$ is 10° and the idler input angle $\beta$ is 40°. If values of the motor input angle $\alpha$ and the idler input angle $\beta$ are changed, the relation between the ideal amplitude ratio Y and a value obtained by dividing the distance L between the transfer sections by the photoconductor circumferential length $\pi R$ is also changed; however, in each case, a ratio of the amplitude of the eccentric component $E_C$ to the amplitude of the eccentric component $E_M$ is inevitably 1, and a value, obtained by dividing the distance L between the transfer sections by the photoconductor circumferential length $\pi R$, inevitably runs through a point of a positive integer. This means that even when the same gears having the same eccentric component are used as the C-photoconductor driving gear 83C and the M-photoconductor driving gear 83M, if the distance L between the transfer sections is configured to be an integral multiple of the photoconductor circumferential length $\pi R$, specific color shift can be eliminated regardless of values of the motor input angle $\alpha$ and the idler input angle $\beta$. However, such a configuration is used mostly to make the distance L between the transfer sections smaller than a value of the integral multiple of the photoconductor circumferential length $\pi R$, especially to make the distance L between the transfer sections smaller than the photoconductor circumferential length $\pi R$ for downsizing of the present printer.

The graph F1 (curvature) shown in FIG. 34 runs through a point where a ratio of the amplitude of the eccentric component $E_C$ to the amplitude of the eccentric component $E_M$ is 1 when the distance L between the transfer sections is smaller than a value of the integral multiple of the photoconductor circumferential length $\pi R$, specifically, a value obtained by dividing the distance L between the transfer sections by the photoconductor circumferential length $\pi R$ equals about 0.8. In the present embodiment, since the same gears are used as the C-photoconductor driving gear 83C and the M-photoconductor driving gear 83M, the ratio of the amplitude of the eccentric component $E_C$ to the amplitude of the eccentric component $E_M$ is 1. Therefore, in a case of the graph F1, if the motor input angle α is set at 10°, the idler input angle β is set at 40°, and the distance L between the transfer sections and the photoconductor circumferential length πR are set so that a value obtained by dividing the distance L between the transfer sections by the photoconductor circumferential length πR corresponds to a value of the X-axis when the Y-axis of the graph (a ratio of the amplitude of the eccentric component $E_C$ to the amplitude of the eccentric component $E_M$) is 1, even when the same gears are used as the C-photoconductor driving gear 83C and the M-photoconductor driving gear 83M, specific color shift can be eliminated with the distance L between the transfer sections set to be smaller than a value of the integral multiple of the photoconductor circumferential length πR.

Incidentally, there is no need to completely eliminate specific color shift in general, and it is only necessary to reduce the specific color shift to be within a required allowable range of an amount of specific color shift. The maximum allowable amount of specific color shift is supposedly set at about 10 μm in response to recent demands for high image quality. Thus, in the present embodiment, the diameter R of the photoconductors 1Y, 1M, and 1C, the distance L between the transfer sections, the motor input angle α, and the idler input angle β are set so that an absolute value of a value obtained by subtracting 1 from the ideal amplitude ratio Y is equal to or less than a maximum allowable amplitude ratio indicating a ratio of 10 μm which is the maximum allowable amount with respect to an actual amplitude of the eccentric component $E_M$ of the M-photoconductor driving gear 83M.

If the actual amplitude of the eccentric component $E_M$ of the M-photoconductor driving gear 83M is 15 μm, the maximum allowable amplitude ratio is about 0.7. In this case, by setting the diameter R of the photoconductors 1Y, 1M, and 1C, the distance L between the transfer sections, the motor input angle α, and the idler input angle β so that the ideal amplitude ratio Y is within a range of 0.3 to 1.7, an amount of specific color shift can be suppressed to 10 μm or less with the distance L between the transfer sections set to be smaller than a value of the integral multiple of the photoconductor circumferential length πR even when the same gears are used as the C-photoconductor driving gear 83C and the M-photoconductor driving gear 83M.

Subsequently, an example of a phase adjusting means, which is a rotational-position adjusting means for adjusting relative rotational positions (assembling positions) of the photoconductor driving gears 83Y, 83M, and 83C, is explained.

Figure 35:
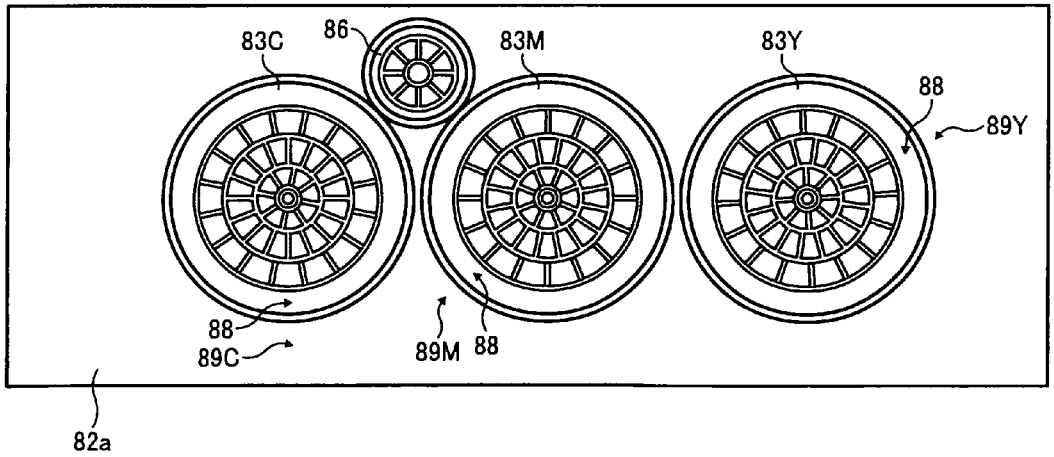
FIG. 35 is an explanatory diagram illustrating an example of a phase adjusting means that can be used in the second embodiment.

FIG. 35 is an explanatory diagram illustrating an example of the phase adjusting means that can be used in the present embodiment.

As the phase adjusting means, a phasing reference mark 88 is made on an axial end surface of each gear used as the photoconductor driving gears 83Y, 83M, and 83C. The mark 88 moves in circles centering around the gear shaft in accordance with the rotation of each of the photoconductor driving gears 83Y, 83M, and 83C. On the other hand, on the side of the holding member 82*a*, marks 89Y, 89M, and 89C are made on portions opposed (or closest) to the marks 88 when the rotational positions of the photoconductor driving gears 83Y, 83M, and 83C are adjusted as described above. Therefore, just by assembling these photoconductor driving gears 83Y, 83M, and 83C with the rotational positions adjusted so that the marks 88 are respectively opposed to the marks 89Y, 89M, and 89C, the rotational positions of the photoconductor driving gears 83Y, 83M, and 83C can be adjusted as described above, and color shift (including specific color shift) due to the eccentricities of the photoconductor driving gears 83Y, 83M, and 83C can be eliminated or reduced.

Figure 36:
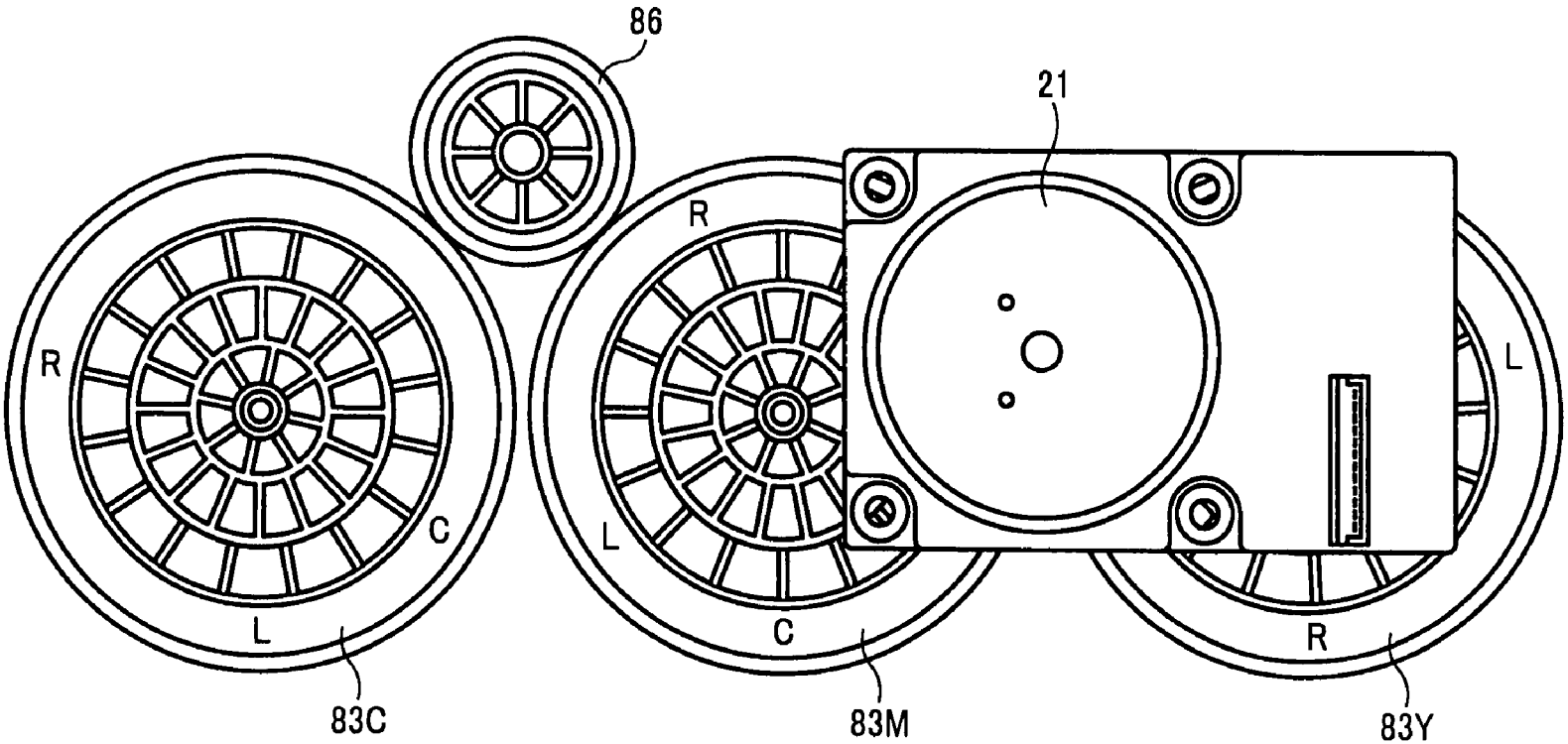
FIG. 36 is an explanatory diagram illustrating another example of the phase adjusting means that can be used in the second embodiment.

FIG. 36 is an explanatory diagram illustrating another example of the phase adjusting means that can be used in the embodiment.

In the phase adjusting means shown in FIG. 35, the positions of the marks 89Y, 89M, and 89C made on the side of the holding member 82*a* are limited, so an assembly worker may have difficulty seeing the marks 89Y, 89M, and 89C because the marks 89Y, 89M, and 89C are hidden behind other parts, or it may be difficult to make the marks 89Y, 89M, and 89C thereon.

In the phase adjusting means shown in FIG. 36, three phasing reference marks R, C, and L corresponding to the photoconductor driving gears 83Y, 83M, and 83C, respectively, are made on the axial end surface of each gear used as the photoconductor driving gears 83Y, 83M, and 83C. The marks R, C, and L are made at the positions on the axial end surface of each gear so that the mark R on the Y-photoconductor driving gear 83Y, the mark C on the M-photoconductor driving gear 83M, and the mark L on the C-photoconductor driving gear 83C are located at the same rotational positions as one another (for example, at the position on the lowest side in the case shown in FIG. 36) after the adjustment of the rotational positions. Therefore, just by assembling these photoconductor driving gears 83Y, 83M, and 83C with the rotational positions adjusted so that the corresponding marks R, C, and L on the photoconductor driving gears 83Y, 83M, and 83C are located at the same rotational positions as one another, the rotational positions of the photoconductor driving gears 83Y, 83M, and 83C can be adjusted as described above, and color shift (including specific color shift) due to the eccentricities of the photoconductor driving gears 83Y, 83M, and 83C can be eliminated or reduced.

Figure 37:
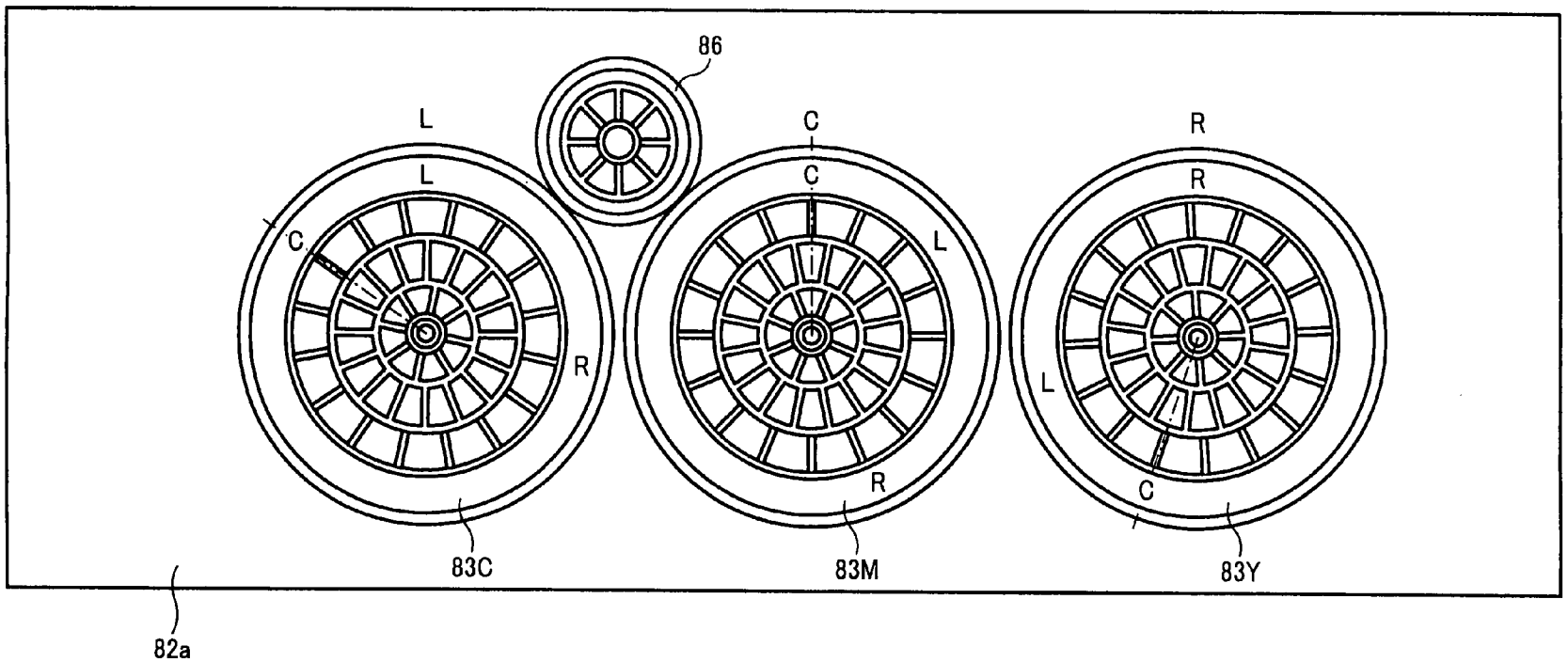
FIG. 37 is an explanatory diagram illustrating still another example of the phase adjusting means that can be used in the second embodiment.

FIG. 37 is an explanatory diagram illustrating still another example of the phase adjusting means that can be used in the embodiment.

In this example, in the same manner as the example shown in FIG. 36, three phasing reference marks R, C, and L corresponding to the photoconductor driving gears 83Y, 83M, and 83C, respectively, are made on the axial end surface of each gear used as the photoconductor driving gears 83Y, 83M, and 83C. Furthermore, on the side of the holding member 82*a*, the same marks R, C, and L are made on portions opposing (or closest) to the corresponding marks R, C, and L when the rotational positions of the photoconductor driving gears 83Y, 83M, and 83C are adjusted as described above. Therefore, just by assembling these photoconductor driving gears 83Y, 83M, and 83C with the rotational positions adjusted so that the marks R as for the Y-photoconductor driving gear 83Y, the marks C as for the M-photoconductor driving gear 83M, and the marks L as for the C-photoconductor driving gear 83C are opposed to each other, the rotational positions of the photoconductor driving gears 83Y, 83M, and 83C can be adjusted as described above, and color shift (including specific color shift) due to the eccentricities of the photoconductor driving gears 83Y, 83M, and 83C can be eliminated or reduced.

Figure 38:
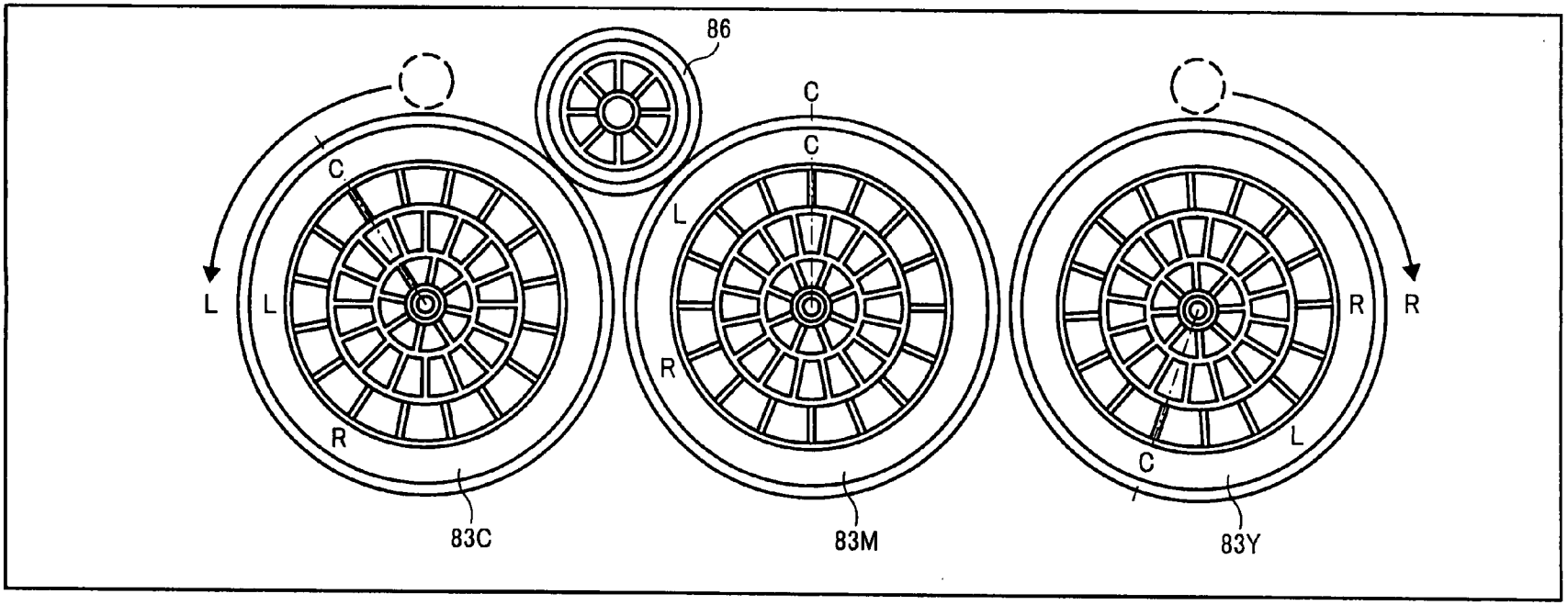
FIG. 38 is an explanatory diagram for explaining an example of how the phase adjusting means is used according to the second embodiment is used.

Furthermore, according to this example, if one wants to move the position of any of the marks R, C, and L on the side of the holding member 82*a* (for example, the mark for the Y-photoconductor driving gear 83Y), as shown in FIG. 38, for example, the mark corresponding to the Y-photoconductor driving gear 83Y and the mark corresponding to the C-photoconductor driving gear 83C are replaced with each other. Then, on the side of the holding member 82*a*, the same marks L, C, and R are made on portions opposed (or portions closest) to the corresponding marks L, C, and R after being subjected to the replacement when the rotational positions of the photoconductor driving gears 83Y, 83M, and 83C are adjusted as described above. In this manner, the positions of the marks on the side of the holding member 82*a* can be changed with the relation of the rotational positions of the photoconductor driving gears 83Y, 83M, and 83C shown in FIG. 37 remaining unchanged. Namely, by changing the positions of the marks on the side of the gears, the positions of the marks on the side of the holding member 82*a* can be freely changed. Consequently, it is possible to arrange the marks on the side of the gears or the marks on the side of the holding member 82*a* without hiding the marks behind other parts.

[Variation]

Subsequently, a variation of the drive unit of the color photoconductors 1Y, 1M, and 1C in the above embodiment is explained.

Figure 39:
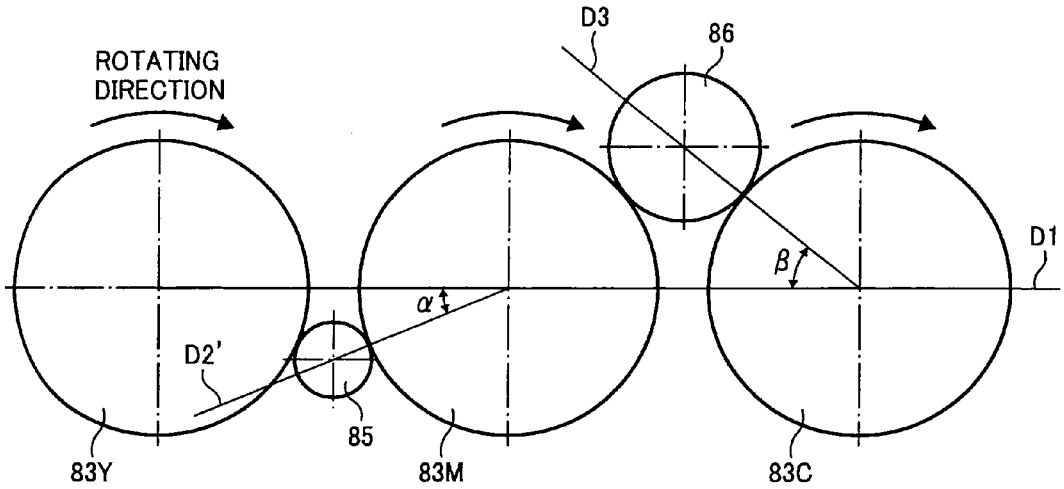
FIG. 39 is a schematic diagram illustrating a relative arrangement relation of the motor gear and the idler gear with respect to the three photoconductor driving gears according to a variation of the second embodiment.

FIG. 39 is a schematic diagram illustrating a relative arrangement relation of the motor gear 85 and the idler gear 86 with respect to the photoconductor driving gears 83Y, 83M, and 83C according to a variation of the present embodiment.

In the present variation, the motor gear 85 is arranged so that the rotation center of the motor gear 85 is located on the upstream side of the first virtual straight line D1 in the rotating direction of the M-photoconductor driving gear 83M when viewed in the direction of the rotating shaft of the motor gear 85. Thus, an angle (a motor input angle) $\alpha$ between the first virtual straight line D1 and a second virtual straight line D2' connecting the rotation center of the M-photoconductor driving gear 83M and the rotation center of the motor gear 85 is a negative value if the rotating direction of the M-photoconductor driving gear 83M (the clockwise direction in FIG. 39) is positive in the same manner as in the above embodiment. Furthermore, an idler input angle $\beta$ is a positive value in the same manner as in the above embodiment. Incidentally, the other configurations are identical to those in the above embodiment.

Figure 40:
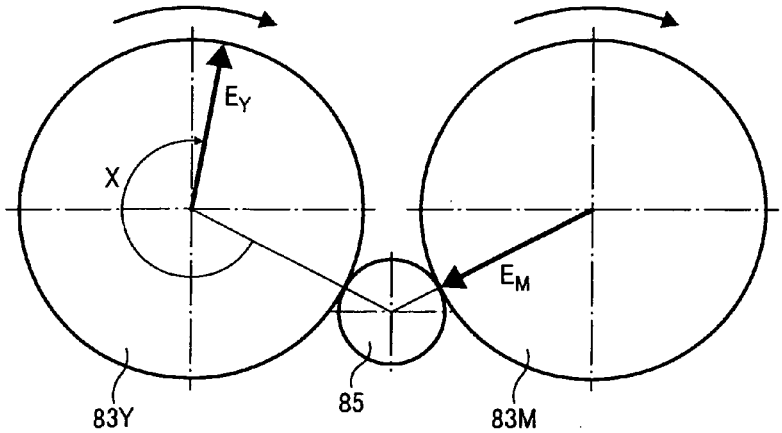
FIG. 40 is an explanatory diagram illustrating a phase relation of radial run-out due to eccentricity of the photoconductor driving gear in the two photoconductor driving gears directly connected to the motor gear according to the variation of the second embodiment.

FIG. 40 is an explanatory diagram illustrating a phase relation of radial run-out due to eccentricity of the photoconductor driving gear in the two photoconductor driving gears 83M and 83Y directly connected to the motor gear 85 according to the present variation.

Considering based on a point of time when the reference phase of the eccentric component $E_M$ of the photoconductor driving gear 83M of the M-photoconductor 1M, located on the downstream side in the surface moving direction of the intermediate transfer belt, points to the direction of the motor gear 85, it is only necessary to adjust the Y-photoconductor driving gear 83Y so that the reference phase of the eccentric component $E_Y$ points to the direction that the reference phase of the eccentric component $E_Y$ at the rotational position pointing to the direction of the motor gear 85 is rotated by X° calculated by the above Equation (17).

Figure 41:
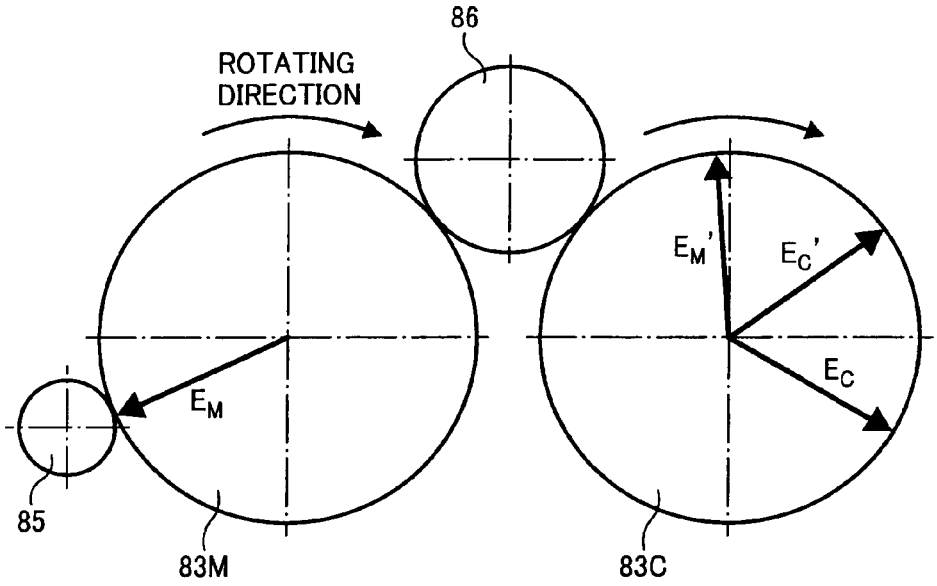
FIG. 41 is an explanatory diagram illustrating a phase relation of eccentric components of the photoconductor driving gears in the two photoconductor driving gears directly connected to the idler gear according to the variation of the second embodiment.

FIG. 41 is an explanatory diagram illustrating a phase relation of eccentric components of the photoconductor driving gears in the two photoconductor driving gears 83C and 83M directly connected to the idler gear 86 according to the present variation.

Figure 42:
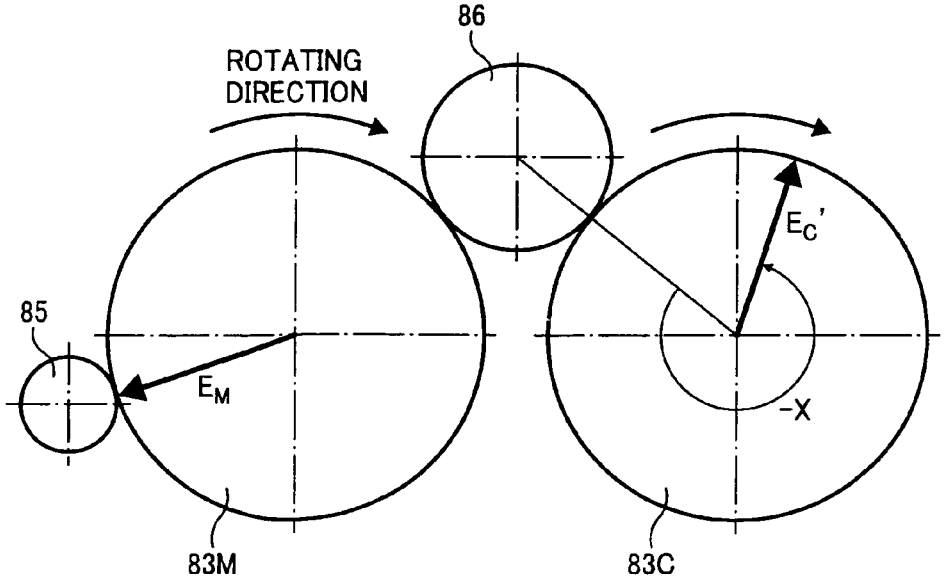
FIG. 42 is an explanatory diagram illustrating a phase relation of a composite eccentric component of the C-photoconductor driving gear and an eccentric component of the M-photoconductor driving gear according to the variation of the second embodiment.

In the same manner as in the embodiment described above, the C-photoconductor driving gear 83C has the lowest angular velocity when the reference phase of the composite eccentric component $E_C'$ points to the direction of the idler gear 86. Thus, as shown in FIG. 42, considering based on a point of time when the reference phase of the eccentric component $E_M$ of the photoconductor driving gear 83M of the M-photoconductor 1M points to the direction of the motor gear 85, if the C-photoconductor driving gear 83C is adjusted so that the reference phase of the composite eccentric component $E_C'$ points to the direction that the reference phase of the composite eccentric component $E_C'$ at the rotational position pointing to the direction of the idler gear 86 is counterrotated by X° calculated by the above Equation (17), toner images having the most contracted shape or toner images having the most elongated shape among those on the color photoconductors 1Y, 1M, and 1C are transferred onto the same point on the intermediate transfer belt 8.

Figure 43:
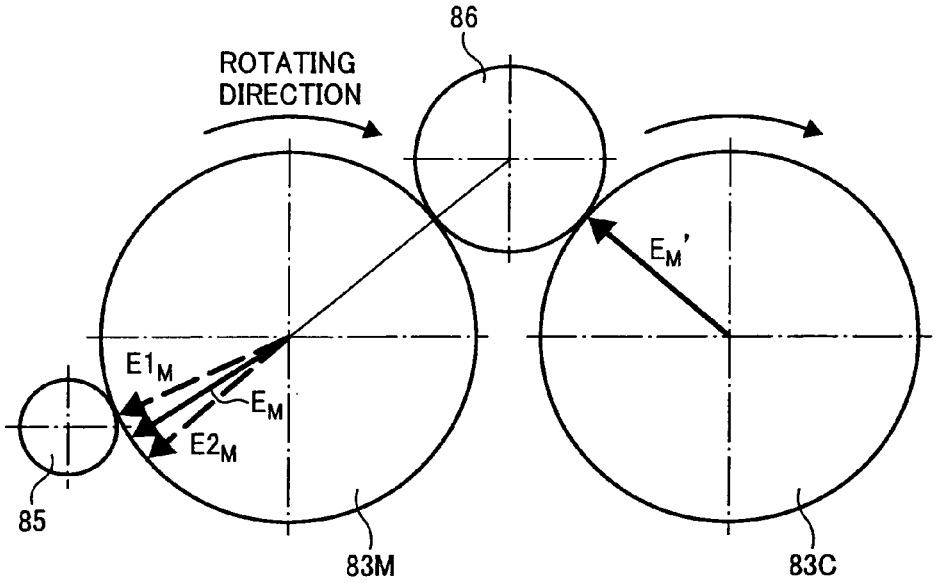
FIG. 43 is an explanatory diagram illustrating a positional relation of an eccentric component of the M-photoconductor driving gear and an eccentric component of the M-photoconductor driving gear transmitted to the C-photoconductor driving gear via the idler gear according to the variation of the second embodiment.

FIG. 43 is an explanatory diagram illustrating a positional relation of the eccentric component $E_M$ of the M-photoconductor driving gear 83M and the eccentric component $E_M'$ of the M-photoconductor driving gear 83M transmitted to the C-photoconductor driving gear 83C via the idler gear 86 according to the present variation.

Also in the present variation, when the idler gear 86 has the lowest angular velocity, the reference phase of the eccentric component $E_M$ of the M-photoconductor driving gear 83M points to the direction midway between the direction indicated by $E1_M$ and the direction indicated by $E2_M$. At this time, the idler gear 86 has the lowest angular velocity, which means that the C-photoconductor driving gear 83C has the lowest linear velocity. Therefore, at this time, the reference phase of the eccentric component $E_M'$ of the M-photoconductor driving gear 83M transmitted to the C-photoconductor driving gear 83C via the idler gear 86 points to the direction of the idler gear 86.

A rotation angle $\theta$, when the idler gear 86 has the lowest angular velocity, can be expressed by the above Equation (18) in the same manner as in the above embodiment, and an amplitude amplification factor Z, when the amplitude of the eccentric component $E_M$ of the M-photoconductor driving gear 83M is transmitted to the C-photoconductor driving gear 83C, is defined by the above Equation (19) in the same manner as in the above embodiment. Furthermore, when the eccentric component $E_M$ of the M-photoconductor driving gear 83M is defined by the above Equation (20), the composite eccentric component $E_C'$ on the C-photoconductor driving gear 83C is expressed by the above Equation (21) in the same manner as in the above embodiment, and the eccentric component $E_M'$ of the M-photoconductor driving gear 83M transmitted to the C-photoconductor driving gear 83C via the idler gear 86 is expressed by the above Equation (22) in the same manner as in the above embodiment. Therefore, also in the present variation, unless $(A^2+B^2)^{1/2}$, which is the amplitude of the eccentric component $E_C$ of the C-photoconductor driving gear 83C, is 1, the amplitude of the composite eccentric component $E_C'$ of the C-photoconductor driving gear 83C cannot coincide with the amplitude of the eccentric component $E_M$ of the M-photoconductor driving gear 83M. When these amplitudes are not coincident with each other, even if toner images having the most contracted shape or toner images having the most elongated shape among those on the color photoconductors 1Y, 1M, and 1C are adjusted to be transferred onto the same point on the intermediate transfer belt 8, specific color shift depending on a difference between the amplitudes occurs.

Also in the present variation, in the configuration that the same gears are used as the photoconductor driving gears 83Y, 83M, and 83C of the color photoconductors 1Y, 1M, and 1C, specific color shift due to the eccentric components $E_Y$, $E_M$, and $E_C$ of the photoconductor driving gears 83Y, 83M, and 83C is eliminated or reduced by employing the same configuration as the above embodiment. Incidentally, in general, it seems unlikely that the motor gear 85 and the idler gear 86 are bigger than the photoconductor driving gear, and thus the practically possible motor input angle α in the present embodiment is within a range of 0° to −60°, and the practically possible idler input angle β in the present embodiment is within a range of 0° to +60°.

Figure 44:
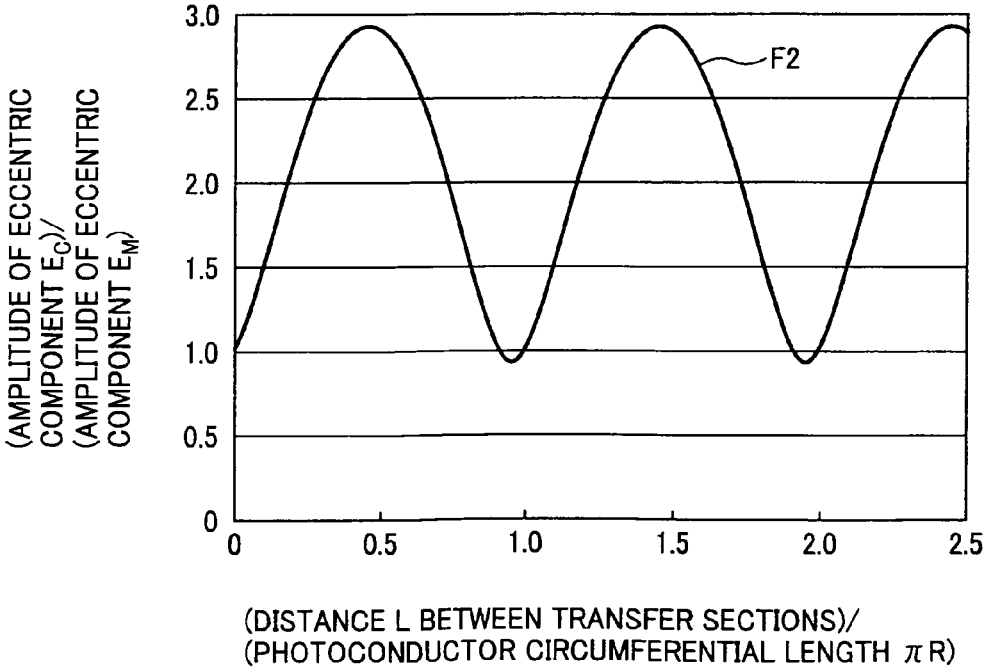
FIG. 44 is a graph illustrating a relation between an ideal amplitude ratio, which indicates a ratio of an ideal amplitude of an eccentric component of the C-photoconductor driving gear that can theoretically zero specific color shift to an actual amplitude of an eccentric component of the M-photoconductor driving gear, and a value obtained by dividing a distance between the transfer sections by the photoconductor circumferential length according to the variation of the second embodiment.

FIG. 44 is a graph illustrating a relation between an ideal amplitude ratio Y, which indicates a ratio of an ideal amplitude of the eccentric component $E_C$ of the C-photoconductor driving gear 83C that can theoretically zero specific color shift to an actual amplitude of the eccentric component $E_M$ of the M-photoconductor driving gear 83M, and a value obtained by dividing the distance L between the transfer sections by the photoconductor circumferential length πR in the configuration according to the present variation. The Y-axis of the graph denotes a ratio of the amplitude of the eccentric component $E_C$ of the C-photoconductor driving gear 83C to the amplitude of the eccentric component $E_M$ of the M-photoconductor driving gear 83M.

A graph F2 (curvature) showing a trajectory of the ideal amplitude ratio depicted in FIG. 44 is obtained in conditions that the motor input angle α is −10° and the idler input angle β is 40°. Also in the present variation, if values of the motor input angle α and the idler input angle β are changed, the relation between the ideal amplitude ratio Y and a value obtained by dividing the distance L between the transfer sections by the photoconductor circumferential length πR is changed. However, as described above, even when values of the motor input angle α and the idler input angle β are changed, a ratio of the amplitude of the eccentric component $E_C$ to the amplitude of the eccentric component $E_M$ is inevitably 1, and a value obtained by dividing the distance L between the transfer sections by the photoconductor circumferential length πR inevitably runs through a point of a positive integer. This means that even when the same gears having the same eccentric component are used as the C-photoconductor driving gear 83C and the M-photoconductor driving gear 83M, if the distance L between the transfer sections is configured to be an integral multiple of the photoconductor circumferential length πR, specific color shift can be eliminated regardless of values of the motor input angle α and the idler input angle β. However, such a configuration is used mostly to make the distance L between the transfer sections smaller than a value of the integral multiple of the photoconductor circumferential length πR, especially to make the distance L between the transfer sections smaller than the photoconductor circumferential length πR for downsizing of the present printer, so is not employed also in the present variation.

The graph F2 shown in FIG. 44 runs through a point where a ratio of the amplitude of the eccentric component $E_C$ to the amplitude of the eccentric component $E_M$ is 1 when the distance L between the transfer sections is smaller than a value of the integral multiple of the photoconductor circumferential length πR, specifically, when a value obtained by dividing the distance L between the transfer sections by the photoconductor circumferential length πR is around 0.9. In the present variation, since the same gears are used as the C-photoconductor driving gear 83C and the M-photoconductor driving gear 83M, the ratio of the amplitude of the eccentric component $E_C$ to the amplitude of the eccentric component $E_M$ is 1. Therefore, according to the present variation, if the motor input angle α is set at −10°, the idler input angle β is set at 40°, and the distance L between the transfer sections and the photoconductor circumferential length πR are set so that a value obtained by dividing the distance L between the transfer sections by the photoconductor circumferential length πR equals a value of the X-axis (around 0.9) when the Y-axis of the graph (a ratio of the amplitude of the eccentric component $E_C$ to the amplitude of the eccentric component $E_M$) is 1, even when the same gears are used as the C-photoconductor driving gear 83C and the M-photoconductor driving gear 83M, specific color shift can be eliminated with the distance L between the transfer sections set to be smaller than a value of the integral multiple of the photoconductor circumferential length πR.

As described above, since there is no need to completely eliminate specific color shift in general, in the present variation, the diameter R of the photoconductors 1Y, 1M, and 1C, the distance L between the transfer sections, the motor input angle α, and the idler input angle β are set so that an absolute value of a value obtained by subtracting 1 from the ideal amplitude ratio Y is equal to or less than a maximum allowable amplitude ratio indicating a ratio of 10 μm, which is the maximum allowable amount, to an actual amplitude of the eccentric component $E_M$ of the M-photoconductor driving gear 83M. If the actual amplitude of the eccentric component $E_M$ of the M-photoconductor driving gear 83M is 15 μm, the maximum allowable amplitude ratio is about 0.7. In this case, by setting the diameter R of the photoconductors 1Y, 1M, and 1C, the distance L between the transfer sections, the motor input angle α, and the idler input angle β so that the ideal amplitude ratio Y is within a range of 0.3 to 1.7, an amount of specific color shift can be suppressed to 10 μm or less with the distance L between the transfer sections set to be smaller than a value of the integral multiple of the photoconductor circumferential length πR even when the same gears are used as the C-photoconductor driving gear 83C and the M-photoconductor driving gear 83M.

In this manner, the printer according to the present embodiment (including the above variation) is a so-called tandem-type image forming apparatus that includes the photoconductors 1Y, 1M, 1C, and 1K, as two or more latent-image carriers of which the surfaces go around the respective latent-image carriers, to be aligned in the surface moving direction of the intermediate transfer belt 8, as an object onto which a toner image is to be transferred, and obtains a final image in such a manner that the image forming apparatus causes the surfaces of the photoconductors 1Y, 1M, 1C, and 1K to go around the respective photoconductors by transmitting a rotational driving force from the motor 81, as a drive source, to the photoconductor driving gears 83Y, 83M, 83C, and 83K, as respective driven transmission rotating bodies provided to the photoconductors, and transfers visible images (toner images), which are obtained by developing respective latent images on the surfaces of the photoconductors formed at predetermined latent-image forming points, onto the intermediate transfer belt 8 in a superimposed manner. The printer is configured so that a distance L between transfer sections of the two photoconductors 1C and 1M having the same diameter R deviates from a value of the integral multiple of the circumferential length πR of the two photoconductors 1C and 1M, and the C-photoconductor driving gear 83C as a first driven transmission rotating body provided to the C-photoconductor 1C as a first photoconductor located on the downstream side in the surface moving direction of the intermediate transfer belt out of the two photoconductors 1C and 1M and the M-photoconductor driving gear 83M as a second driven transmission rotating body provided to the M-photoconductor 1M as a second photoconductor located on the upstream side in the surface moving direction of the intermediate transfer belt are each made up of the same gear (rotating body) as each other. In this printer, relative rotational positions of the C-photoconductor driving gear 83C and the M-photoconductor driving gear 83M are set so that a phase of a fluctuation component of the angular velocity of the C-photoconductor driving gear 83C due to the eccentricity of the C-photoconductor driving gear 83C and the eccentricity of the M-photoconductor driving gear 83M at a point of time when a specific point on the intermediate transfer belt 8 passes through the transfer section of the C-photoconductor 1C coincides with a phase of a fluctuation component of the angular velocity of the M-photoconductor driving gear 83M due to the eccentricity of the M-photoconductor driving gear 83M at a point of time when the specific point passes through the transfer section of the M-photoconductor 1M. Consequently, toner images having the most contracted shape or toner images having the most elongated shape in the two photoconductors 1C and 1M are transferred onto the same point on the intermediate transfer belt 8. Furthermore, the motor gear 85, as a drive transmission rotating body connected to the side of the motor 81, is directly connected to the M-photoconductor driving gear 83M, and the idler gear 86, as a driven rotating body that rotates dependently, is directly connected to the C-photoconductor driving gear 83C and the M-photoconductor driving gear 83M, so that both the C-photoconductor 1C and the M-photoconductor 1M are driven by a rotational driving force transmitted through the motor gear 85. Thus, specific color shift occurs as described above. Therefore, in the present embodiment, the idler gear 86 is arranged so that the rotation center of the idler gear 86 is located on the upstream side of a first virtual straight line D1 connecting the rotation center of the C-photoconductor driving gear 83C and the rotation center of the M-photoconductor driving gear 83M in the rotating direction of the M-photoconductor driving gear 83M when viewed from the direction of the rotating shaft of the idler gear 86, and on the assumption that an angle between the first virtual straight line D1 and a second virtual straight line D2, D2' connecting the rotation center of the M-photoconductor driving gear 83M and the rotation center of the motor gear 85 when viewed from the direction of the rotating shaft of the idler gear 86 is defined as a with the rotating direction of the M-photoconductor driving gear 83M as positive, and an angle between the first virtual straight line D1 and a third virtual straight line D3 connecting the rotation center of the C-photoconductor driving gear 83C and the rotation center of the idler gear 86 when viewed from the direction of the rotating shaft of the idler gear 86 is defined as β with the rotating direction of the C-photoconductor driving gear 83C as positive, when an ideal amplitude ratio Y, which indicates a ratio of an ideal amplitude of the eccentric component of the C-photoconductor driving gear 83C that can theoretically zero relative transfer misalignment (specific color shift) which occurs between the C-photoconductor 1C and the M-photoconductor 1M due to the eccentricities of the C-photoconductor driving gear 83C and the M-photoconductor driving gear 83M to an actual amplitude of the eccentric component $E_M$, i.e., radial run-out of the M-photoconductor driving gear 83M due to the eccentricity that the M-photoconductor driving gear 83M has is defined by the above Equation (1), the diameter R of the two photoconductors 1C and 1M, the distance L between the transfer sections of the two photoconductors 1C and 1M, the motor input angle α, and the idler input angle β are set so that an absolute value of a value obtained by subtracting 1 from the ideal amplitude ratio Y is equal to or smaller than a maximum allowable amplitude ratio indicating a ratio of 10 μm, a maximum allowable amount of the specific color shift, to the actual amplitude of the eccentric component $E_M$ of the M-photoconductor driving gear 83M. Consequently, even when the distance L between the transfer sections is configured to deviate from a value of the integral multiple of the photoconductor circumferential length πR for the purpose of downsizing or the like, an amount of specific color shift that may occur between the two photoconductor driving gears 83C and 83M connected to each other via the idler gear 86 can be reduced to 10 μm or less.

Specifically, if the absolute value of the value obtained by subtracting 1 from the ideal amplitude ratio Y is set to 0.7 or less, even when a gear having a general amount of eccentricity is used as the photoconductor driving gears 83C and 83M, an amount of specific color shift can be reduced to 10 μm or less.

Furthermore, if the absolute value of the value obtained by subtracting 1 from the ideal amplitude ratio Y is set to 0.06 or less, an amount of specific color shift can be significantly reduced, and thus it is possible to achieve a higher image quality. Moreover, as a result of the significant reduction in amount of specific color shift, an allowable amount of color shift caused by other color-shift variation factors can be relatively increased, and thus it is possible to achieve benefits such as an increase in degree of freedom in designing the entire apparatus and the like.

Furthermore, in the present embodiment, the motor gear 85 and the idler gear 86 are configured to rotate an integer number of times while the surfaces of the two photoconductors 1C and 1M each move from a predetermined latent-image forming point (the exposure section) to the transfer section onto the intermediate transfer belt 8. Thus, it is possible to prevent influences of the eccentricities of the motor gear 85 and the idler gear 86 from showing up as color shift.

Moreover, as in the present embodiment, by providing the phase adjusting means as a rotational-position adjusting means for adjusting relative rotational positions of the C-photoconductor driving gear 83C and the M-photoconductor driving gear 83M, the adjustment can be made easily.

Specifically, as described above, as the phase adjusting means, a first mark R and a second mark C are made on the same gears used as the C-photoconductor driving gear 83C and the M-photoconductor driving gear 83M so that the first mark R and the second mark C move in accordance with rotation of the gears, and specifically, the first mark R and the second mark C are made so that the first mark R on the C-photoconductor driving gear 83C and the second mark C on the M-photoconductor driving gear 83M are located at the same rotational positions as each other after the adjustment of the relative rotational positions, whereby the adjustment can be made easily without any interference of other parts.

Furthermore, as described above, as the phase adjusting means, the first mark R and the second mark C are made on the same gears used as the C-photoconductor driving gear 83C and the M-photoconductor driving gear 83M so that the first mark R and the second mark C move in accordance with rotation of the gears, and a third mark R corresponding to the first mark R and a fourth mark C corresponding to the second mark C are made on the holding member 82*a* as a holding member for holding the C-photoconductor driving gear 83C and the M-photoconductor driving gear 83M; the first mark R is made, if the gear is used as the C-photoconductor driving gear 83C, so as to be located at the rotational position closest to the third mark R on the holding member 82*a* after the adjustment of the relative rotational positions, and the second mark C is made, if the gear is used as the M-photoconductor driving gear 83M, so as to be located at the rotational position closest to the fourth mark C on the holding member 82*a* after the adjustment of the relative rotational positions, and thus the adjustment can be made just by aligning the mark on the gear with the mark on the holding member 82*a*, so it is easy to make the adjustment.

According to the present invention, when a distance between transfer sections of first and second latent-image carriers is configured to deviate from a value of an integral multiple of the circumferential length of these latent-image carriers for downsizing of the apparatus or the like, an amount of specific color shift that may occur between two driven transmission rotating bodies connected to each other via a driven rotating body can be reduced to 10 μm or less even if the same rotating bodies are used as these driven transmission rotating bodies.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that includes two or more latent-image carriers of which the surfaces go around the respective latent-image carriers to be aligned in a surface moving direction of an object onto which visible images are to be transferred, and obtains a final image in such a manner that the image forming apparatus causes the surfaces of the latent-image carriers to go around the respective latent-image carriers by transmitting a rotational driving force from a drive source to respective driven transmission rotating bodies provided to the latent-image carriers, and transfers visible images, which are obtained by developing respective latent images on the surfaces of the latent-image carriers formed at predetermined latent-image forming points, onto the object in a superimposed manner, wherein a distance L between transfer sections of two latent-image carriers having the same diameter R is configured to deviate from a value of an integral multiple of a circumferential length πR of the two latent-image carriers, a first driven transmission rotating body provided to a first latent-image carrier, one located on the upstream side in the surface moving direction of the object out of the two latent-image carriers, and a second driven transmission rotating body provided to a second latent-image carrier, the other one located on the downstream side in the surface moving direction of the object out of the two latent-image carriers, are each made up of the same rotating body, relative rotational positions of the first driven transmission rotating body and the second driven transmission rotating body are set so that a phase of a fluctuation component of angular velocity of the first driven transmission rotating body due to eccentricity of the first driven transmission rotating body and eccentricity of the second driven transmission rotating body at a point of time when a specific point on the object passes through the transfer section of the first latent-image carrier coincides with a phase of a fluctuation component of angular velocity of the second driven transmission rotating body due to the eccentricity of the second driven transmission rotating body at a point of time when the specific point passes through the transfer section of the second latent-image carrier, a drive transmission rotating body connected to the side of the drive source is directly connected to the second driven transmission rotating body, and a driven rotating body, which rotates dependently, is directly connected to the first driven transmission rotating body and the second driven transmission rotating body, whereby both the first latent-image carrier and the second latent-image carrier are driven by the rotational driving force transmitted through the drive transmission rotating body, and on the assumption that an angle between the first virtual straight line and a second virtual straight line connecting the rotation center of the second driven transmission rotating body and the rotation center of the drive transmission rotating body when viewed from the direction of the rotating shaft of the driven rotating body is defined as α with a direction opposite to the rotating direction of the second driven transmission rotating body as positive, and an angle between the first virtual straight line and a third virtual straight line connecting the rotation center of the first driven transmission rotating body and the rotation center of the driven rotating body when viewed from the direction of the rotating shaft of the driven rotating body is defined as β with a direction opposite to a rotating direction of the first driven transmission rotating body as positive, when an ideal amplitude ratio Y, which indicates a ratio of an ideal amplitude of radial run-out of the first driven transmission rotating body that can theoretically zero relative transfer misalignment which occurs between the first latent-image carrier and the second latent-image carrier due to the eccentricities of the first driven transmission rotating body and the second driven transmission rotating body to an actual amplitude of radial run-out of the second driven transmission rotating body due to the eccentricity that the second driven transmission rotating body has, is defined by the following Equation (1), the diameter R of the two latent-image carriers, the distance L between the transfer sections of the two latent-image carriers, the angle α, and the angle β are set so that an absolute value of a value obtained by subtracting 1 from the ideal amplitude ratio Y is equal to or smaller than a maximum allowable amplitude ratio indicating a ratio of 10 μm, a maximum allowable amount of the transfer misalignment, to the actual amplitude of the radial run-out of the second driven transmission rotating body:

$$Y=\sqrt{A^2+B^2}\cos(\omega t-C) \tag{1}$$

a period of Y being L/πR, and A, B, and C in the above Equation (1) being defined by the following Equations (2) to (4), respectively:

$$A=\cos(X+\alpha-\beta)-Z\times\cos(\theta-\beta) \tag{2}$$

$$B=\sin(X+\alpha-\beta)-Z\times\sin(\theta-\beta) \tag{3}$$

$$\cos C=\frac{A}{\sqrt{A^2+B^2}} \tag{4}$$

X and Z in the above Equations (2) and (3) being defined by the following Equations (5) and (6), respectively:

$$X[°]=\frac{L-\pi R}{\pi R}\times 360 \tag{5}$$

$$Z=\sqrt{(|A_M|\cos\theta_M+|A_M|\cos(\theta_I+\pi))^2+(|A_M|\sin\theta_M+|A_M|\sin(\theta_I+\pi))^2} \tag{6}$$

$A_M$ denoting an amplitude of the eccentricity of the second driven transmission rotating body, $\theta_M$ equaling α, and $\theta_I$ equaling (180−β).

2. The image forming apparatus according to claim 1, wherein the diameter R of the two latent-image carriers, the distance L between the transfer sections of the two latent-image carriers, the angle α, and the angle β are set so that the absolute value of the value obtained by subtracting 1 from the ideal amplitude ratio Y is 0.7 or less.

3. The image forming apparatus according to claim 1, wherein the diameter R of the two latent-image carriers, the distance L between the transfer sections of the two latent-image carriers, the angle α, and the angle β are set so that the absolute value of the value obtained by subtracting 1 from the ideal amplitude ratio Y is 0.06 or less.

4. The image forming apparatus according to claim 1, wherein the drive transmission rotating body and the driven rotating body are configured to rotate an integer number of times while the surfaces of the two latent-image carriers each move from the predetermined latent-image forming point to the transfer section where the visible image is transferred onto the object.

5. The image forming apparatus according to claim 1, further comprising a rotational-position adjusting means for adjusting the relative rotational positions of the first driven transmission rotating body and the second driven transmission rotating body.

6. The image forming apparatus according to claim 5, wherein the rotational-position adjusting means is composed of a first mark and a second mark that are made on each of the same rotating bodies used as the first driven transmission rotating body and the second driven transmission rotating body so as to run in circles in accordance with rotation of the respective rotating bodies, and the first mark and the second mark are made on each of the same rotating bodies so that the first mark on the first driven transmission rotating body and the second mark on the second driven transmission rotating body are located at the same rotational positions as each other after the relative rotational positions are adjusted.

7. The image forming apparatus according to claim 5, wherein the rotational-position adjusting means is composed of a first mark, a second mark, a third mark corresponding to the first mark, and a fourth mark corresponding to the second mark, the first and second marks being made on each of the same rotating bodies used as the first driven transmission rotating body and the second driven transmission rotating body so as to run in circles in accordance with rotation of the respective rotating bodies, and the third and fourth marks being made on a holding member for holding the first driven transmission rotating body and the second driven transmission rotating body, the first mark is made on each of the same rotating bodies so that the first mark made on the rotating body used as the first driven transmission rotating body is located at a rotational position closest to the third mark made on the holding member after the relative rotational positions are adjusted, and the second mark is made on each of the same rotating bodies so that the second mark made on the rotating body used as the second driven transmission rotating body is located at a rotational position closest to the fourth mark made on the holding member after the relative rotational positions are adjusted.

8. An image forming apparatus that includes two or more latent-image carriers of which the surfaces go around the respective latent-image carriers to be aligned in a surface moving direction of an object onto which visible images are to be transferred, and obtains a final image in such a manner that the image forming apparatus causes the surfaces of the latent-image carriers to go around the respective latent-image carriers by transmitting a rotational driving force from a drive source to respective driven transmission rotating bodies provided to the latent-image carriers, and transfers visible images, which are obtained by developing respective latent images on the surfaces of the latent-image carriers formed at predetermined latent-image forming points, onto the object in a superimposed manner, wherein a distance L between transfer sections of two latent-image carriers having the same diameter R is configured to deviate from a value of an integral multiple of a circumferential length πR of the two latent-image carriers, a first driven transmission rotating body provided to a first latent-image carrier, one located on the downstream side in the surface moving direction of the object out of the two latent-image carriers, and a second driven transmission rotating body provided to a second latent-image carrier, the other one located on the upstream side in the surface moving direction of the object out of the two latent-image carriers, are each made up of the same rotating body, relative rotational positions of the first driven transmission rotating body and the second driven transmission rotating body are set so that a phase of a fluctuation component of angular velocity of the first driven transmission rotating body due to eccentricity of the first driven transmission rotating body and eccentricity of the second driven transmission rotating body at a point of time when a specific point on the object passes through the transfer section of the first latent-image carrier coincides with a phase of a fluctuation component of angular velocity of the second driven transmission rotating body due to the eccentricity of the second driven transmission rotating body at a point of time when the specific point passes through the transfer section of the second latent-image carrier, a drive transmission rotating body connected to the side of the drive source is directly connected to the second driven transmission rotating body, and a driven rotating body, which rotates dependently, is directly connected to the first driven transmission rotating body and the second driven transmission rotating body, whereby both the first latent-image carrier and the second latent-image carrier are driven by the rotational driving force transmitted through the drive transmission rotating body, the driven rotating body is arranged so that the rotation center of the driven rotating body is located on the upstream side of a first virtual straight line connecting the rotation center of the first driven transmission rotating body and the rotation center of the second driven transmission rotating body in a rotating direction of the second driven transmission rotating body when viewed from a direction of a rotating shaft of the driven rotating body, and on the assumption that an angle between the first virtual straight line and a second virtual straight line connecting the rotation center of the second driven transmission rotating body and the rotation center of the drive transmission rotating body when viewed from the direction of the rotating shaft of the driven rotating body is defined as α with the rotating direction of the second driven transmission rotating body as positive, and an angle between the first virtual straight line and a third virtual straight line connecting the rotation center of the first driven transmission rotating body and the rotation center of the driven rotating body when viewed from the direction of the rotating shaft of the driven rotating body is defined as β with a rotating direction of the first driven transmission rotating body as positive, when an ideal amplitude ratio Y, which indicates a ratio of an ideal amplitude of radial run-out of the first driven transmission rotating body that can theoretically zero relative transfer misalignment which occurs between the first latent-image carrier and the second latent-image carrier due to the eccentricities of the first driven transmission rotating body and the second driven transmission rotating body to an actual amplitude of radial run-out of the second driven transmission rotating body due to the eccentricity that the second driven transmission rotating body has, is defined by the following Equation (11), the diameter R of the two latent-image carriers, the distance L between the transfer sections of the two latent-image carriers, the angle α, and the angle β are set so that an absolute value of a value obtained by subtracting 1 from the ideal amplitude ratio Y is equal to or smaller than a maximum allowable amplitude ratio indicating a ratio of 10 μm, a maximum allowable amount of the transfer misalignment, to the actual amplitude of the radial run-out of the second driven transmission rotating body:

$$Y=\sqrt{A^2+B^2}\cos(\omega t-C) \tag{1}$$

a period of Y being L/πR, and A, B, and C in the above Equation (1) being defined by the following Equations (12) to (14), respectively:

$$A = \cos(-X+\alpha-\beta) - Z\times\cos(\theta+\beta-180) \tag{12}$$

$$B = \sin(-X+\alpha-\beta) - Z\times\sin(\theta+\beta-180) \tag{13}$$

$$\cos C = \frac{A}{\sqrt{A^2+B^2}} \tag{4}$$

X and Z in the above Equations (12) and (13) being defined by the following Equations (15) and (16), respectively:

$$X[^\circ] = \frac{L-\pi R}{\pi R}\times 360 \tag{15}$$

$$Z = \sqrt{\begin{array}{l}(|A_M|\cos\theta_M + |A_M|\cos(\theta_I+\pi))^2 + \\ (|A_M|\sin\theta_M + |A_M|\sin(\theta_I+\pi))^2\end{array}} \tag{16}$$

$A_M$ denoting an amplitude of the eccentricity of the second driven transmission rotating body, $\theta_M$ equaling 180−α, and $\theta_I$ equaling β.

9. The image forming apparatus according to claim 8, wherein the diameter R of the two latent-image carriers, the distance L between the transfer sections of the two latent-image carriers, the angle α, and the angle β are set so that the absolute value of the value obtained by subtracting 1 from the ideal amplitude ratio Y is 0.7 or less.

10. The image forming apparatus according to claim 8, wherein the diameter R of the two latent-image carriers, the distance L between the transfer sections of the two latent-image carriers, the angle α, and the angle β are set so that the absolute value of the value obtained by subtracting 1 from the ideal amplitude ratio Y is 0.6 or less.

11. The image forming apparatus according to claim 8, wherein the drive transmission rotating body and the driven rotating body are configured to rotate an integer number of times while the surfaces of the two latent-image carriers each move from the predetermined latent-image forming point to the transfer section where the visible image is transferred onto the object.

12. The image forming apparatus according to claim 8, further comprising a rotational-position adjusting means for adjusting the relative rotational positions of the first driven transmission rotating body and the second driven transmission rotating body.

13. The image forming apparatus according to claim 12, wherein the rotational-position adjusting means is composed of a first mark and a second mark that are made on each of the same rotating bodies used as the first driven transmission rotating body and the second driven transmission rotating body so as to run in circles in accordance with rotation of the respective rotating bodies, and the first mark and the second mark are made on each of the same rotating bodies so that the first mark on the first driven transmission rotating body and the second mark on the second driven transmission rotating body are located at the same rotational positions as each other after the relative rotational positions are adjusted.

14. The image forming apparatus according to claim 12, wherein the rotational-position adjusting means is composed of a first mark, a second mark, a third mark corresponding to the first mark, and a fourth mark corresponding to the second mark, the first and second marks being made on each of the same rotating bodies used as the first driven transmission rotating body and the second driven transmission rotating body so as to run in circles in accordance with rotation of the respective rotating bodies, and the third and fourth marks being made on a holding member for holding the first driven transmission rotating body and the second driven transmission rotating body, the first mark is made on each of the same rotating bodies so that the first mark made on the rotating body used as the first driven transmission rotating body is located at a rotational position closest to the third mark made on the holding member after the relative rotational positions are adjusted, and the second mark is made on each of the same rotating bodies so that the second mark made on the rotating body used as the second driven transmission rotating body is located at a rotational position closest to the fourth mark made on the holding member after the relative rotational positions are adjusted.

* * * * *